US007940950B2

(12) United States Patent
Shim

(10) Patent No.: US 7,940,950 B2
(45) Date of Patent: May 10, 2011

(54) ELECTROMAGNETICALLY-SHIELDED SPEAKER SYSTEMS AND METHODS

(76) Inventor: Youngtack Shim, Port Moody (CA)

( * ) Notice: Subject to any disclaimer, the term of this patent is extended or adjusted under 35 U.S.C. 154(b) by 1347 days.

(21) Appl. No.: 11/440,135

(22) Filed: May 25, 2006

(65) Prior Publication Data

US 2007/0092093 A1 Apr. 26, 2007

Related U.S. Application Data

(60) Provisional application No. 60/723,274, filed on Oct. 3, 2005.

(51) Int. Cl.

| | |
|---|---|
| ***H04R 1/02*** | (2006.01) |
| ***H04R 25/00*** | (2006.01) |
| ***H04R 1/00*** | (2006.01) |
| ***H04R 9/06*** | (2006.01) |
| ***H04R 11/02*** | (2006.01) |

(52) U.S. Cl. ..... 381/393; 381/189; 381/394; 381/401

(58) Field of Classification Search ..... 381/96, 381/189, 386, 393, 394, 400, 401, 413, 414, 381/433

See application file for complete search history.

(56) References Cited

U.S. PATENT DOCUMENTS

| | | | | |
|---|---|---|---|---|
| 5,832,096 | A * | 11/1998 | Hall | 381/401 |
| 6,466,679 | B1 * | 10/2002 | Husung | 381/189 |
| 2004/0208337 | A1 * | 10/2004 | Anciant | 381/401 |

* cited by examiner

*Primary Examiner* — Lana N Le
*Assistant Examiner* — Jesse A Elbin
(74) *Attorney, Agent, or Firm* — Stein McEwen, LLP

(57) ABSTRACT

The present invention relates to electromagnetically-shielded speaker (or microphone) systems for generating acoustic sounds (or electric signals) based upon electric signals (or acoustic sounds) supplied thereto while minimizing irradiation of undesirable electromagnetic waves. More particularly, the present invention relates to various speaker systems each of which has at least one source for emitting the undesirable waves and at least one counter member for emitting counter electromagnetic waves capable of canceling at least a substantial portion of the undesirable waves due to their phase characteristics. The present invention instead relates to various speaker systems each of which has at least one electric and/or magnetic shields capable of shielding and/or terminating electric waves and magnetic waves of the undesirable waves, respectively. The present invention also relates to various methods of minimizing irradiation of the undesirable waves by such counter members, various methods of shielding the undesirable waves by the electric and/or magnetic shields, and the like. The present invention further relates to various processes for providing such systems, counter members thereof, electric and/or magnetic shields therefor, and the like.

3 Claims, 9 Drawing Sheets

ELECTROMAGNETICALLY-SHIELDED SPEAKER SYSTEMS AND METHODS

CROSS-REFERENCES TO RELATED APPLICATIONS

The present application is related to various patent applications which have been filed by the same Applicant. The first is the U.S. Utility Patent Application entitled "Shunted Magnet Systems and Metho-ds," filed on Aug. 30, 2005, and bearing a Ser. No. 11/213,703. The second is the U.S. Utility Patent Application entitled "Magnet-Shunted Systems and Methods," filed on Aug. 30, 2005, and bearing a Ser. No. 11/213,686. The third is the U.S. Provisional Patent Application entitled "Electromagnetic Shield Systems and Methods," filed on Oct. 3, 2005, and bearing a U.S. Ser. No. 60/723,274, and the Disclosure Document entitled the same, deposited in the U.S. Patent and Trademark Office (the "Office") on Oct. 3, 2005 under the Disclosure Document Deposit Program (the "DDDP") of the Office, and bearing a Ser. No. 587,338. The fourth is the U.S. Utility Patent Application which is entitled "Electromagnetically-Shielded Heat Generating Systems and Methods," filed on Nov. 30, 2005 and bears a Ser. No. 11/289,693. The fifth is the U.S. Utility Patent Application which is entitled "Electromagnetically-Shielded Hair Drying Systems and Methods," filed on Nov. 30, 2005, and bears a U.S. Ser. No. 11/289,578. The sixth is another U.S. Utility Patent Application entitled "Electromagnetically-Shielded Air Heating Systems and Methods," filed on Dec. 22, 2005 and bearing a U.S. Ser. No. 11/313,921. The last is another U.S. Utility Patent Application entitled, "Electromagnetically-Shielded High-Temperature Systems and Methods," which was filed on Apr. 11, 2006 and bears a U.S. Ser. No. 11/403,899. All of the above Applications and Documents will now be referred to as the "co-pending Applications" hereinafter and all "co-pending Applications" are to be incorporated herein in their entirety by reference.

FIELD OF THE INVENTION

The present invention relates to electromagnetically-shielded speaker (or microphone) systems for generating acoustic sounds (or electric signals) based upon electric signals (or acoustic sounds) supplied thereto while minimizing irradiation of undesirable electromagnetic waves. More particularly, the present invention relates to various speaker systems each of which has at least one source for emitting the undesirable waves and at least one counter member for emitting counter electromagnetic waves capable of canceling at least a substantial portion of the undesirable waves due to their phase characteristics. The present invention instead relates to various speaker systems each of which has at least one electric and/or magnetic shields capable of shielding and/or terminating electric waves and magnetic waves of the undesirable waves, respectively. The present invention also relates to various methods of minimizing irradiation of the undesirable waves by such counter members, various methods of shielding the undesirable waves by the electric and/or magnetic shields, and the like. The present invention further relates to various processes for providing such systems, counter members thereof, electric and/or magnetic shields therefor, and the like.

BACKGROUND OF THE INVENTION

It is now well established in the scientific community that electromagnetic waves with varying frequencies irradiated by various devices may be hazardous to human health. In some cases, such electromagnetic waves in mega- and giag-hertz range may be the main culprit, whereas the 60-hertz electromagnetic waves may be the main health concern in other cases. It cannot be too emphasized that it is very difficult to shield against magnetic waves of the 60-hertz electromagnetic waves which have wavelengths amounting to thousands of kilometers and that such 60-hertz magnetic waves are omnipresent in any corner of the current civilization.

However, intensity of such electromagnetic waves typically decreases inversely proportional to a square of a distance from a source of such waves to a target. Accordingly, potentially adverse effects from such electromagnetic waves may be minimized by maintaining a safe distance from such a source. Some electrical devices, however, are intended to be used in a close proximity to an user, where typical examples of such devices are hair dryers, hair curlers, electric mattresses or blankets, heating pads, and the like. Accordingly, the Applicant have disclosed numerous electromagnetically-shielded embodiments of such devices.

In contrary to the above devices, conventional electric speakers operate with electric currents having amplitudes lot less than those flowing in such devices. However, certain speakers included in earphones, headphones, cellular phones, and handsets of regular phones are to be disposed close to an ear of an user. Accordingly, although these speakers may emit the electromagnetic waves having less amplitudes, such speakers tend to irradiate the electromagnetic waves directly to brain cells in a close proximity thereto. In particular, the earphones are to be disposed into an ear canal of the ear so that the electromagnetic waves irradiated therefrom may reach the brain cells at a less distance and, therefore, with greater strengths. It is appreciated that the irradiation of such undesirable waves may not be prevented by operating the speakers by a DC current, for such speakers generate the sounds through fluctuating electric currents which inevitably irradiate such electromagnetic waves.

Electromagnetic waves have been proved to affect physiological activities of brain cells. For example, U.S. Pat. Nos. 4,940,453, 5,047,005, 5,061,234, 5,066,272, and 5,267,938 describe various apparatus and methods for stimulating the brain cells by impinging thereto electromagnetic waves. In more recent disclosures, both of U.S. Pat. No. 6,849,040 B2 issued to J. Ruohonen et al. on Feb. 1, 2005 and U.S. Pat. Appl. Pub. No. 2003/0073899 A1 of the same inventors published on Apr. 17, 2003 disclose dose-computing apparatus and method for determining effects of magnetic stimulation on human brain. However, the prior art does not provide any speakers capable of reducing irradiation of the harmful electromagnetic waves to the brain cells of the user.

For example, U.S. Pat. No. 6,590,539 B2 issued to H. Shinichi on Jul. 8, 2003 and another U.S. Pat. Appl. Pub. No. 2002/0060645 A1 of the same inventor published on May 23, 2002 describe dipole antennas of portable communication devices capable of reducing specific absorption rate or "SAR" of electromagnetic waves (to be abbreviated as "EM waves" hereinafter) emitted by such devices. U.S. Pat. No. 6,377,827 B1 issued to N. Rydbeck on Apr. 23, 2002 describes mobile communication devices with foldable antennas which may be disposed away from users during use to reduce the EM waves propagating to the brains of the users, while U.S. Pat. No. 6,246,374 B1 issued to A. Perrotta et al. on Jun. 12, 2001 discloses antenna assemblies of mobile communication devices with main and parasitic antennas disposed away from the users for reducing the EM waves during use. In addition, U.S. Pat. No. 5,586,168 issued to B. Bucalo et al. on Dec. 17, 1996 similarly discloses multi-piece cellular communication devices including antennas disposed toward and away from the rest of such devices and reducing such EM waves emitted thereby. Although these prior art devices may reduce a portion of such EM waves, they fail to reduce the EM waves irradiated to the user from their speakers.

In another class of examples, U.S. Pat. No. 6,418,273 B1 issued to J. Lubinski et al. on Jul. 9, 2002 describes portable CD player devices incorporating less semiconductor devices and minimizing irradiation of the EM waves, while U.S. Pat. No. 6,195,562 B1 issued to R. Pirhonen et al. on Feb. 27, 2001 discloses mobile communication devices capable of restricting maximum transmitting power thereof, thereby limiting power of their EM waves radiated thereby. U.S. Pat. No. 5,777,261 issued to J. Katz on Jul. 7, 1998 discloses mobile communication devices having cases capable of attenuating and diverting their EM waves irradiated thereby, and U.S. Pat. Appl. Pub. No. 2004/0170086 A1 of Y. Mayer et al. published on Sep. 2, 2004 describes microphone devices which may not employ any membranes. U.S. Pat. Appl. Pub. No. 2003/0002691 A1 of H. Ono et al. published on Jan. 2, 2003 describes earphones for portable communication devices capable of being attached thereto at distances and reducing irradiation of the EM waves, while U.S. Pat. Appl. Pub. No. 2002/0098862 A1 of E. Engstrom published on Jul. 25, 2002 describes mobile communication devices with speakers and antennas disposed away from heads of users for reducing exposure of the users to the EM waves from the speakers and antennas thereof. In addition, U.S. Pat. Appl. Pub. No. 2001/0034253 A1 of S. Ruschin published on Oct. 25, 2001 describes mobile communication devices with speakers and microphones coupled by optical paths for reducing radiation of EM waves. Although some of these prior art devices have recognized potential hazards from their speakers, none of the prior art devices teach how to reduce the irradiation of the EM waves from the speakers of such devices.

The prior art also discloses various acoustic paths capable of delivering sounds therethrough. Thus, U.S. Pat. No. 6,825,810 B2 issued to G. Ragner et al. on Nov. 30, 2004 and U.S. Pat. Appl. Pub. No. 2003/0132884 A1 of the same inventors published on Jul. 17, 2003 describe various mobile communication devices employing air channels to route sounds from their speakers to their earpieces, while U.S. Pat. No. 6,631,279 B2 issued to A. Rivera on Oct. 7, 2003 and U.S. Pat. Appl. Pub. No. 2002/0055374 A1 by the same inventor published on May 9, 2002 disclose assemblies of speakers and microphones of cellular communication devices including air tubes for transmitting and receiving acoustic waves for reducing irradiation of the EM waves generated thereby. U.S. Pat. No. 6,377,824 B1 issued to R. Ingbir et al. on Apr. 23, 2002 describes assemblies for cellular communication devices capable of converting electrical signals to acoustic signals to reduce the irradiation of the EM waves, while U.S. Pat. No. 6,181,801 B1 issued to S. Puthuff et al. on Jan. 30, 2001 describes earpieces of mobile communication devices disposed away therefrom through connectors to reduce exposure to the EM waves emitted thereby. In addition, U.S. Pat. Appl. Pub. No. 2004/0125979 A1 of J. Elidan et al. published on Jul. 1, 2004 discloses portable communication devices including tubes for transmitting acoustic waves to and from speakers and microphones and reducing the irradiation of the EM waves, while U.S. Pat. Appl. Pub. No. 2002/0048385 A1 of I. Rosenberg published on Apr. 25, 2002 describes cellular communication devices having assemblies of speakers and microphones coupled by air tubes and receiving and transmitting acoustic waves through the tubes for reducing the irradiation of the EM waves. Though these devices may reduce the exposure of the user to the EM waves, such may be achieved by increasing distances between the user and sources of the EM waves, not by decreasing amounts of the EM waves generated by such devices. In addition, incorporation of such air channels not only introduces mechanical noises to the sounds but also mandates use of additional components such as the air channels.

Various shields have also been described in the prior art so as to shield the user from the EM waves. For example, U.S. Pat. No. 6,855,883 B1 issued to H. Matsui on Feb. 15, 2005 describes shielding materials of electrically conductive fibers woven into a web and incorporated into a case of mobile communication devices, while U.S. Pat. No. 6,708,047 B1 issued to J. Miller et al. on Mar. 16, 2004 discloses annular radiation shields disposed around antennas of mobile communication devices. U.S. Pat. No. 6,314,277 B1 issued to Y-F Hsu et al. on Nov. 6, 2001 discloses radiation shields disposed on one side of an antenna of a mobile communication device for absorbing such EM waves, whereas U.S. Pat. No. 6,184,835 B1 issued to C. Chen et al. on Feb. 6, 2001 describes shielding covers for mobile communication devices for absorbing the EM waves radiated from their antennas. U.S. Pat. No. 6,137,998 issued to H. Holshouser et al. on Oct. 24, 2000 also discloses shields for antennas of cellular communication devices for reducing the EM waves radiated to their users, while U.S. Pat. No. 5,657,386 issued to J. Schwanke on Aug. 12, 1997 describes cellular communication devices including shields incorporated into their cases and absorbing or dispersing such EM waves. U.S. Pat. No. 5,406,038 issued to D. Reiff et al. on Apr. 11, 1995 describes speakers with diaphragms coated with metal layers to prevent transmission of the EM waves therethrough, while U.S. Pat. Appl. Pub. No. 2004/0219328 A1 of K. Tasaki et al. published on Nov. 4, 2004 discloses laminates of soft magnetic materials and insulators capable of being used as countermeasures against a specific absorption rate. In addition, U.S. Pat. Appl. Pub. No. 2004/0090385 A1 of R. Green published on May 13, 2004 describes cellular communication devices with shielding and reflecting layers for reflecting the EM waves away from users, U.S. Pat. Appl. Pub. No. 2002/0137473 A1 of D. Jenkins published on Sep., 26, 2002 discloses shields disposed over speakers of mobile communication devices and obstructing the EM waves irradiated by their speakers, and U.S. Pat. Appl. Pub. No. 2002/0097189 A1 of S. Coloney published on Jul. 25, 2002 describes mobile communication devices with shields which are disposed over speakers and antennas of the devices for reducing the EM waves emitted thereby. Although these shields claim to shield the user from the harmful EM waves, such shields may amount only to electric shields capable of shielding electric waves of the EM waves and may not at all shield magnetic waves of the EM waves.

Therefore, there is a need for electromagnetically-shielded speaker systems which effectively reduce the irradiation of the EM waves from their speakers without affecting the sounds. There also is a need for the speaker systems employing simple countermeasures capable of canceling at least a substantial portion of the EM waves irradiated thereby without compromising their performances and without complicating their configurations. In addition, there is a need for electric and magnetic shields for such speaker systems capable of shielding users from the electric and magnetic waves of the EM waves. There further is a need for speaker systems incorporating multiple mechanisms to shield the users from the EM waves irradiated by their speakers.

SUMMARY OF THE INVENTION

The present invention relates to electromagnetically-shielded speaker systems for generating acoustic sounds based on electric signals supplied thereto while minimizing irradiation of undesirable electromagnetic waves (to be abbreviated as "EM waves" hereinafter). More particularly, the present invention relates to various speaker systems each of which includes at least one source and at least one counter member, where the source irradiates the undesirable EM waves and where the counter member irradiates counter EM waves capable of canceling at least a portion of the undesirable waves based on their phase characteristics. Such a counter member may be formed in various shapes and receive various electric currents having preset amplitudes and flowing along preset directions, where such electric currents may be identical to or amount to only a portion of the source signals supplied to the wave source. In the alternative, the counter member may receive external currents which may be neither related to nor derived from the signals. The counter member may also be disposed in various locations of the system in various arrangements as far as the counter waves emitted thereby may be able to cancel at least a portion of the undesirable EM waves. The present invention may also relate to various speaker systems each including at least one electric shield and/or magnetic shield capable of shielding and/or terminating electric waves and magnetic waves of the undesirable electromagnetic waves, respectively, where the electric shield may include electrically conductive material, while the magnetic shield may include magnetic permeable material and at least one optional magnet and shunt The present invention also relates to various methods of eliminating or minimizing irradiation of such undesirable EM waves generated by the speaker systems by canceling at least a portion of the undesirable EM waves with the counter EM waves. More particularly, the present invention relates to various methods of generating by the counter members such counter EM waves which define preset amplitudes and phase angles for canceling such a portion of the undesirable waves, various methods of forming such counter members in preset shapes and/or sizes to generate such counter EM waves, various methods of arranging the counter members with respect to the wave sources for generating the counter waves, various methods of providing electric currents or at least a portion of the signals defining preset amplitudes and flowing in a preset direction to the counter members for generating the counter waves, various methods of manipulating the amplitudes and/or phase angles of such counter waves to cancel a desired portion of the undesirable waves by the counter waves, various methods of manipulating such amplitudes and/or directions of the external currents or signals for canceling the desired portion of the undesirable waves by the counter waves, and the like. The present invention may also relate to various methods of shielding and eliminating electric waves of the undesirable EM waves with at least one electric shield, various methods of rerouting and terminating magnetic waves of the undesirable EM waves by at least one magnetic shield, and various methods of shielding such undesirable EM waves by at least one electromagnetic shield.

The present invention further relates to various processes for providing the speaker systems capable of minimizing irradiation of the undesirable EM waves by their speakers. More particularly, the present invention relates to various processes for making the counter members capable of irradiating the counter waves capable of canceling a desired portion of the undesirable waves based upon their amplitudes and phase angles, various processes for making the counter members receiving external currents or signals in preset directions, various processes for supplying such currents or signals of preset amplitudes and/or directions, various processes for making the counter members incorporated into various locations of the wave sources, various processes for making the counter members for emitting the counter waves aligned with the undesirable waves in preset relations, various processes for making the counter member to be in preset relation to the wave source, and the like. The present invention may also relate to various processes for making the electric and magnetic shields capable of shielding the electric and magnetic waves of the undesirable waves.

The present invention relates to electromagnetically-shielded speaker systems each including at least two speakers which may be incorporated into the same case member or may be provided as separate articles. In addition, the present invention relates to electromagnetically-shielded microphone systems capable of minimizing irradiation of the undesirable EM waves.

The electromagnetically-shielded speaker systems of the present invention may be provided in various embodiments. For example and as described above, such speaker systems may be embodied as earphones or headphones which are to be disposed adjacent to or into the ears of the users. The speaker systems may also be incorporated into portable mobile or cellular phones, handsets of wired phones, and other communication devices such as walkie-talkies, and the like. The speaker systems may also be incorporated into other audio devices such as portable tape players, portable CD players, portable DVD players, portable mp3 players, and the like. Such speaker systems may also be used in conjunction with consoles of various audiovisual devices, e.g., as speakers for TVs, CD players, DVD players, game machines, computers, and other electric or electronic devices designed to output sound signals. Whether such devices are to be used proximate to or at preset distances from the users, the electromagnetically-shielded speaker systems of this invention may effectively reduce such irradiation of the undesirable EM waves to the user.

Such electromagnetically-shielded speaker systems of this invention may also be used in pairs or in greater numbers. Thus, multiple electromagnetically-shielded speaker systems may be encased in a single case member, where each speaker system may be arranged to cancel at least a portion of the undesirable EM waves generated by its wave source, where two or all speaker systems may be arranged to share a common counter member, a common electric and/or magnetic shield, and the like. In the alternative, multiple electromagnetically-shielded speaker systems may be provided as separate articles, where such speaker systems may be disposed in a preset arrangement, where the speaker systems may be disposed in an arbitrary arrangement while manipulating its common counter member or their individual counter members to irradiate the counter EM waves capable of canceling at least a portion of the undesirable waves.

Basic principles of the electromagnetically-shielded speaker systems and counter members of such systems may be modified and applied to microphone systems. For example, such a microphone system may include at least one counter member which may be similar to that of the speaker system and emit counter waves capable of canceling at least a portion of undesirable EM waves irradiated by one or more wave sources of the microphone system. In the alternative, the microphone system may include at least one electric shield or magnetic shield capable of absorbing and eliminating the electric and magnetic waves of such undesirable waves, respectively. In addition, such electromagnetically-shielded microphone system and speaker system may be encased in a single case member and used as an assembly of a receiver and transmitter, where each of the systems may have its own counter member for canceling the portion of the undesirable waves or where a single counter member may be arranged to cancel the portion of a sum of the undesirable waves from both systems.

Therefore, one objective of the present invention is to provide an electromagnetically-shielded speaker system (to be abbreviated as an "EMS speaker system" hereinafter) for generating counter EM waves capable of canceling a desired portion of undesirable EM waves generated by sources of the system. Accordingly, a related objective of this invention is to provide an EMS speaker system for emitting the counter waves capable of canceling the portion of the undesirable waves generated by a dynamic part such as, e.g., voice coils, of the system. Another related objective of this invention is to provide an EMS speaker system for emitting the counter waves capable of canceling the portion of the undesirable waves generated or transmitted by a stationary part such as, e.g., magnets, of such a system. Another related objective of this invention is to achieve all of the above objectives without affecting sounds generated by such systems. Another related objective of this invention is to achieve such objectives without necessarily disposing the sources of the system away from an ear and head of an user.

Another objective of the present invention is to provide an EMS speaker system which may be capable of manipulating characteristics of the counter EM waves for canceling such a preset portion of the undesirable EM waves. Thus, a related objective of this invention is to provide an EMS speaker system capable of manipulating amplitudes and/or phase angles of such counter waves for canceling the portion of the undesirable waves. Another related objective of this invention is to dispose an EMS speaker system in a location and/or an arrangement capable of rendering such counter waves cancel the portion of the undesirable waves. Another related objective of this invention is to achieve all of the above objectives without affecting sounds generated by such systems.

Another objective of the present invention is to provide an EMS speaker system with a counter member for generating the counter waves capable of canceling the preset portion of the undesirable waves from the wave source of the system. Thus, a related objective of this invention is to provide a single counter member for a single wave source of the system such as, e.g., a drive member, and to irradiate such counter waves. Another related objective of this invention is to provide multiple counter members for multiple waves sources of the system so that each wave source may be provided with at least one counter member and that the portion of the undesirable waves from each source may be canceled by the counter waves irradiated by each counter member. Another related objective of this invention is to provide a less number of counter members than multiple wave sources of the system so that at least one of the counter members may emit the counter waves capable of canceling such a portion of a sum of the undesirable waves irradiated by at least two of such sources.

Another objective of the present invention is to provide an EMS speaker system with at least one counter member capable of generating the counter EM waves while manipulating characteristics thereof for canceling the preset portion of the undesirable EM waves. Thus, a related objective of this invention is to provide the counter member capable of manipulating amplitudes and/or phase angles of the counter waves irradiated therefrom for canceling the portion of the undesirable waves. Another related objective of this invention is to dispose the counter member in a preset location of the system and/or in a preset arrangement each of which is in a preset relation to the system so that the counter waves may cancel the portion of the undesirable waves. Another related objective of this invention is to provide the counter member with electric currents which define preset amplitudes and which flow along a preset direction for irradiating the counter waves capable of canceling such a portion of the undesirable waves.

Another objective of the present invention is to provide at least one counter member capable of canceling at least a portion of undesirable EM waves irradiated by at least one drive member of an EMS speaker system. Thus, a related objective of this invention is to provide the counter member in a preset configuration which is same as, similar to or different from the drive member for local or global canceling of such waves, respectively. Another related objective of this invention is to enclose such a drive member by the counter member in a concentric arrangement. Another related objective of this invention is to dispose the counter and drive members side by side. Another related objective of this invention is to dispose the counter member proximal or distal to an user with respect to an user or to dispose the counter member flush with the drive member with respect to the user. Another related objective of this invention is to generate by the counter member such counter waves with amplitudes same as, similar to or different from those of the undesirable waves for canceling a desired portion of the undesirable waves. Another related objective of this invention is to implement at least one insert into the counter member for augmenting such counter waves generated by the counter member or, in the alternative, for generating the counter waves of preset amplitudes with a smaller or more compact counter member.

Another objective of the present invention is to provide at least one counter member defining a configuration for generating the counter waves for canceling a desired portion of the undesirable EM waves. Thus, a related objective of this invention is to form the counter member in a configuration for generating the counter waves aligned with a propagation direction or axis of the undesirable waves. Another related objective of this invention is to dispose the counter member in an arrangement and/or in an orientation for aligning the counter waves with the propagation axis of the undesirable waves. Another related objective of this invention is to implement the counter member in such a configuration, arrangement, and orientation to cancel only a desired portion or as much a portion of the undesirable waves. Another related objective of this invention is to dispose such counter and drive members at a same or similar distance or at different distances for canceling only the desired portion or as much a portion of the undesirable waves. Another related objective of this invention is to provide one or more counter members to cancel such a portion of the undesirable waves emitted by one or more sources included in the system. Another related objective of this invention is to incorporate at least one insert into the counter member for augmenting such counter waves generated by the counter member or, in the alternative, for generating the counter waves of preset amplitudes with a smaller or more compact counter member. Another related objective of this invention is to provide the counter member to have a composition which is identical to, similar to or different from a composition of at least a portion of the drive member for canceling only the desired portion or as much a portion of the undesirable waves.

Another objective of the present invention is to provide at least one counter member including a single counter unit or multiple identical, similar or different counter units therein. Therefore, a related objective of this invention is to include a single counter unit for generating the counter waves capable of canceling the portion of the undesirable EM waves due to its relation to the drive member of such a system, due to amplitudes and/or directions of electric currents or signals flowing through the counter and drive members, and so on. Another related objective of this invention is to include multiple counter units for generating multiple sets of counter waves a sum of which is capable of canceling the portion of the undesirable waves emitted by one or multiple sources of the drive member due to the relations between multiple counter units and one or more sources, due to amplitudes and/or directions of the electric currents or signals flowing through the counter units and source, and so on. Another related objective of this invention is to form a single symmetric (or asymmetric) counter unit and/or to dispose the counter unit in a symmetric (or asymmetric) arrangement with respect to such a drive member so as to generate such counter waves. Another related objective of this invention is to provide multiple symmetric (or asymmetric) counter units, to dispose the counter units in a symmetric (or asymmetric) arrangement with respect to each other, and/or to dispose at least two of such multiple counter units in an arrangement symmetric (or asymmetric) to the drive member. Another related objective of this invention is to provide at least one of the counter units to define a composition which may be identical to, similar to or different from a composition of at least a portion of the drive member for canceling only the desired portion or as much a portion of the undesirable waves.

Another objective of the present invention is to provide at least one counter member in a shape capable of emitting the counter waves capable of canceling the portion of the undesirable EM waves. Thus, a related objective of this invention is to form the counter member into a shape of a wire, a strip, a sheet, a tube, a coil, a mesh, an array of one or more of such shapes, a combination of one or more of such shapes, a mixture of two or more of such shapes, and the like. Another related objective of this invention is to form the counter member to consist of a single counter unit of one of such shapes. Another related objective of this invention is to provide the counter member to include multiple counter units all of which may define the same shape and may also be disposed in a preset arrangement with respect to the source of the drive member. Another related objective of this invention is to provide the counter member to include multiple counter units at least two of which may have different shapes and may be disposed in a preset arrangement with respect to the source of the drive member. Another related objective of this invention is to provide the counter member with a single counter unit capable of canceling the portion of the undesirable waves emitted by only one or at least two of the sources of the drive member. Another related objective of this invention is to provide the counter member with at least two counter units each of which may cancel the portion of the undesirable waves irradiated by each source of the drive member or all of which may cancel the portion of the undesirable waves irradiated by a single source or multiple sources of the drive member. Another related objective of this invention is to dispose the counter unit(s) closer to, at the same distance from or farther from the user than the drive member for manipulating amplitudes of the counter waves with respect to those of the undesirable waves. Another related objective of this invention is to dispose at least two counter units at the same distance or different distances from the user for canceling the preset portion or as much a portion of the undesirable waves by the counter waves. Another related objective of this invention is to form a symmetric (or asymmetric) counter unit or symmetric (or asymmetric) counter units and/or to arrange at least two of the counter units in an arrangement symmetric (or asymmetric) to at least a portion of the drive member for canceling the portion of the undesirable waves by the counter waves. Another related objective of this invention is to form the counter unit(s) and/or to arrange the counter unit(s) based on various propagation characteristics of the undesirable waves for effective canceling thereof.

Another objective of the present invention is to provide such a speaker system including such a drive member for emitting such undesirable EM waves and at least one counter member for emitting the counter EM waves capable of canceling such a portion of the undesirable waves. Thus, a related objective of this invention is to configure at least a portion of the counter member to conform (or to not conform) to at least a portion of such a drive member. Another related objective of this invention is to dispose at least a portion of the counter member in an arrangement conforming (or not conforming) to at least a portion of the drive member. Another related objective of this invention is to provide such a counter member for generating the counter waves which may define amplitudes and/or phase angles in preset relations to those of the undesirable waves. Another related objective of this invention is to electrically couple at least a portion of the counter member with the drive member in a parallel mode, in a series mode or in a hybrid mode or, in the alternative, to not electrically couple the counter member with the drive member. Another related objective of this invention is to electrically couple the counter member with the drive member in a preset sequence so that the counter member may receive electric currents or signals before, after or simultaneously with the drive member.

Another objective of the present invention is to provide such a speaker system including such a counter member disposed in various strategic locations of the system. Thus, a related objective of this invention is to dispose at least a portion of the counter member over, on, below, and/or inside the case member, bracket, cone, suspension, spider, speaker magnet, dust cap, and/or voice coil of such a system. Another related objective of this invention is to mechanically couple such a counter member directly with such portions of the system or, alternatively, to mechanically couple the counter member with such portions through a separate coupler.

Another objective of the present invention is to form an EMS speaker system which includes at least two speakers and also incorporates at least one counter member for canceling the portion of the undesirable EM waves irradiated by multiple speakers of the system. Thus, a related objective of this invention is to form such a system including at least two speakers encased in a single case member and also including multiple counter members (or units) each irradiating the counter waves capable of canceling the portion of the undesirable waves emitted by each speaker. Another related objective of this invention is to provide such a system including at least two speakers encased in the single case member and also having a single counter member (or unit) for generating the counter waves capable of canceling the portion of a sum of the undesirable waves emitted by all of such speakers. Another related objective of this invention is to provide such a system including multiple speakers individually encased in different case members and also having multiple counter members (or units) each emitting the counter waves capable of canceling such a portion of the undesirable waves irradiated by each of the speakers. Another related objective of this invention is to provide such a system also including multiple speakers encased in different case members and also including a single counter member (or unit) for generating the counter waves capable of canceling the portion of the sum of the undesirable waves emitted by all of such speakers. Another related objective of this invention is to incorporate at least one counter member into each of various conventional speakers which may include one magnet and a set of voice coil, which may include an electrostatic arrangement, and the like.

Another objective of the present invention is to form an EMS speaker system which includes at least two speakers and cancels a preset portion or as a much a portion of the undesirable EM waves irradiated by the drive members of such speakers. Therefore, a related objective of this invention is to provide such a system with the above counter member(s) for generating the counter waves capable of canceling the portion of the undesirable waves locally or globally. Another related objective of this invention is to fabricate the system as an earphone or a headphone each including a pair of speakers to be disposed on each ear of the user and to implement the counter member to each of the speakers for canceling the portion of the undesirable waves emitted by each of the speakers. Another related objective of this invention is to fabricate the system as a microphone and to implement such a counter member to the source of the system to cancel the portion of such undesirable waves emitted thereby. Another related objective of this invention is to fabricate the system as an assembly of a microphone and a speaker and to implement thereinto the counter member(s) for generating the counter waves for canceling the portion of the undesirable waves irradiated by the speaker and the microphone thereof. Another related objective of this invention is to implement the counter member into mobile or stationary communication devices and to generate the counter waves capable of canceling such a portion of the undesirable waves irradiated by the speakers and/or microphones of such devices.

Another objective of the present invention is to fabricate various electric and magnetic shields for such EMS speaker systems and to respectively shield electric waves and magnetic waves of the undesirable EM waves emitted from their wave sources by such shields. Thus, a related objective of this invention is to provide such magnetic shields capable of absorbing and rerouting magnetic waves therealong, terminating or sinking such rerouted waves into a magnetic pole of a magnet, and the like. Another related objective of this invention is to provide such magnetic shields capable of confining a magnet field generated by such a magnet therearound within a preset distance, e.g., by shunting the magnetic fields closer thereto. Another related objective of this invention is to provide various electric shields similarly capable of absorbing and rerouting electric waves therealong, terminating or sinking such rerouted waves into ground or by self-cancellation, and the like.

Another objective of the present invention is to incorporate the above magnetic and/or electric shields into the EMS speaker systems and their drive members for accomplishing synergetic shielding against the undesirable EM waves generated by the source of the drive member. Therefore, a related objective of this invention is to provide such shields in various shapes or sizes to releasably or fixedly couple with various portions of the drive member or other parts of the system, to include such shields inside the drive member or such parts of the system, to fabricate the drive member or such parts from a mixture including materials for such shields, and the like. Another related objective of this invention is to directly incorporate one or both of the shields onto the drive member or other parts of the system. Thus, another related objective of this invention is to provide such shields in various shapes and sizes to releasably couple with the drive member or such parts of the system, to fixedly couple therewith or to couple therewith through a coupler. Another related objective of this invention is to incorporate the shields into the drive member itself for shielding the waves emitted thereby. Another related objective of this invention is to incorporate such shields onto an exterior or interior of the system for shielding such undesirable waves emitted by its drive member. Thus, another related objective of this invention is to dispose such shields around, inside, on, or over one or more strategic locations of the system for effectively shielding such waves.

Another objective of the present invention is to provide an EMS speaker system incorporating the counter member as well as the magnetic and/or electric shields. Therefore, a related objective of this invention is to provide the system including one or more of such counter units for canceling some portions of the undesirable EM waves irradiated by its drive member and further including the above electric and/or magnetic shields for shielding remaining portions of such undesirable waves.

Another objective of the present invention is to provide an EMS speaker system having at least one counter member capable of supplying beneficial EM waves to the user. Thus, a related objective of this invention is to configure the counter member to irradiate such beneficial EM waves in or around ranges of infrared rays (to be abbreviated as "IR rays" hereinafter) including far-infrared rays (or "FIR rays" hereinafter), medium-infrared rays (or "MIR rays" hereinafter), near-infrared rays (or "NIR rays" hereinafter), and so on. Another related objective of this invention is to configure the counter member to cancel portions of the undesirable EM waves except those beneficial waves.

It is appreciated in all of such objectives that the counter members may not adversely affect normal operation of the speaker and other systems. For example, the dynamic magnetic fields formed by the counter members may not adversely affect the interactions between the static magnetic fields generated by the speaker magnet and the dynamic magnetic fields generated by the drive member. In addition, incorporation of such counter members may neither affect quality of the sounds generated by the system.

It is to be understood that various counter members and/or their counter units of various EMS speaker systems of this invention may be incorporated into any electrical or electronic devices which may include at least one speaker and/or microphone and, therefore, may irradiate the undesirable EM waves which may include the electric waves (to be abbreviated as "EWs" hereinafter) and magnetic waves (to be abbreviated as "MWs" hereinafter) of frequencies of about 60 Hz and/or other EWs and MWs of higher frequencies. It is also appreciated that the EMS speaker systems of this invention may be incorporated into any portable or stationary electric and/or electronic devices including at least one speaker and/or microphone.

A variety of apparatus, method, and/or process aspects of such electromagnetically-shielded speaker systems and various embodiments thereof are now enumerated. It is appreciated, however, that following system, method, and process aspects of the present invention may also be embodied in many other different forms and, thus, should not be limited to such aspects and/or their embodiments which are to be set forth herein. Rather, various exemplary aspects and their embodiments described hereinafter are provided such that this disclosure will be thorough and complete, and fully convey the scope of the present invention to one of ordinary skill in the relevant art.

In one aspect of the present invention, an electromagnetically-shielded speaker system may be provided for generating audible sounds based upon electric source signals which are supplied thereto while minimizing irradiation of undesirable electromagnetic waves to an user.

In one exemplary embodiment of this aspect of the invention, a system may include at least one drive member and at least one counter member. Such a drive member may be arranged to receive the signals, to convert the signals into the sounds, and to transmit such sounds to the user while emitting the undesirable waves to the user. The counter member may be arranged to be disposed in a preset relation to the drive member and to emit counter electromagnetic waves capable of canceling at least a substantial portion of the undesirable waves based upon the preset relation, thereby minimizing the irradiation without affecting the sounds.

In another exemplary embodiment of this aspect of the invention, a system may include at least one drive member and at least one counter member. The drive member may be arranged to receive the electric source signals in a first direction, to convert such signals into the sounds, and to transmit the sounds to the user while emitting the undesirable waves to the user. The counter member may be arranged to receive external currents and/or at least a portion of the electric signals along a second direction and to emit counter electromagnetic waves capable of canceling at least a substantial portion of the undesirable waves due to the directions, thereby minimizing the irradiation without affecting the sounds.

In another exemplary embodiment of this aspect of the invention, a system may include at least one case member, at least one drive member, and at least one counter member. Such a case member may be arranged to define at least one opening therethrough. The drive member may be arranged to be disposed on or in the case member and to include at least one cone, at least one voice coil, and at least one magnet, where the magnet may be arranged to define a static magnetic field therearound, where the voice coil may be arranged to be fixedly coupled to the cone, to receive the signals, and to form a dynamic magnetic field therearound as the signals flow therein while irradiating the undesirable waves, and where the cone may be arranged to vibrate based on interactions between the magnetic fields while generating the sounds. The counter member may be arranged to be disposed on or in at least one of the case and drive members in a preset relation to the voice coil and/or magnet and then to irradiate counter electromagnetic waves capable of canceling at least a substantial portion of such undesirable waves due to the preset relation, thereby minimizing such irradiation without affecting the sounds.

In another exemplary embodiment of this aspect of the invention, a system may include at least one case member, at least one drive member, and at least one counter member. Such a case member may be arranged to define at least one opening therethrough. The drive member may be arranged to be disposed on or in the case member and to include at least one cone, at least one voice coil, and at least one magnet, where the magnet may be arranged to define a static magnetic field therearound, where the voice coil may be arranged to be fixedly coupled to the cone, to receive the electric signals, and to form a dynamic magnetic field therearound when the electric signals flow therethrough along a first direction while irradiating the undesirable waves, and where the cone may be arranged to vibrate based on interactions between the magnetic fields while generating the sounds. The counter member may also be arranged to be disposed on or in at least one of the case and drive members, to receive external currents and/or at least a portion of the signals in a second direction, and to irradiate counter electromagnetic waves capable of canceling at least a substantial portion of such undesirable waves based upon the directions, thereby minimizing the irradiation without affecting the sounds.

In another exemplary embodiment of this aspect of the invention, a system may include at least one drive member and at least one counter member. The drive member may be arranged to receive the signals, to convert the signals into the sounds, and to transmit such sounds to an ear canal of the ear while irradiating the undesirable waves thereinto. Such a counter member may be arranged to be disposed on or in at least one of the case and drive members based on a preset relation to the drive member and to emit counter electromagnetic waves capable of canceling at least a substantial portion of the undesirable waves at least partially due to the preset relation, thereby minimizing the irradiation without affecting the sounds.

In another exemplary embodiment of this aspect of the invention, a system may include at least one drive member and at least one counter member. The drive member may be arranged to receive the electric signals in a first direction, to convert such electric signals into the sounds, and to transmit the sounds into an ear canal of the ear while emitting such undesirable waves thereinto. The counter member may be arranged to receive external electric currents and/or at least a portion of the electric signals in a second direction and to irradiate counter electromagnetic waves capable of canceling at least a substantial portion of the undesirable waves based upon the directions, thereby minimizing the irradiation without affecting the sounds.

In another exemplary embodiment of this aspect of the invention, a system may include at least one case member, at least one drive member, and at least one magnetic shield. Such a drive member may be arranged to be at least partially supported by the case member, to receive the source signals, to convert the source signals into the sounds, and to transmit such sounds through the case member while emitting such undesirable waves, where such a drive member will be referred to as the "drive member of the first type" hereinafter. In one example, the magnetic shield may be arranged to couple with the case and/or drive members, to absorb magnetic waves of the undesirable waves thereinto, and to reroute the magnetic waves away from the user therealong, thereby minimizing the irradiation. Such a magnetic shield will be referred to as the "magnetic shield or MS of the first type" hereinafter. In another example, the magnetic shield may also be arranged to be coupled to the case and/or drive members, to include therein at least one magnetically permeable path member and at least one magnet member which may form at least one magnetic pole thereon and may directly or indirectly couple with the path member, to absorb magnetic waves of the undesirable waves along the path member, and to terminate the magnetic waves with the pole of the magnet member, thereby minimizing the irradiation, where this magnetic shield will be referred to as the "MS of the second type" hereinafter. In another example, the magnetic shield may be arranged to be coupled to the case and/or drive members and to include a magnetically permeable path member, a magnet member defining at least one magnetic pole thereon and directly or indirectly coupling with the path member, and a magnetically permeable shunt member, where such a path member may be arranged to absorb magnetic waves of the undesirable waves thereinto, where the magnet member may be arranged to terminate the magnetic waves by the pole while forming a magnetic field therearound, and where the shunt member may then be arranged to confine the magnetic field from the magnet member closer thereto, thereby minimizing the irradiatio Such a magnetic shield will be referred to as the "MS of the third type" hereinafter.

In another exemplary embodiment of this aspect of the invention, a system may include at least one case member, at least one drive member of the first type, at least one electric shield, and at least one magnetic shield which may be one of the above magnetic shield of the first, second or third type. The electric shield may be arranged to be electrically conductive, to couple with the case and/or drive members, and to absorb therein electric waves of such undesirable waves, where such an electric shield will be referred to as the "electric shield of the first type" hereinafter.

In another aspect of this invention, an electromagnetically-shielded speaker system may also be provided for generating audible sounds based upon electric source signals supplied thereto while minimizing irradiation of undesirable electromagnetic waves to an user, where the system may include a case member and a drive member, where the case member may be arranged to include at least one opening therethrough, while the drive member may be arranged to be disposed in or on such a case member, to have at least one stationary part capable of forming a static magnetic field therearound, to include at least one movable part capable of forming a dynamic magnetic field therearound when such signals flow therein while emitting the undesirable waves, and to convert such electric signals into the audible sounds by vibration of the movable part.

In one exemplary embodiment of this aspect of the invention, a system may include at least one counter member which may be arranged to be disposed on or in such case and/or drive members, to define a configuration which may be at least substantially similar to that of at least one of the parts of the drive member, and then to irradiate counter electromagnetic waves capable of canceling at least a substantial portion of the undesirable waves, thereby minimizing the irradiation.

In another exemplary embodiment of this aspect of the invention, a system may include at least one counter member which may be arranged to be disposed on or in such case and/or drive members and to also define a configuration which may be different from that of at least one of the parts. In one example, the counter member may be disposed closer to at least one of the parts. In another example, the counter member may instead be spaced at a preset distance away from both of the parts. In both examples, the counter member may also be arranged to irradiate counter electromagnetic waves with phase angles capable of canceling at least a substantial portion of such undesirable waves, thereby minimizing the irradiation.

In another exemplary embodiment of this aspect of the invention, a system may include at least one counter member which may be arranged to be disposed on or in the case and/or drive members. In one example, the counter member may be arranged to enclose at least a portion of at least one of such parts therein. In another example, the counter member may be arranged to not enclose either of such parts therein. In both examples, the counter member may also be arranged to irradiate counter electromagnetic waves capable of canceling at least a substantial portion of the undesirable waves, thereby minimizing the irradiation.

In another exemplary embodiment of this aspect of the invention, a system may include at least one counter member which may be arranged to be disposed on or in the case and/or drive members. In one example, the counter member may be arranged to be flush with at least one of parts relative to the user. In another example, such a counter member may be arranged to be closer or proximal to the user than such at least one of parts. In another example, the counter member may be arranged to be farther away from or distal to the user than at least one of such parts. In all of these examples, such a counter member may be arranged to irradiate counter electromagnetic waves capable of canceling at least a portion of the undesirable waves, thereby minimizing the irradiation.

In another exemplary embodiment of this aspect of the invention, a system may include at least one counter member which may be arranged to be disposed on or in the case and/or drive members. In one example, the counter member may be arranged to be disposed closer to the user than at least one of the parts, and to irradiate counter electromagnetic waves having amplitudes greater than those of the undesirable waves. In another example, the counter member may be arranged to be disposed farther away from the user than at least one of such parts, and to irradiate counter electromagnetic waves defining amplitudes greater than those of the undesirable waves. In another example, such a counter member may be arranged to be disposed at a same distance from the user as at least one of the parts, and to irradiate counter electromagnetic waves with amplitudes at least substantially similar to those of the undesirable waves. In all of these examples, the counter waves may be arranged to be capable of canceling at least a portion of the undesirable waves, thereby minimizing the irradiation.

In another exemplary embodiment of this aspect of the invention, a system may include at least one counter member which may be arranged to be disposed on or in the case and/or drive members. In one example, the counter member may be arranged to receive external electric currents and/or at least a portion of the signals with amplitudes greater or less than those of the signals supplied to the drive member. In another example, the counter member may be arranged to receive external electric currents and/or at least a portion of the signals with amplitudes at least substantially similar to those of such signals supplied to the drive member. In both examples, the counter member may be arranged to irradiate counter electromagnetic waves which may be capable of canceling at least a portion of such undesirable waves, thereby minimizing the irradiation.

In another exemplary embodiment of this aspect of the invention, a system may include at least one counter member which may be arranged to be disposed on or in the case and/or drive members, to enclose at least one magnetically hard material and/or magnetically soft material therein, and to emit counter electromagnetic waves capable of canceling at least a substantial portion of the undesirable waves while strengthening amplitudes of the counter waves with the material, thereby minimizing the irradiation.

In another exemplary embodiment of this aspect of the invention, a system may include at least one electric shield of the first type and at least one magnetic shield which may be one of the magnetic shield of the first, second or third type.

In another aspect of this invention, an electromagnetically-shielded speaker system may also be provided for generating audible sounds based upon electric source signals supplied thereto while minimizing irradiation of undesirable electromagnetic waves to an user, where the system may include a case member and a drive member, where the case member may be arranged to define at least one opening therethrough, where the drive member may be arranged to be disposed in or on such a case member and to include at least one cone, at least one voice coil, and at least one magnet, where such a magnet may be arranged to define a static magnetic field therearound, where the voice coil may be arranged to be fixedly disposed about at least a portion of the cone, to receive the signals, and then to form a dynamic magnetic field therearound when the source signals flow therein while irradiating the undesirable waves, and where the cone may be arranged to vibrate due to interactions between the magnetic fields to generate the sounds.

In one exemplary embodiment of this aspect of the invention, a system may include at least one counter member which may be arranged to be disposed on or in at least one of such case and drive members and to emit counter electromagnetic waves aligned with the undesirable waves and capable of canceling at least a substantial portion of the undesirable waves, thereby minimizing the irradiation.

In another exemplary embodiment of this aspect of the invention, a system may include at least one counter member which may be arranged to be disposed on or in such case and drive members at a distance from the user which may be substantially similar or equal to another distance between the user and the voice coil and/or magnet of the drive member. In one example, the counter member may be arranged to emit counter electromagnetic waves capable of canceling at least a substantial portion of the undesirable waves, thereby minimizing the irradiation. In another example, the counter member may be arranged to irradiate counter electromagnetic waves with amplitudes which may be different from those of the undesirable waves and which may be capable of canceling only a selected portion of the undesirable waves, thereby minimizing the irradiation.

In another exemplary embodiment of this aspect of the invention, a system may include at least one counter member which may be arranged to be disposed on or in such case and/or drive members at one distance from the user which may be greater or less than another distance between the user and the voice coil and/or magnet of the drive member. In one example, the counter member may be arranged to emit counter electromagnetic waves defining amplitudes greater or less than those of the undesirable waves and capable of canceling at least a substantial portion of the undesirable waves, thereby minimizing such irradiation. In another example, the counter member may be arranged to emit counter electromagnetic waves with amplitudes less or greater than those of the undesirable waves and capable of canceling only a selected portion of such undesirable waves, thereby minimizing such irradiation.

In another exemplary embodiment of this aspect of the invention, a system may include at least one counter member which may be arranged to be disposed closer to the magnet and/or voice coil of the drive member and to emit counter electromagnetic waves which may be arranged to be aligned with the undesirable waves irradiated by only one of the voice coil and magnet and to be capable of canceling at least a preset portion of the undesirable waves in proximity to such one of the voice coil and magnet, thereby minimizing the irradiation.

In another exemplary embodiment of this aspect of the invention, a system may include at least one counter member which may be arranged to be disposed at a distance from both of the voice coil and magnet of the drive member and to emit counter electromagnetic waves which may be arranged to be aligned with all of the undesirable waves emitted by the voice coil and/or magnet and to be also capable of canceling at least a preset portion of such undesirable waves from the distance, thereby minimizing the irradiation.

In another exemplary embodiment of this aspect of the invention, a system may include at least one counter member which may be arranged to be disposed on or in the case and/or drive members, to enclose at least one magnetically hard material and/or magnetically soft material therein, and to also emit counter electromagnetic waves capable of canceling at least a portion of the undesirable waves while augmenting amplitudes of the counter waves by the material, thereby minimizing the irradiation.

In another exemplary embodiment of this aspect of the invention, a system may include at least one magnetic shield which may be arranged to couple with the case and/or drive members, to absorb magnetic waves of the undesirable waves, and to reroute therealong the magnetic waves away from the user, thereby minimizing the irradiation.

In another exemplary embodiment of this aspect of the invention, a system may include at least one magnetic shield which may be arranged to couple with the case and/or drive members, to have a magnetically permeable path member and a magnet member having at least one magnetic pole thereon, to absorb magnetic waves of the undesirable waves by and along the path member, and to terminate the magnetic waves in the pole of the magnet member, thereby minimizing the irradiation.

In another exemplary embodiment of this aspect of the invention, a system may include at least one magnetic shield which may be arranged to couple with the case and/or drive members and to also include a magnetically permeable path member, a magnet member defining at least one magnetic pole thereon, and a magnetically permeable shunt member, where such a path member may be arranged to absorb and reroute magnetic waves of the undesirable waves therealong, where the magnet member may be arranged to terminate the magnetic waves by the magnetic pole, and where the shunt member may be arranged to confine a magnetic field generated by the magnet member closer thereto, thereby minimizing the irradiation.

In another exemplary embodiment of this aspect of the invention, a system may include at least one electric shield of the first type and at least one magnetic shield which may be one of the magnetic shield of the first type, second type or third type.

In another aspect of this invention, an electromagnetically-shielded speaker system may also be provided for generating audible sounds based upon electric source signals supplied thereto while minimizing irradiation of undesirable electromagnetic waves to an user, where the system may include a case member and a drive member, where the case member may be arranged to define at least one opening therethrough, where the drive member may be arranged to be disposed in or on such a case member and to include at least one cone, at least one voice coil, and at least one magnet, where the voice coil may be arranged to define a first shape, to be fixedly coupled to the cone, to receive such electric signals in a first direction, and to form a dynamic magnetic field therearound when the electric signals flow therein while irradiating such undesirable waves, where the magnet may be arranged to define a second shape and to form a static magnetic field therearound, and where the cone may be arranged to move due to interactions between the magnetic fields while generating the sounds.

In one exemplary embodiment of this aspect of the invention, a system may include at least one counter member having a single counter unit which may be arranged to be disposed on or in the case and/or drive members based upon a preset relation to the voice coil and/or magnet and to emit counter electromagnetic waves capable of canceling at least a portion of the undesirable waves due to such a relation, thereby minimizing the irradiation.

In another exemplary embodiment of this aspect of the invention, a system may include at least one counter member including a single counter unit which may be arranged to be disposed on or in the case and/or drive members, to receive external currents and/or at least a portion of the signals along a third direction, and to emit counter electromagnetic waves capable of canceling at least a portion of the undesirable waves due to the directions, thereby minimizing the irradiation.

In another exemplary embodiment of this aspect of the invention, a system may include at least one counter member with multiple counter units each of which may be arranged to be disposed on or in the case and/or drive members based upon a preset relation to the voice coil and/or magnet and to irradiate counter electromagnetic waves capable of canceling at least a portion of such undesirable waves based on the relations, where the counter waves from the counter units may be arranged to cancel at least a substantial portion of the undesirable waves, thereby minimizing the irradiation.

In another exemplary embodiment of this aspect of the invention, a system may include at least one counter member with multiple counter units each of which may be arranged to be disposed on or in the case and/or drive members, to receive at least a portion of the signals and/or external currents in a third direction, and to emit counter electromagnetic waves capable of canceling at least a portion of the undesirable waves due to the directions, where the counter waves from the counter units may be arranged to cancel at least a substantial portion of such undesirable waves, thereby minimizing the irradiation.

In another exemplary embodiment of this aspect of the invention, a system may include at least one counter member including a single counter unit which may be arranged to be disposed on or in the case and/or drive members, to form a symmetric (or asymmetric) shape or, in the alternative, a shape symmetric (or asymmetric) to the voice coil and magnet, and to emit counter electromagnetic waves capable of canceling at least a substantial portion of the undesirable waves due to the shape, thereby minimizing the irradiation.

In another exemplary embodiment of this aspect of the invention, a system may include at least one counter member with multiple counter units each of which may be arranged to be disposed on or in the case and/or drive members and to emit counter electromagnetic waves capable of canceling at least a portion of the undesirable waves. In one example, at least two of such counter units may be arranged to be disposed symmetric (or asymmetric) to each other. In another example, at least two of such counter units may be arranged to be disposed symmetric (or asymmetric) to the voice coil and/or magnet. In both examples, the counter waves emitted by the counter units may be arranged to cancel at least a substantial portion of the undesirable waves based upon arrangement of such at least two of the counter units, thereby minimizing the irradiation.

In another exemplary embodiment of this aspect of the invention, a system may include at least one counter member including at least one counter unit which may be arranged to be disposed on or in the case and/or drive members, to have a composition which may be at least substantially similar to (or different from) that of the voice coil, and to irradiate counter electromagnetic waves capable of canceling at least a portion of the undesirable waves due to the compositions, thereby minimizing the irradiation.

In another aspect of this invention, an electromagnetically-shielded speaker system may also be provided for generating audible sounds based upon electric source signals supplied thereto while minimizing irradiation of undesirable electromagnetic waves to an user, where the system may include a drive member which may be arranged to receive such signals, to convert the electric signals to the sounds, and to transmit the sounds to the user while emitting the undesirable waves thereto.

In one exemplary embodiment of this aspect of the invention, a system may include at least one counter member including at least one counter unit which may be disposed in a preset relation to the drive member. In one example, the counter member may be arranged to form an elongated curvilinear shape of a wire, a strip, a sheet, and/or a tube. In another example, such a counter member may be arranged to be formed as a coil and/or a mesh. In another example, the counter member may instead be arranged to form a shape of an array, mixture, and/or combination of at least two of a wire, a strip, a sheet, a tube, a coil, and a mesh. In all of these examples, the counter member may be arranged to emit counter electromagnetic waves which may be capable of canceling at least a substantial portion of the undesirable waves due to the shape, thereby minimizing the irradiation.

In another exemplary embodiment of this aspect of the invention, a system may include at least one counter member having multiple counter units each of which may be arranged to be disposed in a preset relation to the drive member, to have a shape of a wire, a strip, a sheet, a tube, a coil, and/or a mesh, and to emit counter electromagnetic waves capable of canceling a portion of such undesirable waves because of the shape, where at least two of such counter units may have same (or different) shapes and where the counter waves of the counter units may then be arranged to cancel at least a substantial portion of the undesirable waves, thereby minimizing the irradiation.

In another exemplary embodiment of this aspect of the invention, a system may include at least one counter member having multiple counter units each of which may be arranged to be disposed in a preset relation to the drive member, at least one of which may be arranged to form an array, mixture, and/or combination of at least two of a wire, a strip, a sheet, a tube, a coil, and a mesh, and each of which may be arranged to emit counter electromagnetic waves capable of canceling only a portion of the undesirable waves due to such a shape, where the counter waves of at least two of the counter units may also be arranged to cancel at least a substantial portion of the undesirable waves, thereby minimizing the irradiation.

In another exemplary embodiment of this aspect of the invention, a system may include at least one counter member with at least one counter unit which may be arranged to be disposed in a preset relation to such a drive member, to define a shape of a wire, a strip, a sheet, a tube, a coil, a mesh, an array of at least one of the shapes, a mixture of at least one of the shapes, and/or a combination of at least one of such shapes. In one example, the counter member may be arranged to irradiate counter electromagnetic waves defining patterns of propagation similar to those of the undesirable waves but capable of canceling at least a portion of the undesirable waves due to at least one of such shapes, a direction of external currents flowing therethrough, and a direction of at least a portion of the electric signals flowing therein, thereby minimizing the irradiation. In another example, such a counter member may be arranged to emit counter electromagnetic waves defining propagation patterns similar to those of electromagnetic waves irradiated from the system including the undesirable waves and capable of canceling at least a portion of the undesirable waves from the system due to the shape, a direction of external currents flowing therethrough, and/or a direction of at least a portion of such electric signals flowing therein, thereby minimizing the irradiation.

In another exemplary embodiment of this aspect of the invention, a system may include at least one counter member having multiple counter units each of which may be arranged to be disposed in a preset relation to the drive member, to have a shape of a wire, a strip, a sheet, a tube, a coil, a mesh, an array of at least one of the shapes, a mixture of at least one of such shapes, and/or a combination of at least one of the shapes, and to emit counter electromagnetic waves. In one example, the drive member may include a single source of the undesirable waves, where the counter waves emitted by the counter units may be arranged to define propagation patterns at least substantially similar to those of the undesirable waves when superposed onto each other and to be capable of canceling at least a substantial portion of the undesirable waves due to such shapes, an arrangement thereof, a direction of external currents flowing therethrough, and/or a direction of at least a portion of the electric signals flowing therein, thereby minimizing such irradiation. In another example, the drive member may include multiple sources of such undesirable waves, where each of the counter waves may be arranged to define propagation patterns which may be similar to those of each of the undesirable waves emitted by each of the sources and to be capable of canceling at least a portion of such undesirable waves based on such shapes, an arrangement of the counter units, a direction of external currents flowing therein, and/or a direction of at least a portion of such electric signals flowing therethrough, whereby the counter units may minimize at least a substantial portion of the irradiation. In another example, the drive member may have multiple sources of the undesirable waves, where the counter waves emitted by such counter units may be arranged to define propagation patterns at least substantially similar to those of the undesirable waves when superposed onto one another and to be capable of canceling at least a substantial portion of the undesirable waves due to such shapes, an arrangement of such counter units, a direction of external currents flowing therein, and/or a direction of at least a portion of the signals flowing therein, thereby minimizing the irradiation.

In another exemplary embodiment of this aspect of the invention, a system may include at least one counter member with at least one counter unit which may be arranged to be disposed in a preset relation to such a drive member, to have a shape of a wire, a strip, a sheet, a tube, a coil, a mesh, an array of at least one of the shapes, a mixture of at least one of the shapes, and/or a combination of at least one of such shapes. In one example, the counter unit may be arranged to be disposed closer to (or farther away from) the user than the drive member. In another example, the counter unit may be arranged to be disposed at a similar or same distance from the user as the drive member. In all of the examples, the counter unit may be arranged to irradiate counter electromagnetic waves capable of canceling at least a substantial portion of such undesirable waves due to the shape, an arrangement thereof, a direction of external currents flowing therein, and/or a direction of at least a portion of such electric signals flowing therein, thereby minimizing the irradiation.

In another exemplary embodiment of this aspect of the invention, a system may include at least one counter member having multiple counter units each of which may be arranged to be disposed in a preset relation to the drive member, and to define a shape of a wire, a strip, a sheet, a tube, a coil, a mesh, an array of at least one of such shapes, a mixture of at least one of the shapes, a combination of at least one of such shapes, and the like. In one example, at least one of the counter units may be arranged to be disposed closer to (or farther away) from the user than the drive member. In another example, at least one of such counter units may be arranged to be disposed at a same distance from the user as the drive member. In all of these examples, the counter units may be arranged to irradiate counter electromagnetic waves capable of canceling at least a substantial portion of such undesirable waves due to such shapes, an arrangement of such units, a direction of external currents flowing in such units, and a direction of at least a portion of the signals flowing in such units, thereby minimizing the irradiation.

In another exemplary embodiment of this aspect of the invention, a system may include at least one counter member with at least one counter unit which may be arranged to be disposed in a preset relation to the drive member, to define a shape of a wire, a strip, a sheet, a tube, a coil, a mesh, an array of at least one of the shapes, a mixture of at least one of the shapes, and/or a combination of at least one of the shapes. In one example, the counter unit may be arranged to form a symmetric shape or, in the alternative, a shape symmetric to at least a portion of the drive member, and to emit counter electromagnetic waves capable of canceling at least a substantial portion of such undesirable waves due to the shape, an arrangement thereof, a direction of external currents flowing therein, and/or a direction of at least a portion of the electric signals flowing therein, thereby minimizing the irradiation. In another example, the counter unit may be arranged to define an asymmetric shape and/or a shape asymmetric to the drive member, and to irradiate counter electromagnetic waves capable of canceling at least a substantial portion of such undesirable waves due to the shape, an arrangement thereof, a direction of external currents flowing therein, a direction of at least a portion of such electric signals flowing therein, and the like, thereby minimizing the irradiation.

In another exemplary embodiment of this aspect of the invention, a system may include at least one counter member having multiple counter units each of which may be arranged to be disposed in a preset relation to such a drive member and to have a shape of a wire, a strip, a tube, a sheet, a coil, a mesh, an array of at least one of the shapes, a combination of at least one of the shapes, a mixture of at least one of such shapes, and the like. In one example, such counter units may also be disposed in an arrangement symmetric to each other and/or an arrangement symmetric to at least a portion of the drive member, and to emit counter electromagnetic waves capable of canceling at least a substantial portion of the undesirable waves due to the shape, the arrangement, a direction of external currents flowing through at least one of the counter units, and/or a direction of at least a portion of the electric signals flowing through at least one of the counter units, thereby minimizing the irradiation. In another example, such counter units may be disposed in an arrangement asymmetric to each other and/or an arrangement asymmetric with respect to the drive member, and to irradiate counter electromagnetic waves capable of canceling at least a substantial portion of the undesirable waves due to the shape, the arrangement, a direction of external currents flowing in at least one of the counter units, and/or a direction of at least a portion of the electric signals flowing in at least one of the counter units, thereby minimizing the irradiation.

In another exemplary embodiment of this aspect of the invention, a system may include at least one counter member with at least one counter unit which may be arranged to be disposed in a preset relation to the drive member, to form a shape matching propagation patterns of the undesirable waves and forming a wire, a strip, a sheet, a tube, a coil, a mesh, an array of at least one of such shapes, a mixture thereof, and/or a combination thereof, and to emit counter electromagnetic waves capable of canceling at least a portion of the undesirable waves due to its shape, a direction of external currents flowing therein, and/or a direction of at least a portion of such electric signal flowing therein, thereby minimizing the irradiation.

In another aspect of this invention, an electromagnetically-shielded speaker system may also be provided for generating audible sounds based upon electric source signals supplied thereto while minimizing irradiation of undesirable electromagnetic waves to an user.

In one exemplary embodiment of this aspect of the invention, a system may include at least one drive member and at least one counter member. The drive member may be arranged to define a first shape, to receive the signals, to convert the signals to the sounds, and to transmit the sounds to the user while irradiating the undesirable waves to the user. The counter member may be arranged to be disposed in a preset relation to the drive member, to form a second shape at least partially conforming (or not conforming) to the first shape, and then to irradiate counter electromagnetic waves capable of canceling at least a substantial portion of such undesirable waves at least partially due to the shape, thereby minimizing the irradiation.

In another exemplary embodiment of such an aspect of the invention, a system may include at least one drive member and at least one counter member. The drive member may be arranged to be disposed in a first arrangement, to receive the signals, to convert the signals into the sounds, and to transmit the sounds to the user while irradiating the undesirable waves thereto. The counter member may be arranged to be disposed in a second arrangement conforming (or not conforming) to the first arrangement and to emit counter electromagnetic waves capable of canceling at least a substantial portion of the undesirable waves at least partially due to the first and second arrangements, thereby minimizing the irradiation.

In another exemplary embodiment of this aspect of the present invention, a system may have at least one drive member and at least one counter member. The drive member may be arranged to receive the signals, to convert the signals into the sounds, and then to transmit the sounds to the user while irradiating the undesirable waves having first amplitudes thereto. The counter member may be arranged to emit counter electromagnetic waves defining second amplitudes and capable of canceling at least a substantial portion of the undesirable waves at least partially due to such amplitudes, where the second amplitudes may then be arranged to be stronger than, similar to or weaker than such first amplitudes, thereby minimizing the irradiation.

In another exemplary embodiment of this aspect of the invention, a system may include at least one drive member and at least one counter member. The drive member may be arranged to receive the electric signals defining first amplitudes along a first direction, to convert the signals to the sounds, and to transmit the sounds to the user while irradiating such undesirable waves thereto. The counter member may be arranged to receive external currents and/or at least a portion of such electric signals each having second amplitudes and flowing in a second direction and to emit counter electromagnetic waves capable of canceling at least a substantial portion of such undesirable waves at least partially due to the first and second amplitudes and first and second directions, where the second amplitudes may be arranged to be stronger than, similar to or weaker than the first amplitudes, thereby minimizing the irradiation.

In another exemplary embodiment of this aspect of the present invention, a system may include at least one drive member and at least one counter member. Such a drive member may be arranged to receive the signals, to convert the signals into the sounds, and then to transmit the sounds to the user while irradiating the undesirable waves thereto, where such a drive member will be referred to as the "drive member of the second type" hereinafter. The counter member may be arranged to be disposed in a preset relation to the drive member, to form an electric coupling with the drive member based on a series and/or parallel pattern, and to irradiate counter electromagnetic waves capable of canceling at least a substantial portion of the undesirable waves at least partially due to such relation and coupling, thereby minimizing the irradiation. Instead of such a coupling, the counter member may be arranged to receive external currents but not the signals.

In another exemplary embodiment of this aspect of the invention, a system may include at least one drive member of the second type and at least one counter member which may be arranged to be disposed in a preset relation to the drive member and to emit counter electromagnetic waves capable of canceling at least a substantial portion of the undesirable waves at least partially due to the relation and/or coupling, thereby minimizing such irradiation. Such a counter member may also be arranged to receive such signals through the drive member, to receive such signals simultaneously with the drive member or, in the alternative, to receive the signals and to deliver the signals to the drive member.

In another aspect of this invention, an electromagnetically-shielded speaker system may also be provided for generating audible sounds based upon electric source signals supplied thereto while minimizing irradiation of undesirable electromagnetic waves to an user.

In one exemplary embodiment of this aspect of the invention, a system may include at least one case member, at least one drive member, at least one bracket, and at least one counter member. The case member may be arranged to form at least one opening therethrough, while the drive member may be arranged to be disposed on or in such a case member and to have at least one cone, at least one voice coil, and at least one magnet, where the magnet may be arranged to form a static magnetic field therearound, where the voice coil may be arranged to be fixedly coupled to the cone, to receive such electric signals, and to form a dynamic magnetic field therearound when the signals flow therein while emitting the undesirable waves, and where the cone may be arranged to define a wider end as well as a narrower end and to vibrate due to interactions between the static and dynamic magnetic fields while generating the sounds. This drive member will be referred to as the "drive member of the third type" hereinafter. The bracket may be arranged to be disposed inside the case member, to retain the driver member therein, and to be movably coupled to the wider end of the cone. The counter member may be disposed in various portions of the system, to define a configuration in a preset relation to the voice coil and/or magnet, to receive external electric currents and/or at least a portion of the signals, and to emit counter electromagnetic waves capable of canceling at least a substantial portion of such undesirable waves at least partially based upon the relation, thereby minimizing the irradiation. In one example, the counter member may be disposed on an exterior or an interior of and/or embedded inside the case member. In another example, the counter member may be disposed on an exterior or interior of and/or embedded inside the bracket. In another example, the counter member may be disposed on an exterior of, disposed on an interior of, and/or embedded inside the cone. In another example, the counter member may be disposed between the case member and the bracket and/or cone. In another example, the counter member may be disposed between the bracket and the cone and/or magnet. In another example, such a counter member may be disposed between the cone and magnet. In another example, such a counter member may be disposed closer to or farther away from the user during use than the voice coil. In another example, the counter member may be disposed at a substantially similar distance from the front of the case member as the voice coil. In another example, the counter member may be disposed symmetrically or asymmetrically about the cone. In another example, such a counter member may be disposed about only a portion of the cone, In another exemplary embodiment of this aspect of the invention, such a system may include at least one case member, at least one drive member of the third type, at least one dust cap, at least one bracket, at least one suspension, at least one spider, and at least one counter member. Such a case member may define a front to be disposed closer to the user and a rear to be disposed away from the user and may be arranged to form at least one opening therethrough in its front. The dust cap may be arranged to be disposed in the narrower end of the cone and along a longitudinal axis of such a cone. The bracket may be arranged to be disposed inside the case member and to retain the driver member therein. The suspension may be arranged to be flexible and to movably couple with the wider end of the cone with the the bracket. The spider may be arranged to be coupled to the narrower end of the cone and to retain the voice coil thereon (or therein). The counter member may be disposed in various portions of such a system, to define a configuration in a preset relation with respect to the voice coil and/or magnet, to receive external electric currents and/or at least a portion of the signals, and to emit counter electromagnetic waves capable of canceling at least a substantial portion of such undesirable waves at least partially due to the above relation, thereby minimizing such irradiation. In one example, the counter member may be disposed on an exterior or an interior of and/or embedded inside the case member. In another example, the counter member may be disposed on an exterior of, disposed on an interior of or embedded inside the bracket. In another example, the counter member may be disposed on an exterior or interior of and/or embedded inside the suspension. In another example, the counter member may be disposed on an exterior or interior of and/or embedded inside such a cone. In another example, the counter member may be disposed on an exterior or an interior of and/or embedded inside the dust cap. In another example, such a counter member may be disposed on an exterior or interior of and/or embedded inside the spider. In another example, the counter member may also be disposed between the case member and the bracket, suspension, cone, and/or dust cap. In another example, the counter member may be disposed between the bracket and the suspension, cone, spider, and/or magnet. In another example, the counter member may be disposed between the suspension and the cone and/or spider. In another example, the counter member may be disposed between the cone and the spider, dust cap, and/or magnet. In another example, the counter member may also be disposed between the dust cap and the spider and/or magnet. In another example, the counter member may be disposed closer to or farther away from the front of the case member than the magnet and/or voice coil or, in the alternative, may be disposed at a substantially similar distance from the front of the case member as the voice coil. In another example, the counter member may be disposed symmetrically or asymmetrically about the longitudinal axis of the cone. In another example, the counter member may be arranged to be disposed about only a portion of the longitudinal axis of the cone.

In another exemplary embodiment of this aspect of the invention, such a system may include at least one case member, at least one drive member of the third type, at least one dust cap, at least one bracket, at least one suspension, at least one spider, and at least one counter member. Such a case member may be arranged to define at least one opening therethrough. The dust cap may be arranged to be disposed in the narrower end of the cone and along a longitudinal axis of such a cone, while the bracket may be arranged to be disposed inside the case member and to also retain the driver member therein. The suspension may be arranged to be flexible and to movably couple with the wider end of the cone with the the bracket, while the spider which is arranged to couple with the narrower end of the cone and to also retain the voice coil thereon or therein. The counter member may be arranged to be coupled to at least one of the case member, drive member, dust cap, bracket, suspension, and/or spider, to define a configuration in a preset relation to the voice coil and/or magnet, to receive external electric currents and/or at least a portion of such signals, and to emit counter electromagnetic waves capable of canceling at least a substantial portion of such undesirable waves at least partially due to the relation, thereby minimizing the irradiation. Alternatively, the counter member may be arranged to include at least one coupler and at least one counter unit, to be coupled to such a case member, drive member, dust cap, bracket, suspension, and/or spider through the coupler, to define a configuration defining a preset relation to the voice coil and/or magnet, to receive external electric currents and/or at least a portion of the signals, and to emit counter electromagnetic waves capable of canceling at least a substantial portion of the undesirable waves at least partially due to the relation, thereby minimizing the irradiation.

In another aspect of this invention, an electromagnetically-shielded speaker system may also be provided for generating audible sounds based upon electric source signals supplied thereto while minimizing irradiation of undesirable electromagnetic waves to an user by shielding the user from at least a substantial portion of the waves.

In one exemplary embodiment of this aspect of the invention, a system may include at least one case member, at least one drive member of the first type, and at least one magnetic shield which may be one of the magnetic shield of the first, second or third type.

In another exemplary embodiment of this aspect of the invention, a system may include at least one case member, at least one drive member of the first type, at least one electric shield of the first type, and at least one magnetic shield which may be one of the magnetic shield of the first, second or third type.

In another exemplary embodiment of this aspect of the invention, a system may include at least one case member, at least one drive member of the first type, and at least one electromagnetic shield. In one example, such a shield may define at least a portion of which may be arranged to be electrically conductive, to couple with the case and/or drive members, and to absorb therein electric waves of the undesirable waves, and may also define at least another portion of which may be arranged to be coupled to at least one of the case and drive members, to absorb magnetic waves of the undesirable waves therein, and to reroute the magnetic waves away from the user therealong, thereby minimizing the irradiation. In another example, such a shield may define at least a portion which may be arranged to be also electrically conductive, to couple with the case and/or drive members, and to absorb therein electric waves of the undesirable waves, and may also define at least another portion which may be arranged to be coupled to the case and/or drive members, to define therein at least one magnetically permeable path member and at least one magnet member defining at least one magnetic pole thereon and directly or indirectly coupling with the path member, to absorb magnetic waves of the undesirable waves along the path member, and to terminate the magnetic waves in or with the pole of the magnet member, thereby minimizing such irradiation. In another example, such a shield may define at least a portion of which may be arranged to be electrically conductive, to be coupled to the case and/or drive members, and to absorb therein electric waves of the undesirable waves, and may also form at least another portion of which may be arranged to couple with the case and/or drive members and to have a magnetically permeable path member, a magnet member defining at least one magnetic pole thereon and coupling with the path member directly or indirectly, and a magnetically permeable shunt member.

The path member may be arranged to absorb therein magnetic waves of the undesirable waves, the magnet member may be arranged to terminate such magnetic waves by or with the pole while defining a magnetic field therearound, and the shunt member may be arranged to confine the magnetic field of the magnet member closer thereto, thereby minimizing the irradiation.

In another aspect of this invention, an electromagnetically-shielded speaker system may also be provided for generating audible sounds based upon electric source signals supplied thereto while shielding irradiation of undesirable electromagnetic waves to an user through shielding the user from at least a substantial portion of the waves.

In one exemplary embodiment of such an aspect of the invention, such a system may have at least one case member, at least one drive member of the third type, at least one bracket, and at least one electric and/or magnetic shield. The case member may be arranged to form at least one opening therethrough, and the bracket may be arranged to be disposed inside the case member, to retain the driver member therein, and to movably couple with the wider end of the cone. The shield(s) may be arranged to be disposed in various portions of the system, to have a configuration defining a preset relation to the voice coil and/or magnet, and to absorb electric waves and/or magnetic waves of such undesirable waves, respectively, thereby minimizing the irradiation. In one example, the shield(s) may be disposed on an exterior of, on an interior of, and/or inside the case member. In another example, the shield(s) may be disposed on an exterior of, on an interior of, and/or inside the bracket. In another example, the shield(s) may be disposed on an exterior of, on an interior of, and/or inside the cone. In another example, the shield(s) may be incorporated between the case member and the bracket and/or cone. In another example, the shield(s) may also be incorporated between the bracket and the cone and/or magnet. In another example, the shield(s) may be incorporated between the cone and magnet. In another example, the shield(s) may be incorporated symmetrically (or asymmetrically) about such a cone. In another example, the shield(s) may be incorporated about only a portion of the cone.

In another exemplary embodiment of this aspect of the invention, such a system may include at least one case member, at least one drive member of the third type, at least one dust cap, at least one bracket, at least one suspension, at least one spider, and at least one of such aforementioned electric and magnetic shields. Such case member may define a front to be disposed closer to the user and a rear for being disposed away from the user and define at least one opening therethrough in the front.

The dust cap may be disposed in the narrower end of the cone and along a longitudinal axis of such a cone, while the bracket may be arranged to be disposed inside the case member and to retain such a driver member therein. The suspension may be arranged to be flexible and to movably couple such a wider end of the cone to the the bracket, and the spider may be arranged to couple with the narrower end of the cone and to also retain the voice coil thereon or therein. The shield (s) may be disposed in various portions of the system, to have a configuration defining a preset relation to the magnet and/or voice coil, and to absorb electric waves and magnetic waves of the undesirable waves, respectively, thereby minimizing the irradiation. In one example, the shield(s) may be disposed on an exterior of, on an interior of, and/or inside the case member. In another example, such shield(s) may be disposed on an exterior of, on an interior of, and/or inside the bracket. In another example, such shield(s) may also be disposed on an exterior of, on an interior of, and/or inside the suspension. In another example, the shield(s) may also be disposed on an exterior of, on an interior of, and/or inside the cone. In another example, the shield(s) may be disposed on an exterior of, on an interior of, and/or inside the dust cap. In another example, the shield(s) may be disposed on an exterior of, on an interior of, and/or inside the spider. In another example, the shield(s) may also be incorporated between the case member and the bracket, suspension, cone, and/or dust cap. In another example, such shield(s) may be incorporated between the bracket and the suspension, cone, spider, and/or magnet. In yet another example, such shield(s) may be disposed between the suspension and the cone and/or spider. In another example, the shield(s) may be incorporated between the cone and the spider, dust cap, and/or magnet. In yet another example, the shield(s) may be disposed between the dust cap and the spider and/or magnet. In another example, the shield (s) may be incorporated symmetrically (or asymmetrically) about such a longitudinal axis of the cone. In another example, the shield(s) may also be incorporated about only a portion of the longitudinal axis of the cone.

In another exemplary embodiment of this aspect of the invention, such a system may include at least one case member, at least one drive member of the third type, at least one dust cap, at least one bracket, at least one suspension, at least one spider, and at least one electric and/or magnetic shield. The case member may be arranged to define at least one opening therethrough. The dust cap may be arranged to be disposed in the narrower end of such a cone and along a longitudinal axis of the cone, whereas the bracket may be arranged to be disposed inside the case member and to retain the driver member therein. The suspension may be arranged to be flexible and to movably couple the wider end of the cone with the the bracket, and the spider may be arranged to couple with the narrower end of the cone and to retain the voice coil thereon or therein. The shield(s) may be arranged to be disposed in various portions of the system, to form a configuration having a preset relation to the magnet and/or voice coil, and to absorb electric waves and magnetic waves of the undesirable waves, respectively, thereby minimizing the irradiation. In one example, the shield(s) may be arranged to be coupled to the case member, drive member, dust cap, bracket, suspension, and/or spider. In another example, such shield(s) may be arranged to have at least one coupler and at least one counter unit, to be coupled to the case member, drive member, dust cap, bracket, suspension, and/or spider through the coupler.

In another aspect of the present invention, an electromagnetically-shielded earphone system may be provided for generating audible sounds based upon electric source signals supplied thereto while minimizing irradiation of undesirable electromagnetic waves into an ear and a brain of the user, where the system may be an earphone at least a portion of which may be disposed in a canal of an ear of the user and/or a headphone which may be disposed around a head of the user and over the ear of the user.

In one exemplary embodiment of this aspect of the invention, a system may include at least one drive member and at least one counter member. Such a drive member may be arranged to receive the signals, to convert the signals into the sounds, and then to transmit the sounds into the ear of the user while emitting the undesirable waves thereto. The counter member may be arranged to be disposed based on a preset relation to the drive member and to emit counter electromagnetic waves capable of canceling at least a substantial portion of the undesirable waves based on the preset relation, thereby minimizing the irradiation without affecting the sounds.

In another exemplary embodiment of this aspect of the present invention, a system may include at least one drive member and at least one counter member. Such a drive member may be arranged to receive the electric source signals in a first direction, to convert the signals into the sounds, and then to transmit the sounds into the ear of the user while irradiating such undesirable waves thereto. The counter member may be arranged to receive external currents and/or at least a portion of the electric signals along a second direction and to irradiate counter electromagnetic waves capable of canceling at least a substantial portion of the undesirable waves due to such directions, thereby minimizing the irradiation without affecting the sounds.

In another exemplary embodiment of this aspect of the invention, such a system may also have at least one case member, at least one drive member, and at least one counter member. Such a case member may be arranged to disposed into the ear canal of the user and to define at least one opening therethrough. The drive member may be arranged to be disposed on or in such a case member and to include at least one cone, at least one voice coil, and at least one magnet, where such a magnet may be arranged to define a static magnetic field therearound, where the voice coil may be arranged to be fixedly coupled to the cone, to receive the signals, and to form a dynamic magnetic field therearound when the signals flow therethrough while irradiating the undesirable waves, and where the cone may be arranged to vibrate due to interactions between such magnetic fields while generating the sounds and transmitting the sounds into the ear of the user. The counter member may then be arranged to be disposed on or in such case and/or drive members in a preset relation to the voice coil and/or magnet and to emit counter electromagnetic waves capable of canceling at least a substantial portion of such undesirable waves due to the preset relation, thereby minimizing the irradiation without affecting such sounds.

In another exemplary embodiment of this aspect of the invention, a system may include at least one case member, at least one drive member, and at least one counter member. Such a case member may be arranged to disposed in the ear canal and to define at least one opening therethrough, and the drive member may be arranged to be disposed on or in the case member and to include at least one cone, at least one voice coil, and at least one magnet. The magnet may be arranged to define a static magnetic field therearound, while the voice coil may be arranged to be fixedly coupled to the cone, to receive the electric signals, and to define a dynamic magnetic field therearound as the electric signals flow therethrough along a first direction while irradiating the undesirable waves. The cone may then be arranged to vibrate based on interactions between the magnetic fields while generating the sounds and transmitting the sounds into the ear. The counter member may be arranged to be disposed on or in the case and/or drive members, to receive external currents and/or at least a portion of the signals along a second direction, and to irradiate counter electromagnetic waves capable of canceling at least a substantial portion of the undesirable waves due to the directions, thereby minimizing the irradiation without affecting the sounds.

In another exemplary embodiment of this aspect of the invention, a system may include at least one case member, at least one drive member of the first type, and at least one magnetic shield. Such a case member may be arranged to disposed into the ear canal of the user and to define at least one opening therethrough. Such a magnetic shield may be one of the magnetic shield of the first, second or third type.

In another exemplary embodiment of this aspect of the invention, such a system may include at least one case member, at least one drive member of the first type, at least one electric shield of the first type, and at least one counter member. The case member may be arranged to disposed into the ear canal of the user and to define at least one opening therethrough, and the magnetic shield may be one of the magnetic shield of the first, second or third type.

In another aspect of the present invention, another electromagnetically-shielded communication system may be provided for generating sounds based upon electric source signals supplied thereto while minimizing irradiation of undesirable electromagnetic waves into an ear and a brain of the user, where the system may be a handset of a phone and/or a mobile phone and where at least a portion of the system may be arranged to be disposed over an ear of the user.

In one exemplary embodiment of this aspect of the invention, a system may include at least one drive member and at least one counter member. The drive member may be arranged to be disposed in or over the ear of the user, to receive such signals, to convert the signals into the sounds, and then to transmit the sounds in the ear of the user while emitting the undesirable waves thereto. The counter member may be arranged to be disposed in a preset relation to the drive member and to emit counter electromagnetic waves capable of canceling at least a substantial portion of the undesirable waves based on the preset relation, thereby minimizing the irradiation without affecting the sounds.

In another exemplary embodiment of this aspect of the invention, such a system may include at least one drive member and at least one counter member. The drive member may be arranged to be disposed over the ear of the user, to receive the electric source signals in a first direction, to convert the signals into the sounds, and then to transmit such sounds into the ear of the user while irradiating such undesirable waves thereto. The counter member may be arranged to receive external currents and/or at least a portion of such electric signals along a second direction and to also irradiate counter electromagnetic waves capable of canceling at least a substantial portion of the undesirable waves due to the directions, thereby minimizing the irradiation without affecting the sounds.

In another exemplary embodiment of this aspect of the present invention, a system may include at least one case member, at least one drive member, and at least one counter member. Such a case member may be arranged to disposed over the ear of the user and to also form at least one opening therethrough. The drive member may be arranged to be disposed on or in such a case member and to include at least one cone, at least one voice coil, and at least one magnet. Such a magnet may then be arranged to define a static magnetic field therearound, while the voice coil may be arranged to be fixedly coupled to the cone, to receive the signals, and to form a dynamic magnetic field therearound as the signals flow therein while emitting the undesirable waves. The cone may then be arranged to vibrate due to interactions between the magnetic fields while generating the sounds and transmitting the sounds into the ear of the user. The counter member may be arranged to be disposed on or in the case and/or drive members in a preset relation to the voice coil and/or magnet and to irradiate counter electromagnetic waves capable of canceling at least a substantial portion of such undesirable waves due to the preset relation, thereby minimizing the irradiation without affecting the sounds.

In another exemplary embodiment of this aspect of the invention, a system may include at least one case member, at least one drive member, and at least one counter member. Such a case member may be arranged to disposed over the ear of the user and to form at least one opening therethrough. The drive member may be arranged to be disposed on or in the case member and to have at least one cone, at least one voice coil, and at least one magnet. The magnet may be arranged to define a static magnetic field therearound, while the voice coil may be arranged to be fixedly coupled to the cone, to receive the electric signals, and to form a dynamic magnetic field therearound as the electric signals flow therethrough along a first direction while irradiating the undesirable waves. The cone may then be arranged to vibrate based on interactions between the magnetic fields while generating the sounds and transmitting the sounds into the ear of the user. The counter member may also be arranged to be disposed on or in the case and/or drive members, to receive external currents and/or at least a portion of the signals in a second direction, and to emit counter electromagnetic waves capable of canceling at least a substantial portion of the undesirable waves based upon the directions, thereby minimizing the irradiation without affecting the sounds.

In another exemplary embodiment of this aspect of the invention, a system may include at least one case member, at least one drive member of the first type, and at least one magnetic shield. The case member may be arranged to disposed over the ear of the user and to define at least one opening therethrough, while the magnetic shield may be one of the magnetic shield of the first, second or third type.

In another exemplary embodiment of this aspect of the invention, such a system may include at least one case member, at least one drive member of the first type, at least one electric shield of the first type, and at least one magnetic shield. The case member may be arranged to disposed over the ear of the user and to define at least one opening therethrough, while the magnetic shield may be one of the magnetic shield of the first, second or third type.

In another aspect of the present invention, an electromagnetically-shielded microphone system may be provided for receiving acoustic sounds and generating electric signals based on the acoustic sounds while minimizing irradiation of undesirable electromagnetic waves to an user.

In one exemplary embodiment of this aspect of the invention, a system may include at least one drive member and at least one counter member. The drive member which may be arranged to include a movable part, a stationary part, and a power source, to electrically charge such parts with different polarities by the power source, to receive the sounds with the movable part, and then to generate the signals based upon movements of the movable part due to the sounds while emitting such undesirable waves to the user. Such a drive member will be referred to as the "drive member of the fourth type" hereinafter. The counter member may then be arranged to be disposed in a preset relation to the drive member and to emit counter electromagnetic waves capable of canceling at least a substantial portion of such undesirable waves based upon the preset relation, thereby minimizing such irradiation without affecting the sounds.

In another exemplary embodiment of this aspect of the invention, a system may include at least one drive member and at least one counter member. Such a drive member may be arranged to include a movable part, a stationary part, and a power source, to electrically charge such parts with different polarities by the power source, to receive the sounds by the movable part, and then to generate such signals in a first direction based upon movements of the movable part due to the sounds while emitting the undesirable waves to the user. Such a counter member may then be arranged to receive external currents and/or at least a portion of such electric signals in a second direction and to irradiate counter electromagnetic waves capable of canceling at least a substantial portion of such undesirable waves due to the directions, thereby minimizing the irradiation without affecting the sounds.

In another exemplary embodiment of this aspect of the invention, a system may include at least one case member, at least one drive member of the fourth type, and at least one magnetic shield. The case member may be arranged to disposed closer to a mouth of the user and to also form at least one opening therethrough, while the magnetic shield may be one of the magnetic shield of the first, second or third type.

In another exemplary embodiment of this aspect of the invention, a system may include at least one case member, at least one drive member of the fourth type, at least one electric shield of the first type, and at least one magnetic shield. Such a case member may be arranged to disposed closer to a mouth of the user and to also form at least one opening therethrough, and the magnetic shield may be one of the magnetic shield of the first, second or third type.

Configurational and/or operational variations and/or modifications of such systems and various members thereof also fall within the scope of the present invention.

Such a system may be an earphone including at least one speaker with the counter member or electric and/or magnetic shields, a headphone including such a speaker, an audio and/or video system including such a speaker, another electric device including such a speaker, a speak of various electric devices, a microphone, an assembly of the speaker and microphone, and the like. Such a system may also be at least two same or different speakers enclosed in a single case member, at least two same or different speakers separately enclosed inside different case members, a pair of earphones, a pair of headphones, an assembly having at least one speaker and at least one microphone, and the like.

Such a relation may relate to a shape and/or a size of the counter member (or counter unit), a shape and/or a size of the voice coil, a shape and/or a size of the magnet, an orientation of the voice coil, counter member (or unit), and/or magnet, an arrangement of the counter member (or unit), voice coil, and/or magnet, amplitudes of the external currents and/or electric source signals flowing through the counter member (or unit) and/or voice coil, directions of the currents and/or signals flowing in the counter member (or unit) and/or voice coil, and the like. The counter member and/or counter unit may also define a curvilinear shape of a wire, an array thereof, a strip, an array thereof, a sheet, an array thereof, a tube, an array thereof, a coil, an array thereof, a mesh, an array thereof, a combination of two or more of such shapes, a mixture of two or more of such shapes, and the like, where the array may also define a shape of a bundle, a braid, a coil, a mesh, and the like. The shape and/or array may define a two-dimensional shape or a three-dimensional shape.

At least two portions of the counter member and/or counter unit may define the same or similar shapes of different sizes. At least two portions of the counter member and/or counter unit may have different shapes of similar or different sizes. At least two of the counter units may define the same or similar shapes of different sizes. At least two of the counter units may define different shapes of the same, similar or different sizes. The counter unit and voice coil may define the same or similar shapes of different sizes or, in the alternative, the counter unit and voice coil may define different shapes of similar or different sizes. The coil may be wound into a two-dimensional or three-dimensional solenoid and/or a toroid. Opposing ends of the solenoid or toroid may be arranged to oppose each other. The coil for the solenoid and/or toroid may include an even number of wires or strips at least two of which may generate the waves defining at least partially opposite phase angles. At least two of the counter units disposed adjacent (or close) to each other may be separated by at least one electric insulator when the units may not be coated by an insulative material, may contact each other when at least one of the units may be coated by the insulative material, and the like.

The counter unit may form an uniform shape and/or size along at least its substantial portion in a direction of its longitudinal axis, may have shapes and/or sizes varying in the direction, and the like. At least two of the counter units may electrically couple with each other in a series, parallel or hybrid pattern. At least two of the counter units may define longitudinal axes and may not electrically couple with each other in at least substantial portions along the axes. At least one of the counter units may enclose therein at least a portion of another counter units in a concentric arrangement, may extend (or be braided) along with the portion of another counter unit in a paired arrangement, and the like. Such a counter member (or unit) may define at least one junction and/or bifurcation therealong. The counter member may include therealong multiple layers at least two of which may operate as at least two of the counter units. The counter member (or unit) may include multiple portions which may couple with each other in series and/or parallel patterns or which may not be coupled to each other. The system may include multiple counter members (or units) which may be coupled to each other in series and/or parallel patterns or which may not be coupled to each other. At least two portions of the counter unit or at least two counter units of the counter member may extend in the same direction while forming a series coupling, where such currents or signals may flow therein with the same amplitude. At least two portions of the counter unit or at least two counter units of the counter member may extend in the same direction while forming a parallel coupling, where the currents or signals may flow therein with the same amplitude or different amplitudes.

The external currents or source signals may flow in at least two portions of the counter unit or at least two counter units of the counter member along the same direction but such at least two of the portions or units may also be wound in opposite directions, thereby canceling at least portions of the magnetic waves emitted thereby. Such currents or signals may flow through at least two portions of the counter unit or at least two counter units of the counter member in opposite directions and such at least two of the portions or counter units may be wound along the same direction, thereby canceling at least portions of the magnetic waves emitted thereby. The counter member and driver member may define substantially identical, similar or different resonance frequencies. The counter member and at least one of the voice coil and magnet may have identical, similar or different resonance frequencies. At least two portions of the counter unit or at least two counter units of the counter member may also define resonance frequencies which may be different from those of the rest thereof. At least one of multiple portions of the counter unit or at least one counter unit of the counter member may define a resonance frequency different from those of the rest thereof. At least one of multiple portions of the counter unit or at least one counter unit of the counter member may also be made of and/or include a different material, define a different resonance frequency, and have a different spectrum from that of the rest of the portions of the counter unit and from that of the rest of the counter units of the counter member, respectively. At least two portions of the counter unit or at least two counter units of such a counter member may be made of and/or include at least one common material and one of such at least two portions or units may include at least one frequency-modulating agent and define such spectrum which may overlap only preset portions of the spectrum of another of such two of the units but may not overlap the rest of the spectrum thereof. The preset portions of the electromagnetic waves may include low-frequency waves having frequencies less than 300 kHz, very low-frequency waves of frequencies less than 30 kHz, ultra low-frequency waves of frequencies less than 3 kHz, extremely low-frequency waves of frequencies less than 300 Hz, carrier frequencies in a range of from about 50 Hz to about 60 Hz, and the like. At least one portion of the counter unit or at least one counter unit of the counter member may be made of and/or include at least one material irradiating infrared rays including far-infrared rays, medium-infrared rays, and near-infrared rays as the current flows therein. The rest of the electromagnetic waves may be far infrared rays in a frequency range from about 300 gHz to about 10 tHz, medium infrared rays in a frequency range from about 10 tHz to about 100 tHz, a near infrared rays in a frequency range from about 100 tHz to about 700 tHz, and the like.

The system may include at least one of the magnetic shields described hereinabove or in the co-pending Applications. The magnetic shields may be disposed in, on, over, around, and/or through at least one of the members. The magnetic shields may define shapes at least partially conforming to shapes of at least one of the members of the system or, in the alternative, may define shapes at least partially different from shapes of at least one of the members. The path member may define a relative magnetic permeability greater than 1,000 or 10,000. The pole of the magnet member may be a South pole. The shunt member may directly or indirectly contact the magnet member. Such a shunt member may define a relative magnetic permeability greater than 1,000, 10,000 or higher. The magnetic shields described hereinabove or disclosed in the co-pending Applications may also be incorporated into any of the prior art devices and define novel systems of this invention. The system may further include at least one of the electric shields described hereinabove or in the co-pending Applications. The electric shields described hereinabove or disclosed in the co-pending Applications may be incorporated into any of the prior art devices and define novel systems of this invention. Such magnetic and/or electric shields may form shapes and/or sizes which may be maintained uniform along a longitudinal axis of at least one of the members or which may vary therealong. Such shapes and/or sizes of the magnetic shields and/or electric shields may be identical to, similar to or different from those of at least one of the members. The system may include multiple magnetic and/or electric shields. At least two of such magnetic and/or electric shields may shield against the magnetic waves and/or electric waves having same or different frequencies in same or different extents. The magnetic and/or electric shields may be disposed over at least a portion (or entire portion) of at least one of the members. The system may include the counter member and at least one of the electric shields and magnetic shields. At least one of the members may operate on AC or DC.

In another aspect of this invention, a method may be provided for generating audible sounds based upon electric source signals with a speaker system while minimizing irradiation of undesirable electromagnetic waves generated by at least one source of the waves by canceling at least a portion of the waves.

In one exemplary embodiment of this aspect of the present invention, such a method may have the steps of: incorporating at least one counter member in a preset relation to the wave source (to be referred to as the "first incorporating" hereinafter); flowing the signals in the source (to be referred to as the "first flowing" hereinafter); generating the sounds by the system while irradiating the waves by the source (to be referred to as the "first generating" hereinafter); flowing external electric currents and/or at least a portion of the source signals in the counter member (to be referred to as the "second flowing" hereinafter); and manipulating the relation of the counter member for emitting thereby counter electromagnetic waves and for canceling the portion of the undesirable waves, thereby minimizing the irradiation.

In another exemplary embodiment of such an aspect of the invention, a method may include the steps of: the first incorporating; flowing the signals of first amplitudes in a first direction in the source; the first generating; flowing external electric currents and/or at least a portion of such source signals each defining second amplitudes along a second direction in the counter member; and manipulating the amplitudes and/or directions to emit by the counter member counter electromagnetic waves capable of canceling the portion of the undesirable waves, thereby minimizing the irradiation.

In another exemplary embodiment of such an aspect of the invention, a method may include the steps of: incorporating the source and at least one counter member in a proximity to an user; the first flowing; the first generating; the second flowing; and then irradiating with the counter member counter electromagnetic waves capable of canceling the portion of the undesirable waves at least primarily in such a proximity and/or another proximity to the user, thereby minimizing the irradiation.

In another aspect of this invention, a method may be provided for generating audible sounds based upon electric source signals with a speaker system while minimizing irradiation of undesirable electromagnetic waves generated by at least one source of the undesirable waves through shielding at least a portion of the waves from the user.

In one exemplary embodiment of this aspect of the present invention, a method may include the steps of: disposing at least one electrically conductive shield in a preset relation to the wave source; the first flowing; generating the sounds by the system while irradiating the waves by the source; and absorbing at least a portion of electric waves of the undesirable waves by the shield for the shielding.

In another exemplary embodiment of such an aspect of the invention, a method may include the steps of: disposing at least one magnetically permeable shield in a preset relation to the wave source (to be referred to as the "first disposing" hereinafter); the first flowing; the first generating; absorbing at least a portion of magnetic waves of the undesirable waves with the shield for the shielding.

In another exemplary embodiment of such an aspect of the invention, such a method may have the steps of: the first disposing; the first flowing; the first generating; absorbing at least a portion of magnetic waves of the undesirable waves by such a shield (to be referred to as the "first absorbing" hereinafter); and rerouting the portion of the magnetic waves along the shield for the shielding.

In another exemplary embodiment of such an aspect of the invention, a method may include the steps of: the first disposing; defining at least one magnetic pole in the shield; the first flowing, the first generating; the first absorbing; rerouting the portion of the magnetic waves along the shield; and then terminating the portion of the magnetic waves in the magnetic pole for the shielding.

In another exemplary embodiment of such an aspect of the invention, a method may include the steps of: the first disposing; forming at least one magnetic pole over the shield; enclosing the magnetic pole of the shield by another magnetically permeable portion; the first flowing; the first generating; the first absorbing; rerouting the portion of the magnetic waves along the shield; and then terminating the portion of the magnetic waves in the magnetic pole for the shielding, while confining a magnetic field formed by the magnetic pole closer to the shield by the another portion of the shield.

In another exemplary embodiment of such an aspect of the invention, a method may include the steps of: disposing at least one electrically conductive shield in a preset relation to the wave source; the first disposing; the first flowing; the first generating; absorbing at least a portion of electric waves of the undesirable waves with the shield for at least a portion of the shielding; and absorbing at least a portion of magnetic waves of such undesirable waves with the shield for at least another portion of the shielding.

In another aspect of this invention, a method may be provided for generating audible sounds based upon electric source signals with a speaker system while protecting an user from undesirable electromagnetic waves irradiated from at least one source which defines a first configuration and in which the signals flow along a first direction.

In one exemplary embodiment of this aspect of the present invention, a method may include the steps of: forming at least one counter member in a configuration similar to the first configuration; the first flowing; the first generating; the second flowing; and irradiating from the counter member counter electromagnetic waves capable of canceling at least a portion of the undesirable waves in a proximity to one of the source and user based on the configurations, thereby protecting the user.

In another exemplary embodiment of such an aspect of the invention, a method may include the steps of: forming at least one counter member in a configuration different from the first configuration; the first flowing; the first generating; flowing external electric currents and/or at least a portion of the source signals in the counter member in a second direction; and irradiating from the counter member counter electromagnetic waves capable of canceling at least a portion of the undesirable waves in a proximity to the source and/or user based on the configurations and/or directions, thereby protecting the user.

In another exemplary embodiment of such an aspect of the invention, a method may include the steps of: incorporating at least one counter member (to be referred to as the "second incorporating" hereinafter); arranging the counter member to enclose only a (or entire) portion of the source; the first flowing; the first generating; the second flowing; and then irradiating by the counter member counter electromagnetic waves capable of canceling at least a portion of the undesirable waves in a proximity to one of the source and user based upon the arranging, thereby protecting the user. The arranging may be replaced by the step of: arranging the counter member to not enclose the source.

In another exemplary embodiment of such an aspect of the invention, a method may include the steps of; positioning at least one counter member closer to (or farther from) the user than the source; the first flowing; the first generating; the second flowing; and then irradiating by the counter member counter electromagnetic waves capable of canceling at least a portion of the undesirable waves in a proximity to one of the source and user based upon the positioning, thereby protecting the user. The positioning may be replaced by the step of: positioning at least one counter member and/or the source flush with the user.

In another exemplary embodiment of such an aspect of the invention, such a method may have the steps of: placing the source at a first distance from the user; incorporating at least one counter member at a second distance from the user; the first flowing; generating the sounds with the system while irradiating by the source the waves having first amplitudes; the second flowing; and irradiating from the counter member counter electromagnetic waves defining second amplitudes and capable of canceling at least a portion of the undesirable waves in a proximity to the user and/or source based upon at least one of the amplitudes and distances, thereby protecting the user.

In another exemplary embodiment of such an aspect of the invention, a method may include the steps of: the second incorporating; flowing such signals of first amplitudes in a first direction through the source; the first generating; flowing external electric currents of second amplitudes and/or at least a portion of the source signals of third amplitudes along a second direction in the counter member; and irradiating by the counter member counter electromagnetic waves which have second amplitudes and which are capable of canceling at least a portion of the undesirable waves in a proximity to the user and/or source based on the amplitudes and/or directions, thereby protecting the user.

In another exemplary embodiment of such an aspect of the invention, a method may include the steps of: forming at least one counter member to have a second configuration; arranging the counter member in a preset arrangement to the source; positioning the counter member in a preset distance from the user; flowing the signals of first amplitudes in a first direction through the source; generating the sounds by the system while emitting the waves by the source; flowing external electric currents of second amplitudes and/or at least a portion of the source signals of third amplitudes along a second direction in the counter member; and then irradiating by the counter member counter electromagnetic waves capable of canceling at least a portion of the undesirable waves in a proximity to the source and/or user based on the above configurations, arranging, positioning, distances, amplitudes, and/or directions, thereby protecting the user.

In another exemplary embodiment of such an aspect of the invention, a method may include the steps of: the second incorporating; including at least one magnetically hard and/or soft insert inside the counter member; the first flowing; the first generating; the second flowing; and irradiating from the counter member counter electromagnetic waves augmented by the insert and for canceling at least a portion of the undesirable waves in a proximity to one of the source and user, thereby protecting the user.

In another aspect of this invention, a method may be provided for generating audible sounds based upon electric source signals with a speaker system while protecting an user from undesirable electromagnetic waves irradiated from at least one source.

In one exemplary embodiment of this aspect of the present invention, a method may include the steps of: aligning at least one counter member with the undesirable waves; the first flowing; the first generating; the second flowing; and then irradiating by the counter member counter electromagnetic waves capable of canceling at least a portion of the undesirable waves in a proximity to the source and/or user based on the above aligning, thereby protecting the user. The aligning may be replaced by the step of: aligning at least one counter member with an axis of propagation of such undesirable waves.

In another exemplary embodiment of such an aspect of the invention, such a method may also include the steps of: incorporating at least one counter member at a preset distance from the user; the first flowing; the first generating; the second flowing; irradiating from such a counter member counter electromagnetic waves while controlling amplitudes and/or direction of such at least one of the portion of the signals and/or currents to the counter member; and canceling at least a substantial (or only a preset) portion of the undesirable waves by the counter waves in a proximity to the source and/or the user based upon at least one of the distance and a position of the user, thereby protecting the user.

In another exemplary embodiment of such an aspect of the invention, a method may include the steps of: including multiple the sources in the system; incorporating multiple counter members in preset relations with respect to the sources; flowing the signals through the sources; generating the sounds by the system while irradiating the waves by the sources; flowing external electric currents and/or at least a portion of the source signals in each of the counter members; and irradiating by each of such counter members a set of counter electromagnetic waves capable of canceling at least a portion of the undesirable waves which are emitted by each of the sources in a proximity to the source and/or user, thereby protecting the user. The irradiating may be replaced by the step of: irradiating with the counter members multiple sets of counter electromagnetic waves for canceling at least a portion of a sum of the undesirable waves which are irradiated by the sources in a proximity to the source and/or user, thereby protecting the user.

In another aspect of this invention, a method may be provided for generating audible sounds based upon electric source signals with a speaker system while minimizing irradiation of undesirable electromagnetic waves generated by at least one source of the waves by canceling at least a portion of the waves by a counter member including at least one counter unit therein.

In one exemplary embodiment of this aspect of the present invention, a method may include the steps of: providing a single counter unit in the member in a preset relation to the wave source (to be referred to as the "first providing" hereinafter); the first flowing; the first generating; flowing external electric currents and/or at least a portion of the source signals in the counter unit (to be referred to as the "third flowing" hereinafter); and manipulating such a relation of the counter unit to emit therefrom counter electromagnetic waves capable of canceling the portion of the undesirable waves, thereby minimizing the irradiation.

In another exemplary embodiment of such an aspect of the invention, a method may include the steps of: the first providing; flowing the signals of first amplitudes in the source in a first direction; the first generating; flowing external electric currents and/or at least a portion of the source signals with second amplitudes in the counter unit along a second direction; and manipulating the amplitudes and/or directions of such currents and/or signals to the counter unit to emit thereby counter electromagnetic waves capable of canceling the portion of the undesirable waves, thereby minimizing the irradiation.

In another exemplary embodiment of such an aspect of the invention, a method may include the steps of: providing multiple counter units in the counter member in preset relations to the wave source (to be referred to as the "second providing" hereinafter); the first flowing; the first generating; flowing external electric currents and/or at least a portion of such source signals in the counter units (to be referred to as the "fourth flowing" hereinafter); and manipulating the relations of the counter units for irradiating thereby counter electromagnetic waves for canceling the portion of the undesirable waves, thereby minimizing the irradiation.

In another exemplary embodiment of such an aspect of the invention, a method may include the steps of the second providing; flowing the signals of first amplitudes in the source in a first direction; the first generating; flowing external electric currents and/or at least a portion of the source signals of second amplitudes in the counter units in second directions; and manipulating such amplitudes and/or directions of such currents and/or signals to the counter units to emit thereby counter electromagnetic waves capable of canceling the portion of the undesirable waves, thereby minimizing the irradiation.

In another exemplary embodiment of such an aspect of the invention, a method may include the steps of: providing a single counter unit with a symmetric (or asymmetric) shape; the first flowing; the first generating; the third flowing; and manipulating the shape of the counter unit to irradiate therefrom counter electromagnetic waves capable of canceling the portion of the undesirable waves, thereby minimizing the irradiation.

In another exemplary embodiment of such an aspect of the invention, a method may include the steps of: arranging a single counter unit symmetrically (or asymmetrically) to such a source; the first flowing; the first generating; the third flowing; and manipulating such arranging the counter unit to emit therefrom counter electromagnetic waves capable of canceling the portion of the undesirable waves, thereby minimizing the irradiation.

In another exemplary embodiment of such an aspect of the invention, such a method may have the steps of arranging multiple counter units symmetrically (or asymmetrically) to each other; the first flowing; the first generating; the third flowing; and manipulating such arranging to emit by the counter units counter electromagnetic waves capable of canceling such a portion of the undesirable waves, thereby minimizing the irradiation. Such arranging may be replaced by the step of: arranging multiple counter units symmetrically (or asymmetrically) to the source.

In another exemplary embodiment of such an aspect of the invention, a method may include the steps of forming at least one counter unit of a composition of at least a portion of the source; the first providing; the first generating; the third flowing; and manipulating the composition of the counter unit to irradiate thereby counter electromagnetic waves for canceling the portion of the undesirable waves, thereby minimizing such irradiation. The forming may be replaced by the step of: forming at least one counter unit from a composition different from that of the source;

In another aspect of this invention, a method may be provided for generating audible sounds based upon electric source signals with a speaker system while minimizing irradiation of undesirable electromagnetic waves generated thereby toward an user.

In one exemplary embodiment of this aspect of the present invention, a method may include the steps of: including in the system at least one source of the undesirable waves (to be referred to as the "third including" hereinafter); arranging the counter member to conform to at least a portion of the source; the first flowing; the first generating; the second flowing; and then irradiating by the counter member counter electromagnetic waves capable of canceling at least a portion of such undesirable waves, thereby minimizing the irradiation. The arranging may also be replaced by one of the steps of: arranging the counter member to not conform to the source; disposing the counter member to conform to at least a portion of the source; and disposing the counter member to not conform to the source.

In another exemplary embodiment of such an aspect of the invention, such a method may have the steps of: the third including; the second incorporating; the first flowing; the second generating, the second flowing; and irradiating from the counter member counter electromagnetic waves which have amplitudes similar to, greater than or less than those of the undesirable waves and which are capable of canceling at least a portion of the undesirable waves in a proximity to the source and/or the user, thereby minimizing the irradiation.

In another exemplary embodiment of such an aspect of the invention, a method may include the steps of: the third including; the second incorporating; flowing the signals of first amplitudes in a first direction through the source; the first generating; flowing external electric currents and/or at least a portion of the source signals each of second amplitudes in a second direction in the counter member; and irradiating from the counter member counter electromagnetic waves capable of canceling at least a portion of the undesirable waves in a proximity to the source and/or user based on such amplitudes and/or directions, thereby minimizing the irradiation.

In another exemplary embodiment of such an aspect of the invention, a method may include the steps of: the third including; the second incorporating; electrically connecting the counter member with the source in a parallel mode, a series mode or a hybrid mode; the first flowing; the first generating; the second flowing; and emitting from the counter member counter electromagnetic waves capable of canceling at least a portion of such undesirable waves in a proximity to the source and/or user based on the connecting, thereby minimizing the irradiation. The connecting may be replaced by the step of: not electrically connecting the counter member to the source.

In another exemplary embodiment of such an aspect of the invention, a method may include the steps of: the third including; the second incorporating; flowing the signals in the source and then in the counter member; the first generating; the second flowing; and then irradiating by the counter member counter electromagnetic waves capable of canceling at least a portion of the undesirable waves in a proximity to the source and/or user based upon the flowing, thereby minimizing the irradiation. Such flowing may be replaced by one of the steps of: flowing the signals in the counter member and then in the source; and flowing the signals in the source and counter member simultaneously.

In another aspect of this invention, a method may be provided for generating audible sounds based upon electric source signals from an earphone and/or a headphone system while minimizing irradiation of undesirable electromagnetic waves generated thereby toward an ear and a brain of an user.

In one exemplary embodiment of this aspect of the present invention, such a method may have the steps of: the first incorporating; the first flowing; the first generating; the second flowing; and then manipulating the relation of the counter member for emitting thereby counter electromagnetic waves and for canceling the portion of the undesirable waves, thereby minimizing the irradiation.

In another exemplary embodiment of such an aspect of the invention, a method may include the steps of: the first incorporating; flowing the signals of first amplitudes in a first direction in the source; the first generating; flowing external electric currents and/or at least a portion of such source signals each having second amplitudes in a second direction in the counter member; and then manipulating the amplitudes and/or directions to irradiate by the counter member counter electromagnetic waves which are capable of canceling the portion of the undesirable waves, thereby minimizing the irradiation.

In another exemplary embodiment of such an aspect of the invention, a method may include the steps of: incorporating the source and at least one counter member in proximity to an user; the first flowing; the first generating; the second flowing; and then irradiating with the counter member counter electromagnetic waves capable of canceling the portion of the undesirable waves at least primarily in the proximity and/or another proximity to the user, thereby minimizing the irradiation without affecting the sound.

In another aspect of this invention, a method may be provided for generating audible sounds based on electric source signals by a communication device including a cellular phone or a handset of a phone while minimizing irradiation of undesirable electromagnetic waves generated thereby toward an ear and a brain of an user.

In one exemplary embodiment of this aspect of the present invention, such a method may have the steps of: the first incorporating; the first flowing; the first generating; the second flowing; and then manipulating the relation of the counter member for emitting thereby counter electromagnetic waves and for canceling the portion of the undesirable waves, thereby minimizing the irradiation.

In another exemplary embodiment of such an aspect of the invention, a method may include the steps of: the first incorporating; flowing the signals of first amplitudes in a first direction through the source; the first generating; flowing external electric currents and/or at least a portion of the source signals each having second amplitudes in a second direction in the counter member; and manipulating such amplitudes and/or directions to irradiate by the counter member counter electromagnetic waves capable of canceling the portion of the undesirable waves, thereby minimizing the irradiation.

In another exemplary embodiment of such an aspect of the invention, a method may include the steps of: incorporating the source and at least one counter member in proximity to an user; the first flowing; the first generating; the second flowing; and then irradiating with the counter member counter electromagnetic waves capable of canceling the portion of the undesirable waves at least primarily in the proximity and/or another proximity to the user, thereby minimizing the irradiation without affecting the sound.

In another aspect of this invention, a method may be provided for generating audible sounds based on electric source signals by multiple speakers of a speaker system while minimizing irradiation of undesirable electromagnetic waves from the speakers to an user.

In one exemplary embodiment of this aspect of the present invention, a method may include the steps of: disposing the speakers in a single case member; defining at least one source of the waves in each of such speakers; incorporating multiple counter members in preset relations to each of such sources; flowing the signals in the sources; generating the sounds by the system while irradiating the waves by the sources; flowing in each of the counter members external electric currents and/or at least a portion of the signals each of which define preset amplitudes and flow along preset directions; and manipulating the relations, amplitudes, and/or directions of the counter members for irradiating by each of the counter members counter electromagnetic waves capable of canceling at least a portion of the undesirable waves emitted by each of the sources, thereby minimizing the irradiation by all of the speakers as well.

In another exemplary embodiment of such an aspect of the invention, a method may include the steps of: disposing the speakers in a single case member; defining at least one source of the waves in each of the speakers; incorporating at least one counter member in a preset relation to the sources; flowing the signals through the sources; generating such sounds by the system while irradiating the waves by the sources; flowing in the counter member at least a portion of the source signals and/or external electric currents each defining preset amplitudes and flowing in a preset direction; and then manipulating such relation, amplitudes, and/or direction of the counter member for irradiating counter electromagnetic waves which are capable of canceling at least a portion of a sum of the undesirable waves emitted by all of the sources, thereby minimizing the irradiation as well.

In another exemplary embodiment of such an aspect of the invention, a method may include the steps of: defining at least one source of the waves in each of the speakers; disposing the speakers in a preset arrangement; incorporating at least one counter member in a preset relation to the sources; flowing the signals through the sources; generating the sounds by the system while irradiating such undesirable waves by the sources; flowing external electric currents and/or at least a portion of the source signals defining preset amplitudes and flowing in a preset direction in the counter member; and manipulating the relation, amplitudes, and/or direction of such a counter member for irradiating counter electromagnetic waves which are capable of canceling at least a portion of a sum of the undesirable waves emitted by all of the sources, thereby minimizing the irradiation as well.

In another exemplary embodiment of such an aspect of the invention, a method may include the steps of: defining at least one source of the waves in each of the speakers; disposing the speakers in any arbitrary arrangement; incorporating at least one counter member; flowing the signals along the sources; generating the sounds by the system while irradiating such waves by the sources; flowing external electric currents and/or at least a portion of such signals each having preset amplitudes and flowing in a preset direction in the counter member; and manipulating such amplitudes and/or direction while disposing the counter member in an arrangement capable of irradiating counter electromagnetic waves for canceling at least a portion of a sum of such undesirable waves irradiated by all sources, thereby minimizing the irradiation as well.

Configurational and/or operational variations and/or modifications of such methods fall within the scope of the present invention.

Such incorporating may include one of the steps of: directly coupling the counter member with a portion of the system; coupling the counter member to the system through a coupler, and so on. The incorporating may include the step of: manipulating configuration of at least a portion of the counter member, orientation thereof with respect to at least a portion of the source, arrangement thereof with respect thereto, and so on. The incorporating may include the step of: manipulating the configuration, orientation, and/or arrangement with respect to at least one of amplitudes of the signals flowing in the source, directions of the signals flowing therein, distances of the source and counter member from the user, amplitudes of at least one of the counter and undesirable waves measured by the user, and the like. The incorporating may include one of the steps of: enclosing at least a portion of the source by the counter member; surrounding the portion of the source by the counter member; disposing such a counter member without enclosing any of the source, and so on. The incorporating may include the steps of: defining multiple counter units in the counter member; and incorporating each of the counter units in one of the same relation and different relations to the source. Such incorporating may include one of the steps of: electrically connecting the source to the counter member based on a series mode, a parallel mode or a hybrid mode; and not directly connecting such a source with the counter member electrically.

The flowing the signals may include one of the steps of: flowing the signals along an entire portion of the source; flowing the signals in only a portion of the source; flowing different portions of the signals in different portions of the source; and the like. The flowing the signals may include one of the steps of: flowing the signals in a single direction along the source; flowing the signals in different directions in different portions of the source, and the like. The system may include multiple sources of such undesirable waves and the flowing may then include one of the steps of, flowing the signals of the same amplitudes along the same direction in all of the sources; flowing such signals of the same amplitudes in different directions along the sources; flowing the signals of different amplitudes in the same direction in all of the sources; flowing the signals of different amplitudes in different directions in the sources, and the like.

The generating may include the steps of: generating a static magnetic field; generating another magnetic field varying in response to the signals; and moving a portion of the source for generating the sounds while irradiating the undesirable waves by such varying magnetic field. Such generating may include the steps of: generating a static electric field; generating another electric field varying in response to the signals; vibrating a portion of the source for generating the sounds while irradiating the undesirable waves through the varying electric field, and the like.

The flowing the currents and/or signals may include one of the steps of: flowing the portion of the signals of the same (or different) amplitudes in the counter member; flowing in the counter member such currents which may not be derived from such signals but may define a temporal pattern at least partially similar to that of the signals; flowing along the counter member such currents which may be derived not from the signals and may define a temporal pattern different from that of the signals. The flowing the currents and/or signals may include one of the steps of: flowing the signals in the source and then in the counter member, flowing such signals in the counter member and then in the source; flowing the signals at least simultaneously in the source and counter member, and the like.

Such disposing the shield may include at least one of the steps of: including the shield onto at least a portion of the source; incorporating the shield between at least two portions of such a source; disposing the shield over or on the source; disposing the shield about at least a portion of the source; disposing the shield between the source and user while defining at least one opening over the shield, and the like. The disposing the shield may include one of the steps of: orienting the shield normal to a direction of propagation of the undesirable waves; orienting the shield at a preset angle with respect to the direction of propagation, and the like.

The absorbing the portion of the electric waves may be followed by the step of: grounding the electric shield. The absorbing the portion of the electric and magnetic waves may also include at least one of the steps of: disposing the electric and magnetic shields at a preset angle; spacing the shields by a preset distance; physically contacting the electric shield with the magnetic shield, and so on. The positioning may also include one of the steps of: fixedly disposing the counter member to the system; movably disposing the counter member thereto for allowing the counter member to move while emitting the counter waves, and the like. The aligning may also include at least one of the steps of: aligning a longitudinal axis of the source with that of the counter member; disposing different portions of such a counter member along the axis of the source; concentrically placing such a counter member along the axis of the source; and misaligning the counter member from the axis of the source. Such arranging and/or disposing the counter member may include at least one of the steps of: disposing the counter member around a periphery of the source symmetrically or asymmetrically; arranging such a counter member on a periphery of the source at a preset distance symmetrically or asymmetrically, and so on.

Such irradiating and/or emitting such counter electromagnetic waves may include the steps of: manipulating phase angles of the counter waves to be at least partially (or substantially) opposite to those of the undesirable waves. The irradiating and/or emitting such counter electromagnetic waves may include at least one of the steps of: manipulating the amplitudes of the counter waves to be less or greater than those of the undesirable waves when measured at or near the source; manipulating the amplitudes of the counter waves to be greater or less than those of the undesirable waves when measured at the brain or ear of the user; and manipulating the amplitudes of the counter waves to be at least substantially similar to those of the undesirable waves when measured at one of the source, ear, and brain. The irradiating and/or emitting the counter electromagnetic waves may include at least one of the steps of: propagating the counter waves in the same direction as that of such undesirable waves; propagating the counter waves along a direction different from that of the undesirable waves irradiated by each of multiple sources but along the same direction as that of a sum of the undesirable waves from the sources, and the like.

Such manipulating at least one of the configuration and shape may include the step of: forming the counter member into at least one of the configuration and shape. The forming the counter member may include at least one of the steps of: extending a single wire for at least a portion of the counter member, extending an array and/or bundle of multiple wires for the portion of such a counter member; extending a single strip therefor; extending an array or a bundle of multiple strips therefor; extending a single sheet therefor; extending an array and/or bundle of multiple sheets therefor; extending a single tube therefor; extending a bundle or an array of multiple tubes therefor; winding a single coil therefor; winding a bundle and/or array of multiple coils therefor; extending a single annular mesh therefor; and extending an array or a bundle of multiple annular meshes therefor. The providing the single counter unit may include at least one of the steps of the forming. The providing the counter units may include the steps: providing at least two (or all) of the counter units based on one of the steps of the forming. The providing the counter units may also include the steps: providing at least one of the counter units based upon one of the steps of the forming; and providing at least another of the counter unit based upon another of the steps of the forming. The manipulating such arranging may include at least one of the steps of: enclosing at least a portion of the source by an array or bundle of multiple wires of the counter member; enclosing the portion of the source by an array or bundle of multiple strips of such a counter member; enclosing the portion of the source by an array or bundle of multiple sheets of such a counter member; enclosing the portion of the source by an array or bundle of multiple tubes of such a counter member; winding at least one coil of the counter member about the portion of the source; winding the portion of the source by an array or bundle of multiple coils; enclosing the portion of such a source by at least one annular mesh of the counter member, and so on. The enclosing may include one of the steps of: disposing the counter member indirectly over (or around) the portion of source; and disposing the counter member directly on (or around) the portion of the source. Such enclosing may include at least one of the steps of: arranging at least two of the counter member concentrically; electrically coupling the units in one of a series mode, a parallel mode, and a hybrid mode, and the like. Such manipulating the relation may include at least one of the steps of manipulating the configuration; manipulating the amplitudes; manipulating the directions; manipulating the shape; and manipulating the arranging. The flowing may further include at least one of the steps of: supplying AC to the system; supplying DC thereto; rectifying the AC and supplying a rectified DC thereto, and the like.

In another aspect of the present invention, an electromagnetically shielded speaker system may be provided for generating audible sounds based upon electric source signals while minimizing undesirable electromagnetic waves irradiated by at least one source of the waves thereof to an user.

In one exemplary embodiment of this aspect of the invention, a speaker system may be made by a process comprising the steps of: flowing the signals in the source while generating the sounds and irradiating the waves; disposing at least one counter member in a preset geometric relation to the source; and then arranging the counter member to irradiate counter electromagnetic waves capable of canceling at least a portion of the undesirable waves based on the relation, thereby minimizing the irradiation to the user.

In another exemplary embodiment of this aspect of the invention, another speaker system may be made by a process comprising the steps of: flowing the signals having first amplitudes along a first direction in the source while generating the sounds and irradiating the waves; disposing at least one counter member in a preset electrical relation to the source; and arranging the counter member to emit counter electromagnetic waves by flowing therein external electric currents and/or at least a portion of the signals having second amplitudes and flowing along a second direction and to cancel at least a portion of the undesirable waves by the counter waves, thereby minimizing the irradiation to the user.

In another exemplary embodiment of this aspect of the invention, another speaker system may be made by a process comprising the steps of: flowing the signals in the source while generating the sounds and irradiating the waves; disposing at least one counter member at a preset distance from the user; and then arranging the counter member to irradiate counter electromagnetic waves having amplitudes capable of canceling at least a portion of such undesirable waves in a vicinity of the user based upon the distance and amplitudes, thereby minimizing the irradiation to the user.

In another aspect of the present invention, an electromagnetically-shielded speaker system may be provided for generating audible sounds based upon electric source signals supplied thereto while minimizing irradiation of undesirable electromagnetic waves to an user.

In one exemplary embodiment of this aspect of the invention, a speaker system may be made by a process comprising the steps of: arranging a drive member to receive the signals, to convert the signals into the sounds, and to transmit the sounds to the user while emitting the undesirable waves thereto; incorporating at least one counter member in a preset relation to the drive member; and then arranging the counter member to emit counter electromagnetic waves capable of canceling at least a portion of the undesirable waves based on the relation, thereby minimizing the irradiation.

In another exemplary embodiment of this aspect of the invention, another speaker system may be made by a process comprising the steps of: arranging a drive member to receive the signals along a first direction, to convert the signals to the sounds, and then to transmit the sounds to the user while emitting the undesirable waves thereto; incorporating at least one counter member; and arranging the counter member to receive external currents and/or at least a portion of such signals defining preset amplitudes and flowing along a second direction and to emit counter electromagnetic waves capable of canceling at least a portion of the undesirable waves due to the amplitudes and directions, thereby minimizing the irradiation.

In another exemplary embodiment of this aspect of the invention, another speaker system may be made by a process comprising the steps of: arranging a case member having at least one opening therethrough; disposing a drive member on (or in) the case member; providing the drive member with at least one magnet capable of forming a static magnetic field therearound, at least one voice coil, and at least one cone, where the voice coil may be arranged to be fixedly coupled to the cone, to receive such signals, and to form a dynamic magnetic field therearound when the signals flow therethrough while irradiating the undesirable waves and where the cone may then be arranged to vibrate due to interactions between the magnetic fields while generating the sounds; disposing at least one counter member on (or in) at least one of the case and drive members in a preset relation to at least one of the voice coil and magnet; and arranging the counter member to irradiate counter electromagnetic waves capable of canceling at least a portion of the undesirable waves based on the preset relation, thereby minimizing the irradiation.

In another exemplary embodiment of this aspect of the invention, another speaker system may be made by a process comprising the steps of: arranging a case member having at least one opening therethrough; disposing a drive member on (or in) the case member; providing the drive member with at least one magnet capable of forming a static magnetic field therearound, at least one voice coil, and at least one cone, where the voice coil may be arranged to be fixedly coupled to the cone, to receive the signals, and to form a dynamic magnetic field therearound as the signals flow therethrough along a first direction while irradiating the undesirable waves, and where the cone may then be arranged to vibrate based on interactions between the magnetic fields while generating the sounds; disposing at least one counter member on (or in) at least one of such case and drive members and then to receive external currents and/or at least a portion of the signals defining second amplitudes and flowing along a second direction; and arranging the counter member to emit counter electromagnetic waves capable of canceling at least a portion of the undesirable waves based upon the amplitudes and/or directions, thereby minimizing the irradiation.

In another exemplary embodiment of this aspect of the invention, another speaker system may be made by a process comprising the steps of: arranging a drive member to receive such signals, to convert the signals to the sounds, and to transmit the sounds to an ear canal of the ear while emitting the undesirable waves thereinto; incorporating at least one counter member in a preset relation to the drive member; and arranging the counter member to emit counter electromagnetic waves capable of canceling at least a portion of the undesirable waves based on the preset relation, thereby minimizing the irradiation.

In another exemplary embodiment of this aspect of the invention, another speaker system may be made by a process comprising the steps of: arranging a drive member to receive the signals in a first direction, to convert the signals to the sounds, and to transmit the sounds into an ear canal of the ear while emitting such undesirable waves thereinto; incorporating at least one counter member, and arranging the counter member to receive external currents and/or at least a portion of the signals in a second direction and to emit counter electromagnetic waves capable of canceling at least a portion of the undesirable waves based on the amplitudes and/or directions, thereby minimizing the irradiation.

In another exemplary embodiment of this aspect of the invention, another speaker system may be made by a process comprising the steps of: disposing a case member; arranging a drive member to be at least partially supported by the case member, to receive such signals, to convert the signals into the sounds, and to transmit the sounds through the case member while emitting such undesirable waves; and arranging at least one magnetic shield to be coupled to the case and/or drive members, to absorb magnetic waves of the undesirable waves therein, and to reroute the magnetic waves away from the user therealong, thereby minimizing the irradiation. Such arranging may also be replaced by the step of: arranging at least one magnetic shield to be coupled to the case and/or drive members, to include at least one magnetically permeable path member and at least one magnet member forming at least one magnetic pole thereover and one of directly and indirectly coupling with the path member, to absorb magnetic waves of the undesirable waves along the path member, and then to terminate such magnetic waves in the pole of the magnet member, thereby minimizing the irradiation. Such arranging may instead be replaced by the step of: arranging at least one magnetic shield to couple with the case and/or drive members and to include a magnetically permeable path member, a magnet member having at least one magnetic pole thereover and one of directly and indirectly coupling with the path member, and a magnetically permeable shunt member, where such a path member may be arranged to absorb magnetic waves of the undesirable waves thereinto, where the magnet member may be arranged to terminate the magnetic waves by the pole while forming a magnetic field therearound, and where the shunt member may be arranged to confine the magnetic field from the magnet member closer thereto, thereby minimizing the irradiation.

More product-by-process claims may be constructed by modifying the foregoing preambles of the apparatus and/or method claims and by appending thereonto such bodies of the apparatus and/or method claims. In addition, such process claims may include one or more of the above features of the apparatus and/or method claims of the present invention.

As used herein, the term "magnet" refers to a material or an article which may spontaneously or actively generate magnetic fields therearound by itself, where a strength of the magnetic fields may be measured by a conventional gaussmeter. Accordingly, a permanent magnet defining any arbitrary shape, size, and/or number of the N and S poles may qualify as the "magnet" within the scope of this invention as far as the permanent magnet may generate the measurable magnetic fields therearound. It is to be understood that the "magnet" may not refer to electromagnets unless otherwise specified.

Similarly, the term "magnetic" refers to a property of a material or article which may be able to spontaneously or actively generate magnetic fields therearound. Therefore, a "magnetic material" or "magnetic article" refers to a permanent magnet or an article with the permanent magnet. In contrary, a "nonmagnetic" refers to a property of a material or article which may not spontaneously or actively generate such magnetic fields. Thus, a "paramagnetic," "diamagnetic," and "ferrimagnetic" material or article generally belongs to such a "nonmagnetic" material. It is to be understood that a ferromagnetic material or article may be or may not be "magnetic" depending upon its magnetic state and that such a "nonmagnetic" ferromagnetic material or article may be converted to be "magnetic" by properly aligning its magnetic domains. It is also to be understood that the term "magnetic" refers to the above meaning when related to an article. In contrary, the term "magnetic" may connote different meaning when used in conjunction with verbs, more particularly, the verb "couple" as follows.

The term "magnetic permeability" refers to a property of a substance of retaining magnetic field lines therein and, accordingly, has a dimension of Telsa meter/ampere or Newton/ampere$_2$. The terms "relative magnetic permeability" and "relative permeability" refer to a ratio of the "magnetic permeability" of a substance of interest to that of air and, therefore, are dimensionless properties. As used herein, the term "permeability" means the dimensionless "relative permeability" unless otherwise specified as the "magnetic permeability" with the above dimension. The term "very or highly permeable" means that the "permeability" is high such as, e.g., at least a few orders of magnitudes higher than that of the air. Ferromagnetic materials may be generally relatively permeable, where their examples may include, but not be limited to, elements such as iron, cobalt, nickel, and gadolinium, and certain alloys including or based upon one or more of such elements. Non-ferromagnetic and paramagnetic materials exhibit the "magnetic permeability" slightly greater than that of air, while non-ferromagnetic, diamagnetic materials have the "magnetic permeability" slightly less than that of air. Accordingly, the "permeabilities" of the ferromagnetic materials are very greater than 1.0, while the "permeabilities" of the paramagnetic and diamagnetic materials are respectively slightly greater than and slightly less than 1.0. As used herein, the term "magnetic susceptibility" refers to a difference between the "permeability" and 1. Therefore, the "magnetic susceptibilities" of the ferromagnetic materials are far greater than 0, while those of the paramagnetic and diamagnetic materials may only be slightly greater and less than 0, respectively. As used herein, a "complex permeability" may be defined to consist of a real part and an imaginary part. In this case, the above "permeability" corresponds to the real part of the "complex permeability" unless otherwise specified as the imaginary part thereof.

The terms "magnetic fields" and "magnetic waves" within the scope of this invention refer to those which are associated with various electromagnetic waves. Therefore, such "magnetic fields" are accompanied by matching electric fields, while such "magnetic waves" are also accompanied by matching electric waves. Only exceptions are the static magnetic fields which are not accompanied by the electric fields, where examples of such static magnetic fields are those generated by the Earth, permanent magnet of the magnet member, and the like. It is appreciated for simplicity of illustration that the "magnetic waves" or "MWs" may collectively include the "magnetic fields" or "MFs" therein and that the "electric waves" or "EWs" may collectively include the "electric fields" or "EFs" therein within the scope of the present invention.

As used herein, the term "terminate" means preventing propagation of the magnetic fields and waves. Therefore, "terminating" the magnetic fields and waves by a magnetic pole means absorbing such magnetic fields and waves into the magnetic pole and then preventing such magnetic fields and waves from propagating away from a permanent magnet and/or electromagnet which may include the magnetic pole.

Within the scope of the present invention, the term "wire" collectively refers to a wire, filament, fiber, rod, strand, and/or any other similar elongated shapes of articles each of which may be straight and/or curved (i.e., curvilinear), and each of which may also be arranged in a loop, a coil, a roll, and the like. The term "strip" collectively refers to a strip, bar, pad, tape, and any other planar articles with large aspect ratios (i.e., ratios of lengths to widths or heights) each of which may be straight and/or curved, each of which may be arranged in a two- or three-dimensional configuration, each of which may also be arranged in a loop, a coil, a roll, and so on. In addition, the term "sheet" collectively refers to a sheet, a slab, a foil, a film, a plate, a layer, and any other planar articles which may be relatively wider than the "strip," each of which may be planar (i.e., two-dimensional) and/or curved (i.e., three-dimensional), each of which may also be arranged in a segment, a roll, and the like. The terms "braid" and "braided article" collectively refer to any elongated article which is braided in such a manner that the "braid" or "braided article" consists of at least two "wires" or "strips" in a cross-section normal to a longitudinal axis of the "braid" or "braided article," where examples of such articles may include, but not be limited to, a thread, a yarn, any other articles made by conventional "braid" techniques, and the like. The term "mesh" also collectively refers to a mesh, a net, a screen, a quilt, a fabric, a garment, any other articles in a networking, woven, and/or interwoven structure. It is to be understood that at least a portion of each of such articles formed according to the foregoing terms in this paragraph may be arranged to be solid, hollow or porous such as, e.g., a foam, a sponge, and so on. It is also to be understood that each of such articles formed according to the foregoing terms of this paragraph may be arranged to include (or define) at least one hole, gap or opening.

Similarly and as used herein, the term "mixture" collectively refers to a liquid, a solution, a sol, a gel, an emulsion, a suspension, a slurry, and/or a powder, each of which may include therein multiple particles, particulates, grains, granules, filings, fragments, and/or pellets each of which may also have shapes of spheres, ellipsoids, cylinders, flakes, "wires," "strips," and the like, and each of which may be in a range of millimeters, microns or nanometers. When appropriate, such a "mixture" may include at least one solvent, at least one chemically, electrically, and/or magnetically inert filler for the purpose of providing mechanical strength and/or integrity thereto, and so on.

Unless otherwise defined in the following specification, all technical and scientific terms used herein have the same meaning as commonly understood by one of ordinary skill in the art to which the present invention belongs. Although the methods or materials equivalent or similar to those described herein can be used in the practice or in the testing of the present invention, the suitable methods and materials are described below. All publications, patent applications, patents, and/or other references mentioned herein are incorporated by reference in their entirety. In case of any conflict, the present specification, including definitions, will control. In addition, the materials, methods, and examples are illustrative only and not intended to be limiting.

Other features and advantages of the present invention will be apparent from the following detailed description, and from the claims.

DETAILED DESCRIPTION OF THE PREFERRED EMBODIMENTS

Figure 1A:
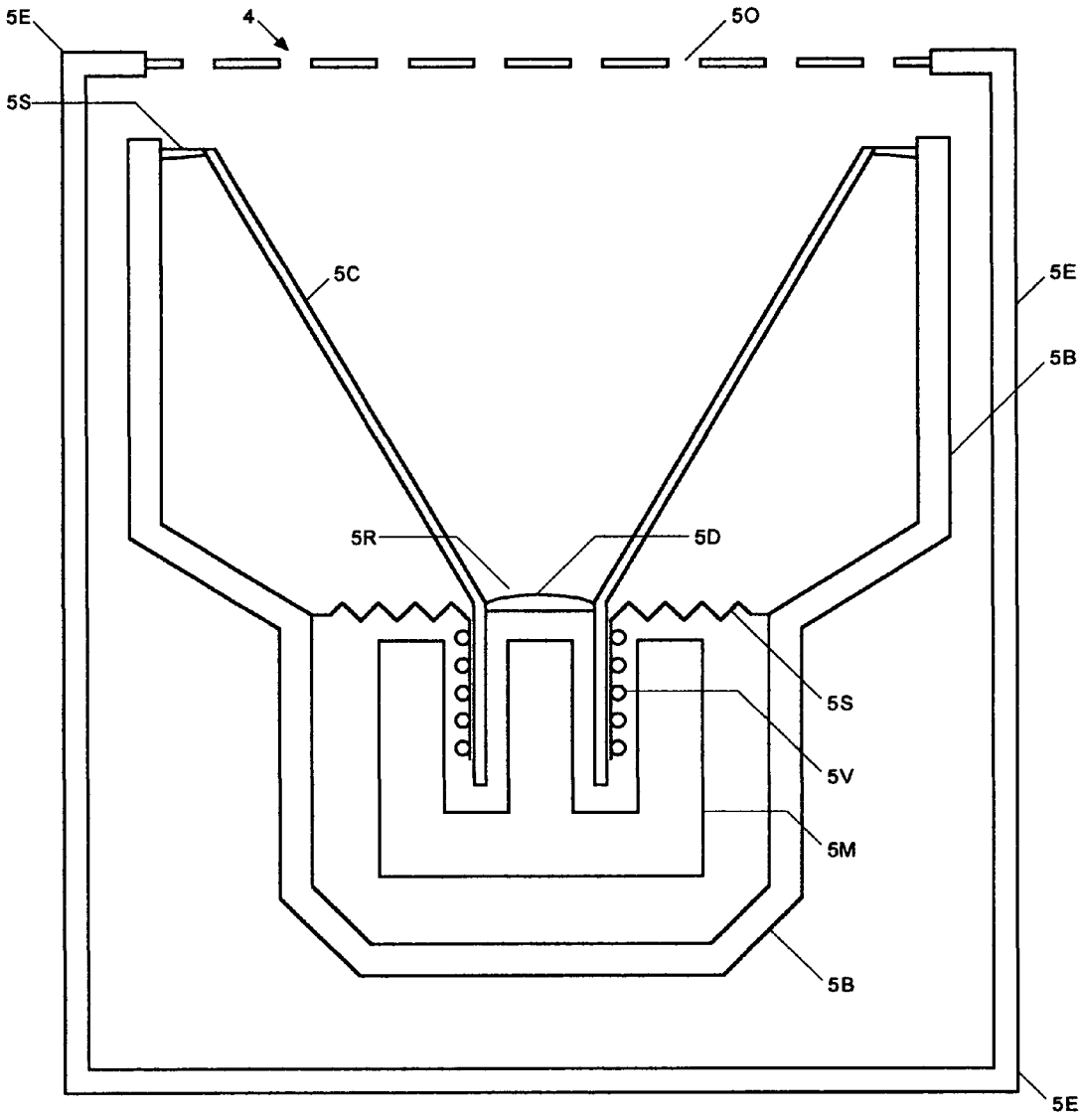
FIG. 1A (Prior Art)
FIG. 1A is a cross-sectional view of a conventional speaker device including a drive member irradiating undesirable electromagnetic waves therefrom.

The present invention relates to electromagnetically-shielded speaker systems for generating acoustic sounds based on electric signals supplied thereto while minimizing irradiation of undesirable electromagnetic waves (to be abbreviated as "EM waves" hereinafter). More particularly, the present invention relates to various speaker systems each of which includes at least one source and at least one counter member, where the source irradiates the undesirable EM waves and where the counter member irradiates counter EM waves capable of canceling at least a portion of the undesirable waves based on their phase characteristics. Such a counter member may be formed in various shapes and receive various electric currents having preset amplitudes and flowing along preset directions, where such electric currents may be identical to or amount to only a portion of the source signals supplied to the wave source. In the alternative, the counter member may receive external currents which may be neither related to nor derived from the signals. The counter member may also be disposed in various locations of the system in various arrangements as far as the counter waves emitted thereby may be able to cancel at least a portion of the undesirable EM waves. The present invention may also relate to various speaker systems each including at least one electric shield and/or magnetic shield capable of shielding and/or terminating electric waves and magnetic waves of the undesirable electromagnetic waves, respectively, where the electric shield may include electrically conductive material, while the magnetic shield may include magnetic permeable material and at least one optional magnet and shuni The present invention also relates to various methods of eliminating or minimizing irradiation of such undesirable EM waves generated by the speaker systems by canceling at least a portion of the undesirable EM waves with the counter EM waves. More particularly, the present invention relates to various methods of generating by the counter members such counter EM waves which define preset amplitudes and phase angles for canceling such a portion of the undesirable waves, various methods of forming such counter members in preset shapes and/or sizes to generate such counter EM waves, various methods of arranging the counter members with respect to the wave sources for generating the counter waves, various methods of providing electric currents or at least a portion of the signals defining preset amplitudes and flowing in a preset direction to the counter members for generating the counter waves, various methods of manipulating the amplitudes and/ or phase angles of such counter waves to cancel a desired portion of the undesirable waves by the counter waves, various methods of manipulating such amplitudes and/or directions of the external currents or signals for canceling the desired portion of the undesirable waves by the counter waves, and the like. The present invention may also relate to various methods of shielding and eliminating electric waves of the undesirable EM waves with at least one electric shield, various methods of rerouting and terminating magnetic waves of the undesirable EM waves by at least one magnetic shield, and various methods of shielding such undesirable EM waves by at least one electromagnetic shield.

The present invention further relates to various processes for providing the speaker systems capable of minimizing irradiation of the undesirable EM waves by their speakers. More particularly, the present invention relates to various processes for making the counter members capable of irradiating the counter waves capable of canceling a desired portion of the undesirable waves based upon their amplitudes and phase angles, various processes for making the counter members receiving external currents or signals in preset directions, various processes for supplying such currents or signals of preset amplitudes and/or directions, various processes for making the counter members incorporated into various locations of the wave sources, various processes for making the counter members for emitting the counter waves aligned with the undesirable waves in preset relations, various processes for making the counter member to be in preset relation to the wave source, and the like. The present invention may also relate to various processes for making the electric and magnetic shields capable of shielding the electric and magnetic waves of the undesirable waves.

The present invention relates to electromagnetically-shielded speaker systems each including at least two speakers which may be incorporated into the same case member or may be provided as separate articles. In addition, the present invention relates to electromagnetically-shielded microphone systems capable of minimizing irradiation of the undesirable EM waves.

The electromagnetically-shielded speaker systems of the present invention may be provided in various embodiments. For example and as described above, such speaker systems may be embodied as earphones or headphones which are to be disposed adjacent to or into the ears of the users. The speaker systems may also be incorporated into portable mobile or cellular phones, handsets of wired phones, and other communication devices such as walkie-talkies, and the like. The speaker systems may also be incorporated into other audio devices such as portable tape players, portable CD players, portable DVD players, portable mp3 players, and the like. Such speaker systems may also be used in conjunction with consoles of various audiovisual devices, e.g., as speakers for TVs, CD players, DVD players, game machines, computers, and other electric or electronic devices designed to output sound signals. Whether such devices are to be used proximate to or at preset distances from the users, the electromagnetically-shielded speaker systems of this invention may effectively reduce such irradiation of the undesirable EM waves to the user.

Such electromagnetically-shielded speaker systems of this invention may also be used in pairs or in greater numbers. Thus, multiple electromagnetically-shielded speaker systems may be encased in a single case member, where each speaker system may be arranged to cancel at least a portion of the undesirable EM waves generated by its wave source, where two or all speaker systems may be arranged to share a common counter member, a common electric and/or magnetic shield, and the like. In the alternative, multiple electromagnetically-shielded speaker systems may be provided as separate articles, where such speaker systems may be disposed in a preset arrangement, where the speaker systems may be disposed in an arbitrary arrangement while manipulating its common counter member or their individual counter members to irradiate the counter EM waves capable of canceling at least a portion of the undesirable waves.

Basic principles of the electromagnetically-shielded speaker systems and counter members of such systems may be modified and applied to microphone systems. For example, such a microphone system may include at least one counter member which may be similar to that of the speaker system and emit counter waves capable of canceling at least a portion of undesirable EM waves irradiated by one or more wave sources of the microphone system. In the alternative, the microphone system may include at least one electric shield or magnetic shield capable of absorbing and eliminating the electric and magnetic waves of such undesirable waves, respectively. In addition, such electromagnetically-shielded microphone system and speaker system may be encased in a single case member and used as an assembly of a receiver and transmitter, where each of the systems may have its own counter member for canceling the portion of the undesirable waves or where a single counter member may be arranged to cancel the portion of a sum of the undesirable waves from both systems.

Various aspects and/or embodiments of various systems, methods, and/or processes of this invention will now be described more particularly with reference to the accompanying drawings and text, where such aspects and/or embodiments thereof only represent different forms. Such systems, methods, and/or processes of this invention, however, may also be embodied in many other different forms and, accordingly, should not be limited to such aspects and/or embodiments which are set forth herein. Rather, various exemplary aspects and/or embodiments described herein are provided so that this disclosure will be thorough and complete, and fully convey the scope of the present invention to one of ordinary skill in the relevant art.

Unless otherwise specified, it is to be understood that various members, units, elements, and parts of various systems of the present invention are not typically drawn to scales and/or proportions for ease of illustration. It is also to be understood that such members, units, elements, and/or parts of various systems of this invention designated by the same numerals may typically represent the same, similar, and/or functionally equivalent members, units, elements, and/or parts thereof, respectively.

FIG. 1A is a cross-sectional view of a conventional speaker device including a drive member irradiating undesirable electromagnetic waves therefrom. In general, the device 4 includes a case or enclosure 5E which has multiple openings 5O on one side (or front). Inside the case 5E is disposed a bracket 5B which is usually made of a metal and coupled to the case 5E by various means. A drive member 5R is disposed inside and movably supported by the bracket 5B, where the drive member 5R consists of a cone or diaphragm 5C, a voice coil 5V, and a speaker magnet 5M. The cone 5C is made of paper, plastic, metal or other light materials and forms a wider end and a narrower end, where the wider end is disposed near the front of the case 5E, and where the narrower end is disposed toward an opposite side (or rear) of the case 5E. The wider end of the cone 5C is attached to the bracket 5B by a suspension or a surround 5S which is a rim of a flexible material movably incorporated between the bracket 5B and cone 5C. Therefore, the suspension 5S allows the cone 5C to move toward and away from the front of the case 5E. The narrower end of the cone 5C is attached to the voice coil 5V which is a wound coil of an electrically conductive wire. The voice coil 5V is typically attached to the basket 5B by a spider 5S which is also a ring of a flexible material. Therefore, the spider 5S holds the voice coil 5V in position but allows the voice coil 5C to move toward and away from the front of such a case 5E. The speaker magnet (or simply "magnet") 5M defines a shape of an annular ring with (or without) a center core, where the voice coil 5V is preferably disposed in a gap defined in the magnet 5M, whereby the voice coil 5V is disposed inside a static magnetic field generated by the magnet 5M. A dust cap 5D is made of any rigid or flexible material and encloses the narrower end of the cone 5C.

In operation, the voice coil 5V is disposed inside the gap formed inside the speaker magnet 5M in its rest position which is generally determined by a weight of the cone 5C and voice coil 5V, elastic properties of the suspension 5S, orientation of the case 5E, and the like. Electric source signals are then supplied to the voice coil 5V, where such signals typically carry information about a voice, music, and the like. As the source signals flow therein, the voice coil 5V generates a dynamic magnetic field of which strengths and directions may depend upon various factors such as, e.g., amplitudes of such signals, directions of such signals, a direction of winding of the coil 5V, and disposition of the coil 5V. By manipulating such factors, the voice coil 5V may be arranged to define the dynamic magnetic field which may repel and attract the static dynamic field of the magnet 5M while moving with the cone 5C back and forth. As a result, the cone 5C compresses air when it moves outward toward the front of the case 5E to its extended position, and rarefies air when it recoils back to its rest position. Thereby, the drive member 5R generates acoustic sounds and transmits such sounds toward an user situated in the front of the case 5E through the openings 5O thereof. Concurrent therewith, the fluctuating or time-varying source signals flowing through the voice coil 5V also generate fluctuating electric fields and magnetic fields, thereby irradiating undesirable electromagnetic waves or EM waves containing 60 Hz (or 50 Hz) components. When the user is situated at a greater distance from the voice coil 5V, such undesirable EM waves are attenuated when they impinge upon the user. However, when the device 4 is provided as an earphone, a headphone, and/or a speaker of a communication device, the undesirable EM waves may impinge upon brain cells of the user with significant amplitudes, thereby causing hazardous results.

Various electromagnetically-shielded (or "EMS") speaker systems of the present invention aim to prevent irradiation of such undesirable or harmful EM waves onto the user regardless of distances between the systems and user.

Figure 1B:
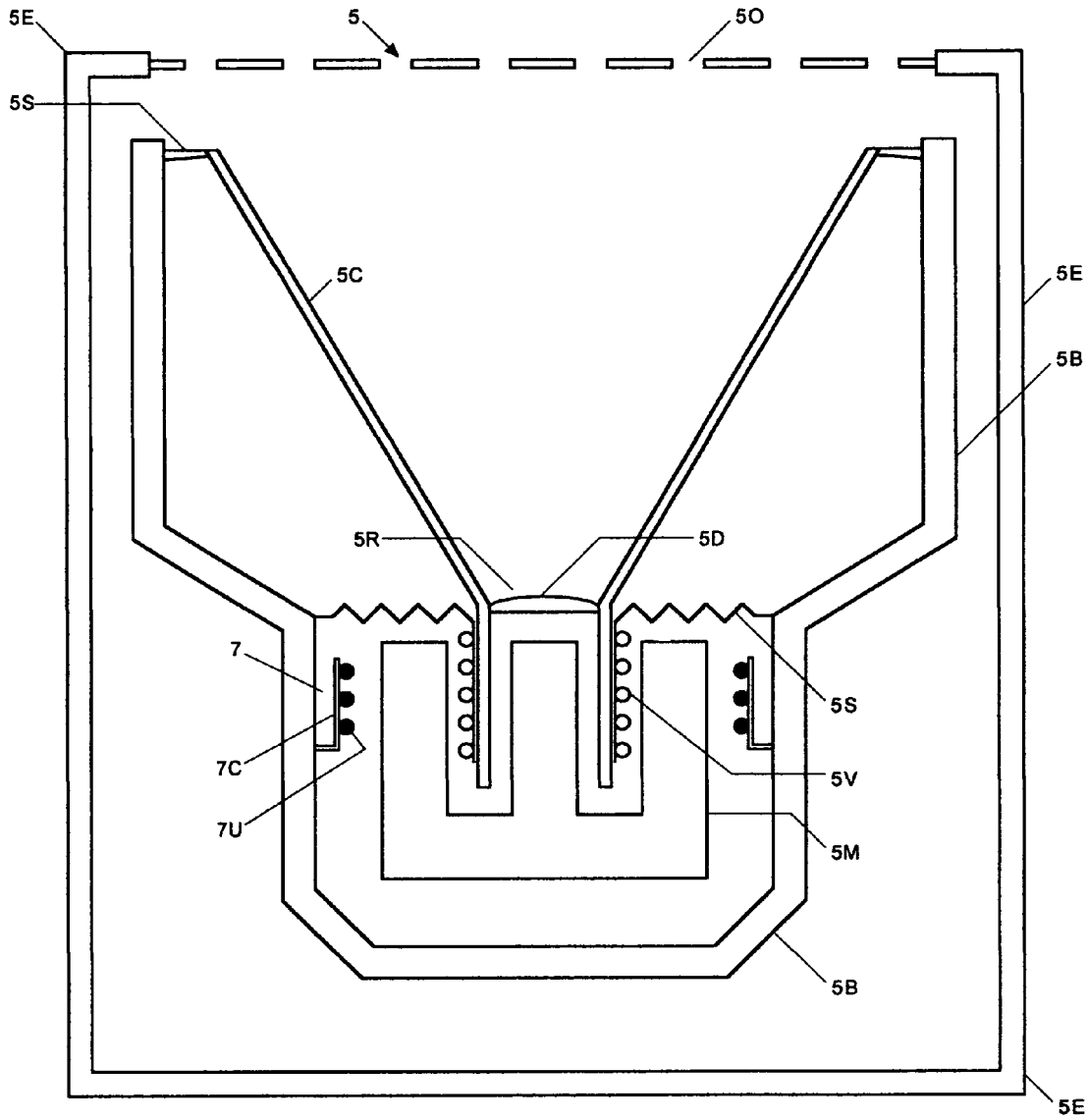
FIG. 1B is a cross-sectional view of an exemplary speaker system which has a drive member for irradiating such undesirable electromagnetic waves and a counter member for generating counter electromagnetic waves and canceling the undesirable waves according to the present invention.

In one aspect of the present invention, an EMS speaker system may be provided by modifying the conventional speaker device of FIG. 1A. FIG. 1B shows a cross-sectional view of an exemplary speaker system including a drive member for irradiating such undesirable electromagnetic waves and also at least one counter member for generating counter electromagnetic waves capable of canceling such undesirable waves according to the present invention. An exemplary EMS speaker system 5 is generally similar to the speaker device 4 of FIG. 1A in that the system 5 includes a case or enclosure 5E which defines multiple openings 5O on its front and that a drive member 5R including a cone 5C, a voice coil 5V, and a speaker magnet 5M is disposed in and supported by a metal bracket 5B which is in turn disposed in and supported by the case 5E. The cone 5C is also made of paper, plastic, metal or other light materials and forms a wider end and a narrower end, where the wider end is disposed near the front of the case 5E, and where the narrower end is disposed toward an opposite side or a rear of the case 5E. The wider end of the cone 5C is attached to the bracket 5B by a suspension or a surround 5S which is a rim of a flexible material movably disposed between the bracket 5B and cone 5C. Therefore, the suspension 5S allows the cone 5C to move toward and away from the front of the case 5E. The narrower end of the cone 5C is attached to the voice coil 5V which is a wound coil of an electrically conductive wire. The voice coil 5V is typically attached to the basket 5B by a spider 5S which is a ring of a flexible material. Accordingly, the spider 5S holds the voice coil 5V in position but allows the voice coil 5C to move back and forth from the case front. The speaker magnet 5M defines a shape of an annular ring with (or without) a center core, where the voice coil 5V is incorporated in a gap defined in the magnet 5M, whereby the voice coil 5V is disposed inside a static magnetic field generated by the magnet 5M. A dust cap 5D is made of any rigid or flexible material and encloses the narrower end of the cone 5C.

In addition to these conventional portions, the EMS speaker system 5 also includes a counter member 7 of a single counter unit 7U and a single coupler 7C. The counter unit 7U is generally made of an electric conductor which is wound into a coil and disposed around the speaker magnet 5M, and the coupler 7C is fixedly coupled around an inner surface or wall of the bracket 5B and receives the counter unit 7U therein. Accordingly, such a counter unit 7U may be disposed inside the case 5E in a preset relation to the drive member 5R.

In operation, the voice coil 5V is disposed inside the gap formed inside the speaker magnet 5M in its rest position which is generally determined by a weight of the cone 5C and voice coil 5V, elastic properties of the suspension 5S, orientation of the case 5E, and the like. The coupler 7C is coupled to the inner surface of the bracket 5B and another coil of the counter unit 7U is incorporated around the coupler 7C. Electric source signals are then supplied to the voice coil 5V, where the signals typically carry information about a voice, music, and the like. As the source signals flow therein, the voice coil 5V generates a dynamic magnetic field of which strengths and directions may depend upon various factors such as, e.g., amplitudes of such signals, directions of such signals, a direction of winding of the coil 5V, and disposition of the coil 5V. By manipulating such factors, the voice coil 5V may define the dynamic magnetic field which may repel and attract the static dynamic field of the magnet 5M while moving with the cone 5C. As a result, the cone 5C compresses air as it moves outward toward the front of the case 5E to its extended position, and then rarefies air as it recoils back to its rest position. Thereby, the drive member 5R generates acoustic sounds and transmits the sounds toward an user. Concurrent therewith, the fluctuating or time-varying source signals flowing through the voice coil 5V generate fluctuating electric fields and magnetic fields, thereby irradiating undesirable electromagnetic waves or EM waves containing 60 Hz (or 50 Hz) components.

After passing through the voice coil 5V, the source signals are supplied to the counter unit 7U so that the counter unit 7U may generate counter electromagnetic waves or counter EM waves. It is appreciated that a winding direction of the counter unit 7U, an orientation of the counter unit 7U, and a direction of the signals flowing in the counter unit 7U are arranged so that the counter EM waves may define phase angles which are not synchronized with and, most preferably, opposite to those of the undesirable EM waves and that the counter EM waves may therefore cancel at least a portion of the undesirable waves. It is also appreciated that a disposition of the counter unit 7U, a number of turns of the coil of the counter unit 7U, and amplitudes of the signals flowing in the counter unit 7U are also arranged so that the counter EM waves may have suitable amplitudes to cancel as much a portion of the undesirable waves at or near the user. Accordingly, such an EMS speaker system may eliminate or at least substantially minimize irradiation of the undesirable EM waves from its drive member to the user.

Configurational and/or operational variations and/or modifications of the speaker systems, their counter members, and other portions exemplified in FIG. 1B also fall within the scope of this invention.

As described above, the counter member may be provided to satisfy a preset relation to the source of the undesirable waves such as the drive member of the system. Such a relation within the scope of this invention collectively refer to various factors such as, e.g., a shape and/or a size of the voice coil, a shape and/or a size of the speaker magnet, a shape and/or a size of the counter member, an orientation of the voice coil, an orientation of the magnet, an orientation of the counter member, an arrangement of the voice coil, an arrangement of the magnet, an arrangement of the counter member, amplitudes and directions of the source signals flowing in the voice coil, amplitudes and directions of external electric currents and/or such source signals flowing in the counter member, and the like.

The counter member of the EMS speaker system of this invention may be provided in various shapes and/or sizes which may be determined by various factors such as, e.g., shapes and sizes of the drive member (including those of the voice coil as well as the speaker magnet), amplitudes and/or directions of the source signals flowing in the voice coil and other electrical portions of the system, an orientation of the drive member (including that of the voice coil as well as magnet), a number of drive members in the system, other electrical wiring of the speaker system, and so on. It is appreciated that a major source of the undesirable EM waves is the voice coil of the drive member but that the waves may also be dispersed through the speaker magnet. In addition, other electrical wiring may also emit the undesirable waves which may have wave characteristics different from those irradiated by the voice coil and speaker magnet, although these waves may also include the 60 Hz (or 50 Hz) waves. Thus, such a counter member may be designed to effectively cancel as much a portion of all of these undesirable waves.

In general, the counter member may define a configuration which conforms to that of the drive member so that the counter EM waves emitted by the counter member may match various propagation characteristics of the undesirable EM waves and effectively cancel the desired portion of the waves. To this end and as exemplified in FIG. 1B, the counter member may be disposed around a periphery of the drive member, preferably in an arrangement conforming or similar to the shape and/or size of such a drive member. In some instances, the counter member may be shaped and sized to conform to only a portion of the drive member when it is impractical to devise a conforming configuration due to space limitation inside the case member or bracket, complicated geometry of the drive member, and so on. In the alternative, the counter member may instead define a symmetric configuration, may define another configuration not exactly conforming to that of the drive member but at least partially symmetric to the drive member. In another alternative, such a counter member may define an asymmetric configuration, may define another configuration at least partially asymmetric to the drive member, and so on. In all of these examples, it is appreciated that the EMS speaker system may include a single or multiple counter members or may include a single or multiple sources of the undesirable waves in its drive member and in other portions thereof and that each of such multiple counter members may be similarly shaped and sized as described in this paragraph. It is appreciated that the foregoing conforming and/or symmetric configuration of the counter member may be generally preferred to emit the counter waves capable of canceling the desired portion of such undesirable waves emitted by a single wave source or a single drive member (which is to be referred to as "local canceling" hereinafter) but that the non-conforming and/or asymmetric configuration of the counter member may be suited to irradiate the counter waves capable of canceling the desired portions of a sum of the undesirable waves emitted by multiple wave sources or multiple drive members of a single speaker system or multiple speaker systems (which is to be referred to as "global canceling" hereinafter). Depending on detailed configurations, however, the conforming or symmetric configuration may be better suited for the global canceling, whereas the non-conforming or asymmetric configuration may be preferred for the local canceling.

In addition to its configurations, the counter member may be disposed in various arrangements with respect to the drive member. For example, the counter member may be arranged to enclose only a portion, to enclose an entire portion of the drive member, to be disposed side by side with respect to the drive member, to be disposed in other non-enclosing patterns, and so on. In another example, the counter member may be disposed in an arrangement symmetric to only a portion or an entire portion of the drive member, in another arrangement asymmetric to only a portion or an entire portion of the drive member, and the like. In all these examples, it is appreciated that the EMS speaker system may include a single or multiple counter members, may have a single or multiple sources of the undesirable waves in its drive member and/or in other portions thereof, and the like, and that each of such multiple counter members may then be similarly arranged as described in this paragraph. It is also appreciated that the above enclosing or symmetric arrangement of the counter member may be generally preferred to emit the counter waves capable of canceling the desired portion of such undesirable waves irradiated by a single wave source or a single drive member (i.e., the "local canceling") but that the non-enclosing or asymmetric arrangement of the counter member may be preferable to irradiate the counter waves capable of canceling the desired portions of the sum of the undesirable waves irradiated by multiple wave sources or multiple drive members of a single speaker system or multiple speaker systems (i.e., the "global canceling"). Depending upon detailed configurations, however, the enclosing or symmetric configuration may be better suited for the global canceling, whereas the non-enclosing or asymmetric configuration may be preferred for the local canceling.

It is to be understood that the counter member may be configured in various shapes and sizes, may be disposed in various arrangements, may include various numbers of counter units therein, and may be provided in any number, as long as such counter EM waves irradiated thereby may cancel the desired portion of the undesirable waves. Other details of the counter members and/or their counter units are to be disclosed below in conjunction with FIGS. 2A through 2X.

While the shape, size, and/or arrangement of such a counter member may dictate propagation characteristics of such counter waves, their phase angles may be decided by a direction of electric currents flowing in the counter member and an orientation of the counter member with respect to the drive member, while their amplitudes may be determined by amplitudes of the currents flowing in the counter member and a distance between the counter member and the user. For example, the counter member may receive the currents of amplitudes less than those of the signals flowing in the voice coil while emitting the counter waves capable of effectively canceling such undesirable waves when the counter member is disposed closer to the user, when the counter member may include more windings than the voice coil, when the counter member may include more layers of coils than the voice coil, and so on. Conversely, the counter member may receive the currents of amplitudes greater than those of the signals flowing in the voice coil while emitting the counter waves capable of effectively canceling the undesirable waves when the counter member is disposed farther away from the user, when the counter member may include less windings than the voice coil, when the counter member may include less layers of coils than the voice coil, and the like.

The counter member may operate on various sources of electric currents. In one example, the source signals may be supplied to the counter member such that the same signals may flow in both of the counter member and voice coil. Such an arrangement may be embodied by electrically connecting the voice coil with the counter member in series, where the source signals may first flow through the counter member and then through the voice coil (or vice versa) and where an optional resistor may be disposed therebetween in order to regulate voltage thereacross. In another example, only a portion of the source signals may be supplied to the counter member, where this arrangement may be embodied by electrically connecting the voice coil and the counter member in parallel, by diverting such a portion of the source signals through the counter member, and the like. Thus, different portions of the signals may flow through the counter member and voice coil simultaneously or sequentially. When desirable, an optional resistor may be disposed along the connection so as to regulate voltage thereacross. The counter member of all of these examples may then generate the counter waves which have temporal characteristics identical or at least substantially similar to those of such undesirable waves and, thus, cancel the desired portion of the undesirable waves. In another example, the counter member may be supplied with external electric currents or voltages which may not be directly obtained or derived from the source signals as well.

Such signals and/or external currents may flow in the counter member in various directions as well, where such directions may be generally determined by configurations and/or orientations of the voice coil and counter member. Therefore, when the voice coil and counter member are wound in the same direction, such signals and/or currents may flow therein along opposite directions. Conversely, when the voice coil and counter member are wound along the opposite directions, the signals and/or currents may flow therein along the same direction.

The counter member may be incorporated into various locations and orientations of such EMS speaker system with respect to the drive member, the user, and the like. First, such dispositions may be characterized based upon distances between the user and the counter member and between the user and the drive member. For example, such a counter member may be disposed from the user at a distance which may be equal or at least substantially similar to a distance between the user and the drive member. Accordingly, when viewed from the user, the counter member and drive member may be disposed flush with each other. In another example, the counter member may be disposed closer to (or farther from) the user than the drive member. In such an example, the amplitudes of the counter waves irradiated by the counter member may be adjusted by manipulating such configurations of the counter member and/or amplitudes of the currents or signals flowing through the counter member for the purpose of equalizing the amplitudes of the counter waves with those of the undesirable waves when measured at the user, rendering such counter waves have greater or less amplitudes than the undesirable waves when measured thereat, and so on. Secondly, such dispositions may be defined in terms of individual portions of the system, where the counter members may be disposed on or over exterior and/or interior surfaces of such portions or may be incorporated into such portions. Thirdly, the counter member may be disposed in various orientations with respect to the user when compared with the drive member. In one example, the counter member may be disposed in an orientation so that the counter waves emitted thereby may align with the undesirable waves for maximizing cancellation of such undesirable waves. It is appreciated that the drive member and its voice coil and magnet may be disposed in various orientation with respect to the case member and that the counter member may also be disposed accordingly. In another example, the counter member may be disposed in another orientation which may align with that of the drive member or its voice coil and magnet. In this example, the counter waves emitted by the counter member may be arranged to not perform the local canceling but to rather perform the global canceling such that the counter waves may cancel the desired portion of the sum of such undesirable waves irradiated by multiple sources. In another example, the counter member may be intentionally misaligned with the drive member or its voice coil and magnet so that the counter waves may cancel only a portion of the undesirable waves. Details of the dispositions and/or orientations of the counter member and/or counter units thereof are provided in conjunction with FIGS. 3A to 3L.

As briefly described above, the counter member may be arranged to selectively cancel only a desired portion of such undesired waves. First, the counter member may be arranged to selectively cancel the desired portion of the undesired waves regardless of their frequency components. That is, the counter waves emitted by the counter member may cancel a preset portion or percentages of the undesirable waves generally across an entire spectrum of such undesirable waves. To this end, the counter member may define a preset configuration, may be disposed at a preset distance, may be supplied with the currents or signals of preset amplitudes, and the like, such that the counter waves may define the amplitudes less than those of the undesirable waves when measured at the user. In the alternative, the counter member may be arranged to emit the counter waves having the amplitudes greater than those of the undesirable waves when measured thereat. Secondly, the counter member may be arranged to selectively cancel only desired frequency components of the undesirable waves. That is, the counter waves emitted by the counter member may cancel the desired portion or as much a portion of specific frequency components of the undesirable waves, while leaving other frequency components of the undesirable waves intact. To this end, such a counter member may be made of or include at least one material which is not present in the drive member, its voice coil, and/or its speaker. Alternatively, the counter and drive members may define compositions which may be at least slightly different from each other. Therefore, the counter waves emitted by the counter member may cancel only a portion or as much a portion of the desired frequency components of the undesirable waves such as, e.g., 60 Hz (or 50 Hz) components, while leaving potentially beneficial various infrared rays intact. When desirable, the counter member may also be arranged to emit such beneficial rays, where further details of such frequency-specific cancellation and/or frequency-specific augmentation have been disclosed in the co-pending Applications.

The counter member may further include at least one insert therearound, where such an insert may be any magnetically hard or soft material. Therefore, when the external currents or signals flow in the counter member, the dynamic magnetic field generated thereby may be augmented by the insert as commonly employed in conventional electromagnets. The insert may define any shapes and sizes, although such an insert may define a configuration conforming to that of the counter member in order to uniformly augment the dynamic magnetic field of the counter member and to generate such counter waves of which amplitudes may be uniformly increased as well. In this context, the insert may have a symmetrical shape when feasible. It is appreciated that the dynamic magnetic field generated by or around the counter member may depend upon the configurations of the counter member and insert. It then follows that such an insert may have another configuration which may not conform to that of the counter member, which may have an asymmetric shape, which may not be symmetric with respect to the counter member, and the like, as long as the configurations of the insert and counter member may be manipulated such that both of the insert and counter member may in unison generate the dynamic magnetic field of a preset configuration and may emit the counter waves with preset characteristics. Accordingly, it is possible to arrange the shape, size, arrangement, and/or orientation of the insert to generate the dynamic magnetic field having the preset shape and to emit such counter waves which may align with or may be misaligned with the undesirable waves.

In another aspect of the present invention, an EMS speaker system may include such counter members defining various configurations and generating the counter waves capable of canceling the desired portion or as much a portion of the undesirable waves irradiated by the drive member of such a system. Such counter members may also be provided in various shapes and/or sizes as described heretofore and as will be further elaborated in FIGS. 2A to 2X. It is to be understood that such an EMS speaker system of the present invention may include a single counter member having a single counter unit, a single counter member with multiple counter units, multiple counter members each of which may include a single counter unit or multiple counter units, and the like. Accordingly, each counter member of FIGS. 2A to 2X may also be deemed as a single counter unit, and multiple counter units of a single counter member may also be deemed as an assembly of multiple counter members. In other words, the counter members and counter units may be interchangeably used within the scope of the present invention, where the counter member may also be used to collectively refer to multiple counter units. It is also appreciated for simplicity of illustration that only the narrower ends of the drive members are included in FIGS. 2A to 2X and that the wider ends of such drive members may be disposed on top of or below the narrower ends, thereby respectively transmitting the sounds upwardly or downwardly in the figures. It is further appreciated that the narrower ends of the drive members are represented by cylindrical shapes, although such ends may be embodied in other shapes as well. Such a counter member may be disposed in various geometric relations to the drive member by itself or may instead be received by various couplers capable of maintaining such geometric relations between the counter and drive members. FIGS. 2A to 2L and FIGS. 2S to 2X show various counter members or their units disposed in such relations by themselves, while FIGS. 2M to 2R exemplify various counter members or their units fixated to various couplers, although the former may also be interpreted to be fixated to the couplers which may be omitted from FIGS. 2A to 2L and FIGS. 2S to 2X for simplicity of illustration.

In one exemplary embodiment of this aspect of the invention, various counter members may be fabricated into coils of electrically conductive wires would in various shapes, sizes, and orientations. FIGS. 2A to 2F show schematic views of exemplary counter members which are wound as coils and disposed around the drive member according to the present invention. In one example of FIG. 2A, an exemplary voice coil 5V is wound around the cone in one direction and an exemplary counter member 7 includes a single counter unit 7U which is similarly shaped as a coil of wire which however defines a greater radius of winding and encloses an entire portion of the voice coil 5V therein. In addition, the counter unit 7U is wound at a pitch which is similar or identical to a pitch of the voice coil 5V but in an opposite direction. Accordingly, when the source signals flow in the voice coil 5V from the top to the bottom and as the external currents or source signals also flow in the counter unit 7U along the same direction, the voice coil 5V irradiates the undesirable waves of a preset phase angle, and the counter unit 7U generates the counter waves of an opposite phase angle, thereby canceling a desired portion or an entire portion of the undesirable waves. It is appreciated that amplitudes of the counter waves may be manipulated by various means. For example, amplitudes of the currents or signals supplied to the counter member and/or a configuration of the counter unit 7 may be manipulated in order to render amplitudes of the counter waves equal to, greater than or less than those of the undesirable waves. In addition, by manipulating the disposition of the counter unit 7, the amplitudes of the counter waves and undesirable waves may be controlled when measured at the user. In another example of FIG. 2B, an exemplary counter unit 7U is similar to that of FIG. 2A, except that the counter unit 7U is wound at a longer pitch than the voice coil 5V. According to the Ampere's law, the number of windings along the counter unit 7U may not alter the amplitudes of such counter waves as long as the amplitudes of the external currents or signals flowing therein remain the same. Thus, the resistance of the counter unit 7U or voltage thereacross may be manipulated to emit the counter waves defining suitable amplitudes. Other characteristics of the counter unit 7U of FIG. 2B are similar or identical to those of the counter unit of FIG. 2A. In another example of FIG. 2C, an exemplary counter unit 7U is similar to that of FIG. 2A, except that the counter unit 7U is wound along the same direction as the voice coil 5V. Thus, the external currents or signals may flow in a direction opposite to another direction in which the signals flow in the voice coil 5V, thereby guaranteeing the counter waves to cancel the desired portion of the undesirable waves. Other characteristics of the counter unit 7U of FIG. 2C are similar or identical to those of the counter units of FIGS. 2A and 2B. In another example of FIG. 2D, an exemplary counter unit 7U is similar to those of FIGS. 2A and 2B, except that the counter unit 7U has a pitch varying in a longitudinal direction. Other characteristics of the counter unit 7U of FIG. 2D are similar or identical to those of the counter units of FIGS. 2A to 2C. In another example of FIG. 2E, an exemplary counter unit 7U is similar to that of FIG. 2A, except that the radius of winding of the counter unit 7U varies along its longitudinal direction. Other characteristics of the counter unit 7U of FIG. 2E may be similar or identical to those of the counter units of FIGS. 2A to 2D. In another example of FIG. 2F, an exemplary counter member 7 includes a pair of counter units 7U1, 7U2 disposed one over the other and enclosing therein different portions of the voice coil 5C, where the first counter unit 7U1 is similar to that of FIG. 2A, the second counter unit 7U2 is similar to that of FIG. 2C, and the like. Other characteristics of the counter units 7U1, 7U2 of FIG. 2F are similar or identical to those of the counter units of FIGS. 2A to 2E. It is to be understood that the counter unit may also be arranged to have a shape, a size, an orientation, and an arrangement which may be a combination of any two or more of the above examples.

In another exemplary embodiment of this aspect of the invention, the counter member and/or its counter unit may be made of and/or include at least one electrically conductive article which may then be fabricated into various shapes, sizes, and/or orientations. In general, the counter unit may define a shape of a wire, a strip, a sheet, a tube, a coil, a mesh, an array of one or more of the above shapes, a combination of one or more of such shapes, and/or a combination of one or more of such shapes. It is to be understood that the counter member may define a symmetric (or an asymmetric) shape, may also be disposed in an arrangement symmetric (or asymmetric) to a preset portion or an entire portion of the voice coil and/or speaker magnet, and so on. The counter member may include multiple counter units, where all of the counter units may have an identical or similar shape, where at least two of the counter units may define different shapes, and the like. In addition, the counter units may be disposed in an arrangement symmetric to each other, in another arrangement symmetric to a preset portion or an entire portion of the voice coil and/or speaker magnet, and the like. FIGS. 2G to 2L are perspective views of exemplary counter members and/or their units enclosing therein at least a portion of the drive member according to the present invention.

In one example, the counter member may define a shape other than the coils of FIGS. 2A to 2F. As shown in FIG. 2G, an exemplary counter member 7 may include a single counter unit 7U forming a single loop disposed around the voice coil 5V. The external currents or signals may then flow in such a counter unit 7U in a direction opposite to another direction of the signals flowing in the voice coil 5V, thereby allowing the counter waves to cancel the desired portion of such undesirable waves. In this example, the amplitudes of the currents or signals supplied to the counter unit 7U may be manipulated to accomplish the canceling of the portion of the undesirable waves. The counter unit 7U may also be disposed in any location along the longitudinal axis of the voice coil 5V such that the amplitudes of the counter waves may then be controlled to achieve such desired canceling of the undesirable waves. Other characteristics of the counter unit 7U of FIG. 2G are similar or identical to those of the counter units of FIGS. 2A to 2F.

In another example, the counter member may form at least one coil disposed around the voice coil and wound in a direction perpendicular to the longitudinal axis of the voice coil. As exemplified in FIG. 2H, an exemplary counter member 7 may include a single counter unit 7U wound around a preset elevation of the voice coil 5V by a preset number of turns. Because the counter unit 7U has multiple layers of turns, such an unit 7U may generate the dynamic magnetic field stronger than that of FIG. 2G and may also emit the counter waves stronger than those of FIG. 2G when other factors being equal. As also exemplified in FIG. 2I, an exemplary counter member 7 may include a pair of counter units 7U1, 7U2 of FIG. 2H disposed one over the other along the longitudinal axis of the voice coil 5C and enclose different portions of the voice coil 5V therein. Other characteristics of the counter units 7U, 7U1, 7U2 of FIGS. 2H and 2I are similar or identical to those of the counter units of FIGS. 2A to 2G.

In another example, the counter member may form a tube of an arbitrary cross-section which may also enclose therein at least a substantial portion of the voice coil. In an exemplary embodiment of FIG. 2J, a counter member 7 may include a single counter unit 7U defining a circular cross-section and enclosing the voice coil 5V in its center in a symmetric arrangement such that the counter waves emitted by the counter unit 7U may cancel the desired portion of the undesirable waves. To this end, the external currents or signals may be supplied to the counter unit 7U in a direction opposite to that of the signals flowing in the voice coil 5V. It is appreciated that such a tube-shaped counter unit 7U may define other cross-sectional shapes, may define openings therethrough, and the like, as long as such counter waves may accomplish the desired canceling. Other characteristics of the counter unit 7U of FIG. 2J are similar or identical to those of the counter units of FIGS. 2A to 21.

In another example, the counter member may define a mesh and enclose at least a substantial portion of the voice coil therein while maintaining a fluid communication therethrough. In an exemplary embodiment of FIG. 2K, a counter member 7 may have a single mesh which may be wrapped around the voice coil 5V in a symmetric arrangement, similar to that of conventional coaxial cables. Thus, the counter waves from the counter unit 7U may cancel the desired portion of the undesirable waves as the external currents or signals may flow therein along a direction opposite to that of the voice coil 5V. Other characteristics of the counter unit 7U of FIG. 2K are similar or identical to those of the counter units of FIGS. 2A to 2J.

In another example, the counter member may consist of multiple conductive articles disposed in various arrangements each of which may preferably allow the articles to irradiate the counter waves capable of canceling such desired portion of the undesirable waves. In an exemplary embodiment of FIG. 2L, multiple wire-shaped counter units 7U may be disposed around a circumference of the voice coil 5V at a preset interval so that the sum of the counter waves irradiated by such counter units 7U may cancel the desired portion of the undesirable waves. It is to be understood that such a counter member 7 may include any desirable number of counter units 7U each of which may define the same or similar shape or at least two of which may define different shapes. In addition, such counter units 7U may be disposed in an arrangement symmetric (or asymmetric) to each other, in an arrangement symmetric (or asymmetric) to the voice coil 5V and/or speaker magnet of the drive member 5, and the like. Other characteristics of the counter unit 7U of FIG. 2L may be similar or identical to those of the counter units of FIGS. 2A to 2K.

In another exemplary embodiment of this aspect of the invention, the counter members may be disposed in various arrangement and/or orientations with respect to the drive member of the system. FIGS. 2M to 2R represent schematic views of exemplary counter members each of which is placed in a preset relation with respect to the drive member according to the present invention. It is appreciated that all of these figures may be best interpreted as top (or bottom) views of various counter members and various cones wrapped by the voice coils. It is also appreciated that such counter members may enclose only portions or entire portions of the voice coils along the longitudinal direction of the cones (i.e., the direction perpendicular to the paper).

In one example, the counter member (or unit) may enclose therein at least a substantial portion of the cone. As exemplified in FIG. 2M, an exemplary counter member 7 may include a single counter unit 7U (or multiple counter units 7U along the longitudinal direction) which may be coupled to a coupler 7C which may define a circular cross-section and enclose the cone 5C near its center in a symmetric arrangement. Therefore, the counter waves irradiated from the counter unit 7U may be automatically aligned with the undesirable waves emitted by the voice coil 5V wrapped around the cone 5C. Other characteristics of the counter unit 7U of FIG. 2M are similar or identical to those of the counter units of FIGS. 2A to 2L. In another example of FIG. 2N, an exemplary counter member 7 is similar to that of FIG. 2M, except that a coupler 7C may define an oval cross-section. Accordingly, the counter unit 7U may enclose the cone 5C near its center in a symmetric arrangement, while facing different portions of the voice coil 5V at different distances. Accordingly, such a counter unit 7U may emit the counter waves with different amplitudes in different directions, although such counter waves may also be arranged to have uniform amplitudes therearound by manipulating the configuration of the counter unit 7U, e.g., by including more conductive articles in those portions disposed farther away from the cone 5C and including less conductive articles in those portions closer to the cone 5C. Alternatively, amplitudes of the external currents or signals supplied to different portions of the counter unit 7U may be controlled to manipulate the counter unit 7U to irradiate the counter waves defining desirable distribution of their amplitudes. In another alternative, the counter unit 7U may also enclose the cone 5C in an off-center location capable of manipulating the distribution pattern of the amplitudes of the counter waves. Other characteristics of the counter unit 7U of FIG. 2N are similar or identical to those of the counter units of FIGS. 2A to 2M. In another example of FIG. 2O, an exemplary counter member 7 is similar to those of FIGS. 2M and 2N, except that a coupler 7C may not have any symmetric cross-section and, thus, the counter unit 7U may be disposed in an asymmetric arrangement. As described above, however, the configuration of the counter unit 7U, arrangement of such an unit 7U, and directions of the currents or signals may be manipulated to generate the counter waves of suitable amplitude distribution patterns. Other characteristics of the counter unit 7U of FIG. 2O are similar or identical to those of the counter units of FIGS. 2A to 2N.

In another example, the counter member (or unit) may be disposed beside the cone while not enclosing a substantial portion of the cone therein. As exemplified in FIG. 2P, a curvilinear coupler 7C as well as a counter unit 7U wrapped therearound may be disposed on one side of the cone 5C in a symmetric arrangement. Because of such an off-center disposition, it may not be feasible to cancel at least a substantial portion of the undesirable waves by the counter waves generated by the counter unit 7U. Accordingly, such a disposition may be employed when it is desirable to cancel only a portion of the undesirable waves in a preset area around the cone 5C. Alternatively, such counter members 7 may be provided in multiple numbers around multiple sources and/or cones 5C so that the sum of the counter waves irradiated by such counter units 7U may cancel the desired portion of the undesirable waves. It is appreciated, however, that the counter unit 7U of FIG. 2P may form a symmetry between its top and bottom portions such that the counter waves may also define similar symmetric properties. As also exemplified in FIG. 2Q, an asymmetric curvilinear coupler 7C may be similarly disposed away from the cone 7C and a counter unit 7U may be wrapped therearound so as to generate the counter waves which may be misaligned with such undesirable waves or, may be manipulated to be aligned with such undesirable waves by any of the above means. Other characteristics of the counter units 7U of FIGS. 2P and 2Q are similar or identical to those of such counter units of FIGS. 2A to 2P.

In another example, the counter member may include multiple counter units disposed around or alongside the cone in various enclosing or non-enclosing arrangements. As exemplified in FIG. 2R, an exemplary counter member 7 may have a pair of identical counter units 7U1, 7U2 each of which may define an oval cross-section. The counter units 7U1, 7U2 may then be disposed in opposite sides of the cone 5C at an equal distance in a symmetric arrangement so that the counter waves generated by such counter units 7U1, 7U2 may also be at least partially aligned with the undesirable waves. Other characteristics of the counter unit 7U of FIG. 2R are similar or identical to those of the counter units of FIGS. 2A to 2Q.

Figure 2A:
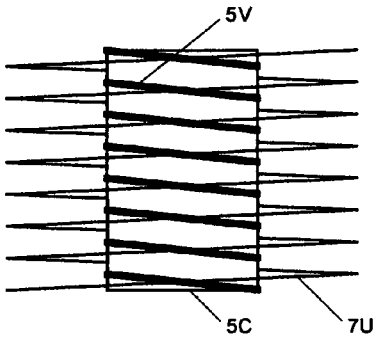
FIGS. 2A to 2F are schematic views of exemplary counter members which are wound as coils and disposed around the drive member according to the present invention.
Figure 2D:
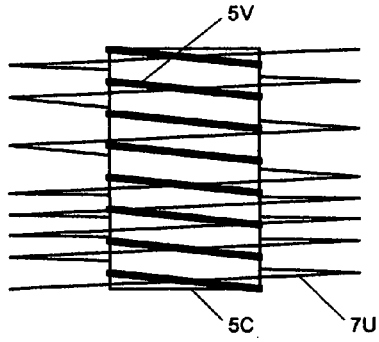
Figure 2B:
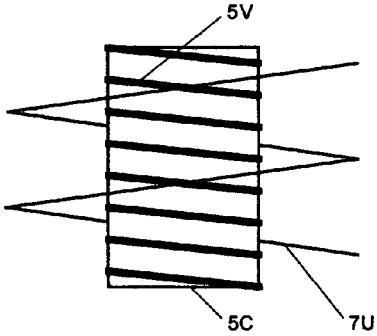
Figure 2E:
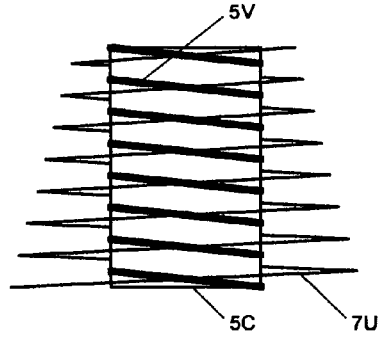
Figure 2C:
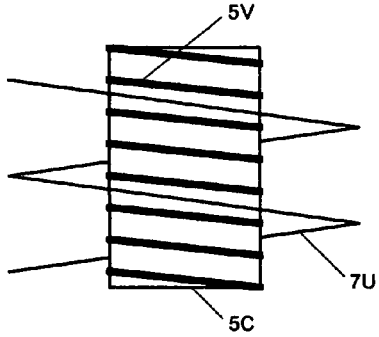
Figure 2F:
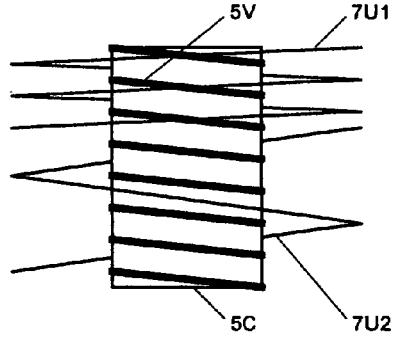
Figure 2G:
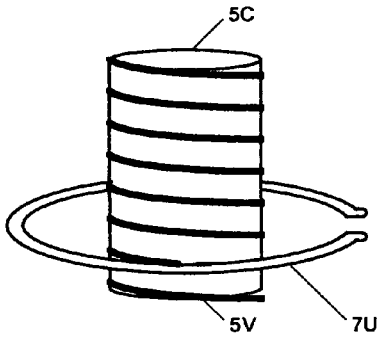
FIGS. 2G to 2L are perspective views of exemplary counter members enclosing therein at least a portion of the drive member according to the present invention.
Figure 2J:
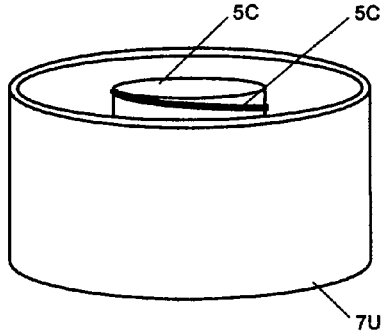
Figure 2H:
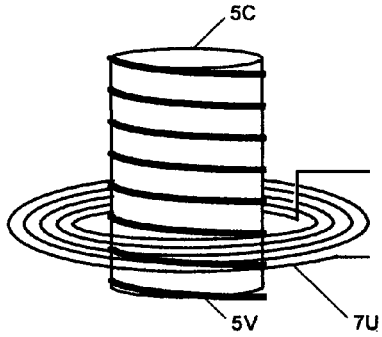
Figure 2K:
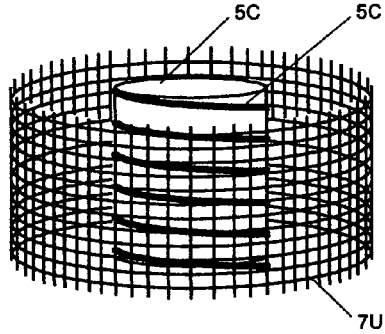
Figure 2I:
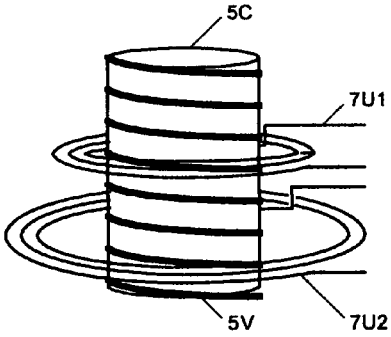
Figure 2L:
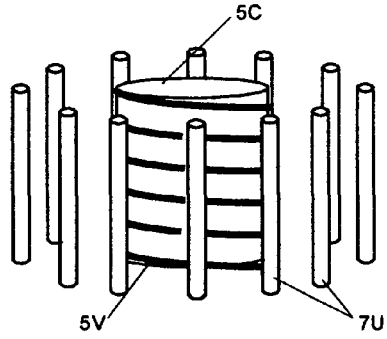
Figure 2M:
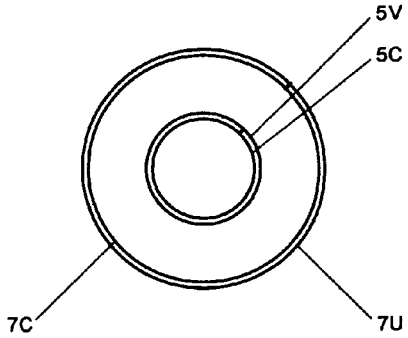
FIGS. 2M to 2R are schematic views of exemplary counter members each of which is placed in a preset relation with respect to the drive member according to the present invention.
Figure 2P:
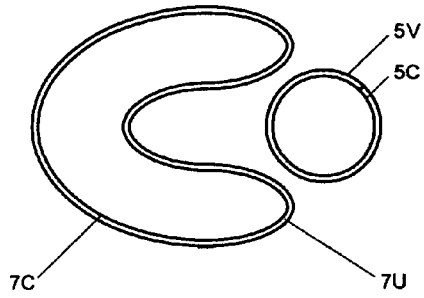
Figure 2N:
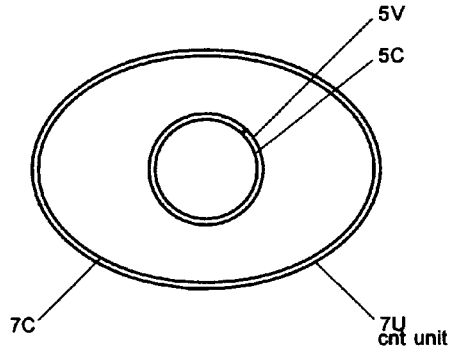
Figure 2Q:
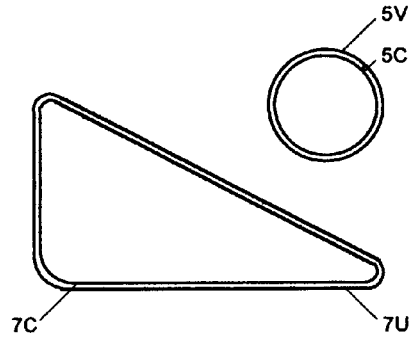
Figure 2O:
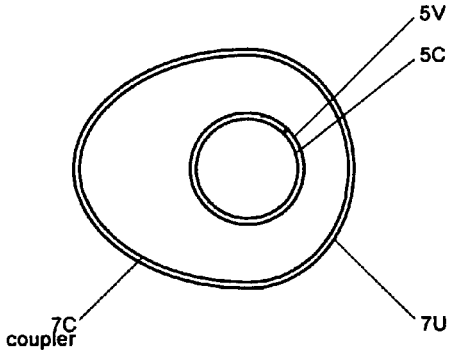
Figure 2R:
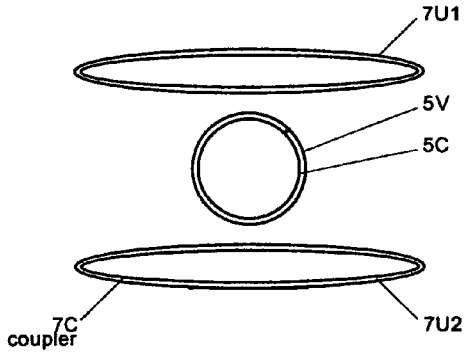

In another exemplary embodiment of this aspect of the invention, the counter members may be incorporated in other shapes, sizes, and orientations with respect to the drive member of the system. FIGS. 2S to 2X represent schematic views of exemplary counter members each of which is disposed in another preset relation to the drive member according to the present invention. It is appreciated that FIGS. 2S to 2V are to be interpreted as top (or bottom) views of various counter members and cones wrapped by such voice coils and that FIGS. 2W and 2X are to be interpreted as side views of various counter members and cones wrapped thereby. It is also appreciated that such counter members may include multiple counter units disposed in various arrangements and orientations, where such counter units may define identical, similar or different shapes and/or sizes and where such counter units may be disposed symmetrically (or asymmetrically) to each other, symmetrically (or asymmetrically) to the cone and/or speaker magnet.

Figure 2S:
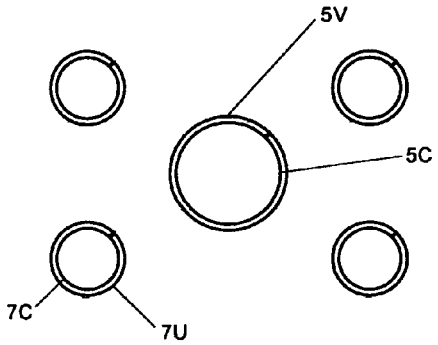
FIGS. 2S to 2X are schematic views of exemplary counter members each of which is disposed in another preset relation with respect to the drive member according to the present invention.

In one example of FIG. 2S, an exemplary counter member 7 may include four counter units 7U defining identical shapes and sizes and coupled to four couplers 7C which may in turn be disposed in four corners of a square or rectangle in a center of which the cone 5C may be disposed. Therefore, the counter waves emitted by such counter units 7U may be manipulated to have desirable symmetric propagation characteristics capable of canceling the desired portion of such undesirable waves. As also exemplified in FIG. 2T, an exemplary counter member 7 may include three counter units 7U having identical shapes and sizes and coupled to three couplers 7C which may be disposed in three vertices of an arbitrary. Therefore, the counter waves emitted by the counter units 7U may be manipulated to define preset propagation characteristics for canceling the desired portion of the undesirable waves. As further exemplified in FIG. 2U, an exemplary counter member 7 may include three counter units 7U disposed on only one side of the cone 5C. Such an arrangement may be utilized in various ways as described in conjunction with those of FIGS. 2P and 2Q. Other characteristics of the counter unit 7U of FIGS. 2S to 2U are similar or identical to those of the counter units of FIGS. 2A to 2R.

Figure 2V:
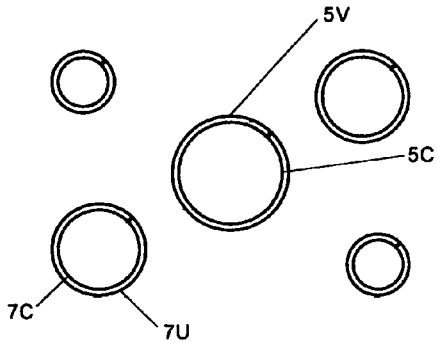
Figure 2T:
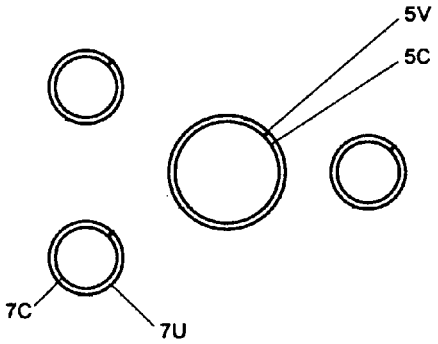
Figure 2W:
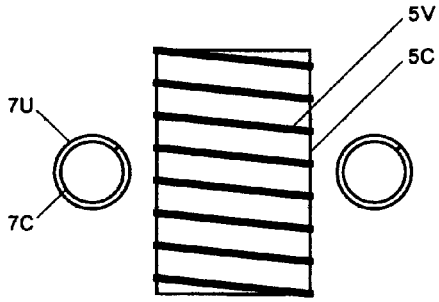
Figure 2U:
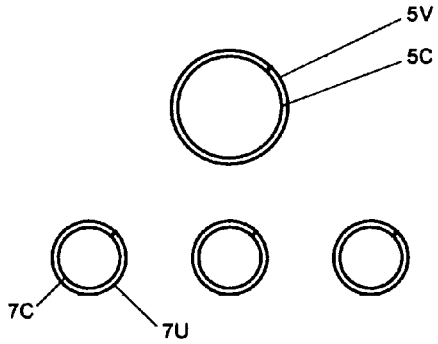
Figure 2X:
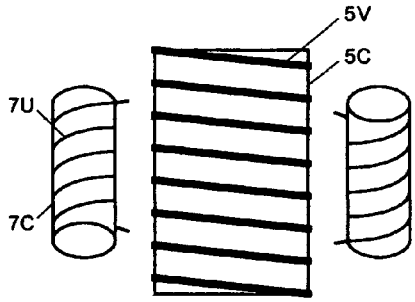

In another example of FIG. 2V, an exemplary counter member 7 may include four counter units 7U having different shapes and sizes and coupled to four couplers 7C which may in turn be disposed in four corners of a square or rectangle in a center of which the cone 5C may be disposed. Thus, the counter waves emitted by the counter units 7U may also be manipulated to have desirable propagation characteristics for canceling the desired portion of the undesirable waves. Further characteristics of the counter unit 7U of FIG. 2V are similar or identical to those of the counter units of FIGS. 2A to 2U.

In another example of FIG. 2W, an exemplary counter member 7 may include a pair of counter units 7U which may wound around a pair of couplers 7C which may be disposed on opposite sides of the cone 5C and which may extend along a direction perpendicular to the longitudinal axis of the cone 5C. In order to align the counter waves irradiated thereby, such counter units 7U may be arranged to define various configurations and/or may be supplied with such external currents or source signals in various directions as well as described heretofore and hereinafter. In another example of FIG. 2X, an exemplary counter member 7 may have another pair of counter units 7U which may be wound around a pair of couplers which may be disposed on opposite sides of the cone 5C at angles which may not 900. Similar to those of FIG. 2W, such counter units may also be arranged to emit the counter waves for canceling the desired portion of the undesirable waves, e.g., by manipulating their configurations and/or dispositions, controlling the amplitudes and/or directions of the external currents or signals, and the like. Other characteristics of the counter unit 7U of FIGS. 2W and 2X may be similar or identical to those of the counter units of FIGS. 2A to 2V.

Configurational and/or operational variations and/or modifications of the counter members and units exemplified in FIGS. 2A through 2X also fall within the scope of this invention.

As described above, such counter members and counter units may be used interchangeably within the scope of the present invention. Accordingly, all of the foregoing variations and modifications described in conjunction with FIG. 1B may be applied to each counter unit and/or to assemblies of the counter units of FIGS. 2A to 2X unless otherwise specified.

As described above, the counter unit may be arranged to enclose therein at least a portion of the drive member or, in the alternative, to be disposed alongside the drive member without enclosing any portion of the drive member. When the counter member may include a single counter unit, such an unit may enclose therein such a portion of the drive member or may be disposed side by side with the drive member. When the counter member may include multiple counter units, such units may then be disposed around and enclose therewithin such a portion of the drive member or, in the alternative, may be disposed alongside the drive member in a preset pattern.

Similar to the counter member, a single counter unit may be disposed in a preset relation to the drive member and generate the counter waves for canceling the desired portion of such undesirable waves. Alternatively, the single counter unit may be supplied with the external currents or signals for generating the counter waves capable of canceling such a portion of the undesirable waves. When the counter member includes multiple counter units, at least two or all of such units may be disposed in a preset relation to a single or multiple wave sources of the drive member for canceling the desired portion of the undesirable waves by local or global canceling. In the alternative, at least two or all of the counter units may then be supplied with the external currents or source signals with the same or similar amplitudes and/or flowing in the same or similar directions therefor. In another alternative and depending upon detailed configurations, arrangements, and/or orientations thereof, at least two or all of such counter units may be supplied with the external currents or source signals defining different amplitudes and/or flowing in different directions therefor.

In addition and as exemplified in some of the above figures, the counter member may include a single symmetric counter unit or may include a single symmetric or asymmetric counter unit disposed around or alongside the drive member in a symmetric arrangement. Alternatively, the counter member may include a single asymmetric unit or may instead include a single symmetric or asymmetric counter unit disposed around or alongside the drive member in an asymmetric arrangement. When the counter member may have multiple counter units, such units may be symmetric or asymmetric or, alternatively, the counter units may be disposed around or alongside the drive member in a symmetric arrangement. The counter member may instead include multiple asymmetric units or, in the alternative, may include multiple symmetric or asymmetric counter units disposed around or alongside the drive member in an asymmetric arrangement.

Similar to the case of multiple counter members as described above, multiple counter units of a single counter member may have an identical configuration or similar configurations, may be disposed in a symmetric or asymmetric arrangement, and the like. In particular, such counter units may have the same shape such as, e.g., wires, strips, sheets, tubes, coils, meshes, and so on. At least one of the counter units may define an assembly, a combination, and/or mixture of one or more of such shapes. Such counter units may further be disposed at the same distance from the user and/or drive member or at least one of such counter units may be disposed closer to or farther away from the user and/or drive member. In addition, each of such counter units may generate the counter waves defining the same or similar amplitudes and/or propagation directions or, alternatively, at least one of such counter units may generate the counter waves defining stronger or weaker amplitudes than the rest thereof. As described above, each counter unit may be disposed around one of multiple wave sources of the drive member and perform the local canceling. In the alternative, at least two of the counter units may be arranged to irradiate the counter waves the sum of which may be capable of canceling the desired portion of the undesirable waves and perform the global canceling.

As described in conjunction with FIGS. 1B and 2A to 2X, various counter members and units of the present invention may define various configurations, may be disposed in various arrangements or orientations, may be supplied with the external currents or at least portions of the signals with various amplitudes and/or directions, may be disposed in various distances from the user and wave sources of the drive member, and the like. The principal requirement of all of the above criteria, however, is to ensure that the counter waves irradiated by a single or multiple counter members and/or units may be capable of canceling the desired portion of the undesirable waves. Therefore, the counter members and units are to be preferably constructed according to the above criteria while satisfying the above requirement. In other words, such counter members and counter units may be constructed in various embodiments as long as such requirement is met.

As described in detail in the co-pending Applications and briefly described above, it is widely believed that various EM waves in the range of infrared rays, more particularly, far-infrared rays are beneficial to humans. Therefore, the EMS speaker system may be tailored to selectively irradiate such beneficial IR rays, e.g., through selectively canceling the low-frequency portions of such undesirable waves by the counter members or units, by emitting the IR rays by the counter members or units while performing the selective or overall cancellation of the undesirable waves, and the like.

Other configurational and/or operational characteristics of the counter units may be identical or similar to those of the counter members as described above. In addition, other configurational and/or operational characteristics of the counter members and units may be similar or identical to those of the co-pending Applications.

In another aspect of the present invention, such counter members and/or counter units may be incorporated into various portions of the EMS speaker system of the present invention. FIGS. 3A to 3L are cross-sectional views of the exemplary speaker system of FIG. 1B incorporating various counter members and units in various locations thereof according to the present invention. It is appreciated in these figures that various counter members and/or units are depicted by multiple dots, that such dots may denote cross-sections of coils, but that such dots may also describe other shapes such as, e.g., wires, strips, tubes, sheets, meshes, arrays thereof, combinations thereof, mixtures thereof, and the like. It is also appreciated that each figure only include a single quadrant of an entire cross-section of the EMS speaker and that such dots may depict a specific disposition of the counter members or units only in that location or may describe a symmetric disposition of the counter members or units about an axis of symmetry which may coincide with a center longitudinal axis of the system, with an off-center longitudinal axis thereof, with an axis perpendicular to such longitudinal axes, and the like.

Figure 3A:
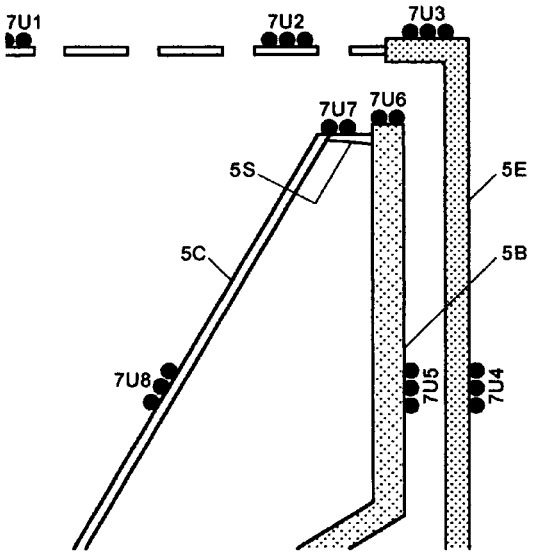
FIGS. 3A to 3L are cross-sectional views of the exemplary speaker system of FIG. 1B which incorporates the counter member in various locations thereof according to the present invention.

In one exemplary embodiment of this aspect of the invention and as exemplified in FIG. 3A, an exemplary counter unit (or member) may be disposed in various locations of an upper quadrant of the cross-section of the EMS system. For example, a counter unit may be disposed on an exterior of the case member 5E and in a top center portion (7U1), in a top middle portion (7U2), in a top edge portion (7U3), on a side (7U4), and the like. A counter unit may be disposed on an exterior of the bracket 5B and on a side (7U5) or on a top edge (7U6), may be disposed on top of the suspension 5N (7U7) or on top of the cone 5C (7U8).

Figure 3C:
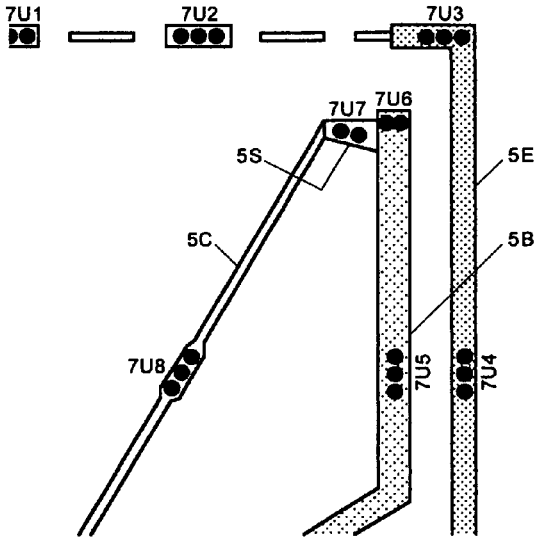
Figure 3B:
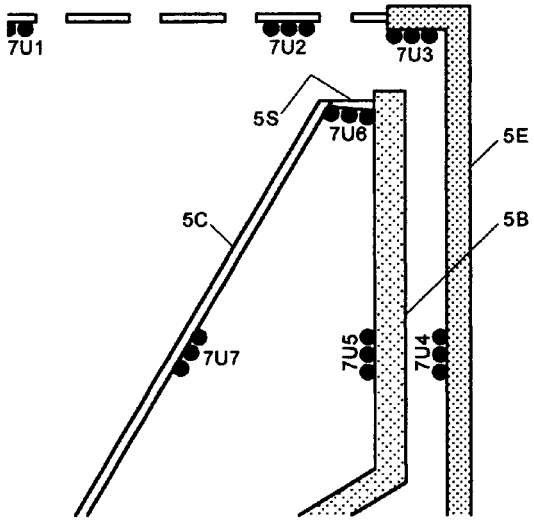

In another exemplary embodiment of this aspect of the invention and as exemplified in FIG. 3B, an exemplary counter unit (or member) may be disposed in various locations of the upper quadrant of the cross-section of the EMS system. For example, a counter unit may be incorporated on an interior of the case member 5E and in a top center portion (7U1), in its top middle portion (7U2), in its top edge portion (7U3) or on a side (7U4). A counter unit may be disposed on an interior of the bracket 5B and on a side (7U5), may be disposed below the suspension 5N (7U6) or below the cone 5C (7U7).

In another exemplary embodiment of this aspect of the invention and as exemplified in FIG. 3C, an exemplary counter unit (or member) may be embedded in various locations of the upper quadrant of the cross-section of the EMS system. For example, a counter unit may be embedded into the case member 5E and in a top center portion (7U1), in a top middle portion (7U2), in a top edge portion (7U3) or on a side (7U4). A counter unit may be embedded into the bracket 5B and on a side (7U5) or on its top (7U6), may be embedded into the suspension 5N (7U7) or into the cone 5C (7U8).

Figure 3D:
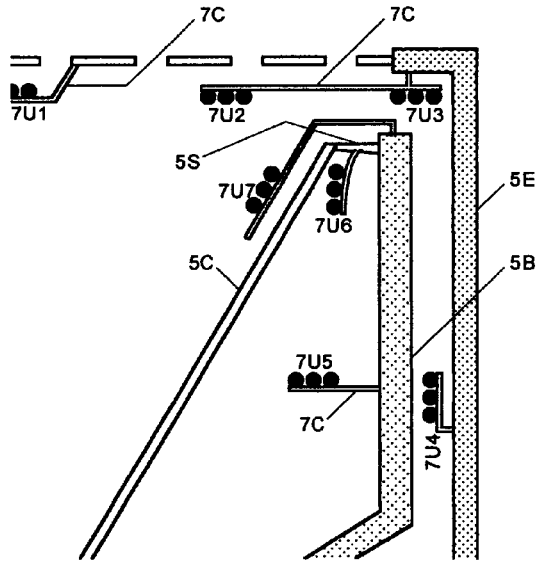

In another exemplary embodiment of this aspect of the invention and as exemplified in FIG. 3D, an exemplary counter unit (or member) may be disposed in various locations of the upper quadrant of the cross-section of the EMS system by various couplers releasably or fixedly coupling with various portions of such EMS systems. For example, a coupler 7C may be releasably or fixedly coupled to the case member 5E and receive thereonto a counter unit which may then be disposed on an interior (or exterior) of the case member 5E and in a top center portion (7U1), in a top middle portion (7U2), in a top edge portion (7U3) or on a side (7U4). A coupler 7C may similarly couple with the bracket 5B and receive thereonto a counter unit which may be disposed on an interior (or exterior) of the bracket 5B and on a side (7U5) or on a top edge (7U6). A coupler 7C may be similarly coupled to the suspension 5N and receive thereonto another counter unit which may then be disposed on an interior (or exterior) thereof (7U7).

Figure 3E:
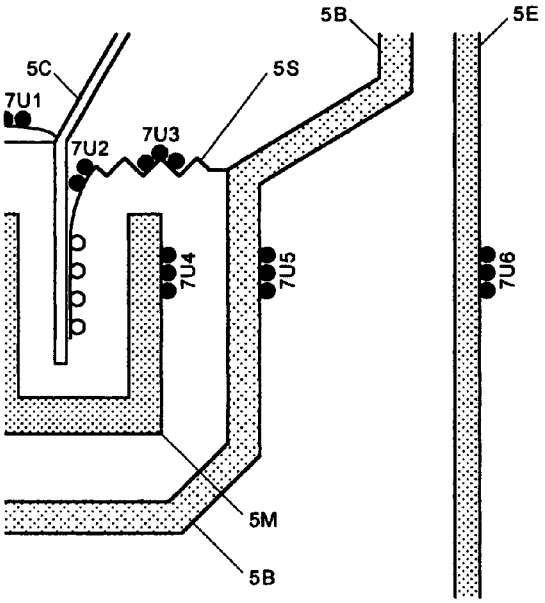

In another exemplary embodiment of this aspect of the invention and as exemplified in FIG. 3E, an exemplary counter unit (or member) may be disposed in various locations of a middle quadrant of the cross-section of the EMS system. For example, a counter unit may be disposed on an exterior of the dust cap 5D (7U1), on an exterior of the spider 5S and near the cone 5C (7U2) or near the bracket 5B (7U3), on an exterior and on a side of the magnet 7M (7U4), bracket 7B (7U5) or case member 5E (7U6), and the like.

Figure 3G:
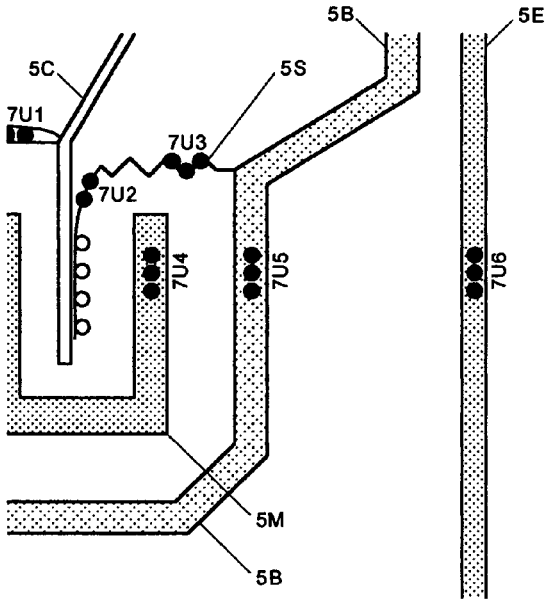
Figure 3F:
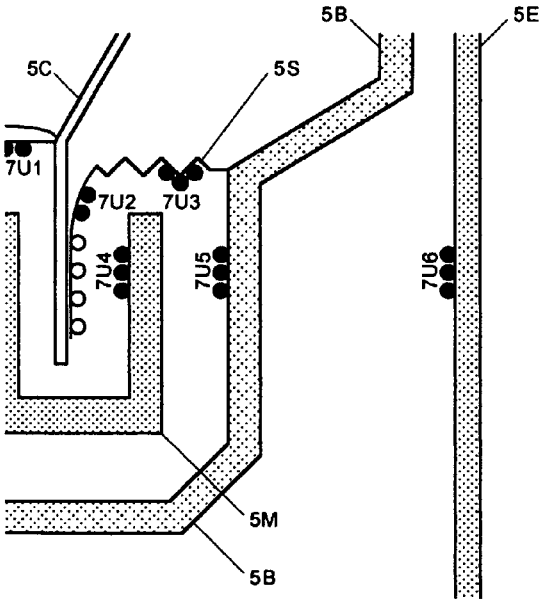

In another exemplary embodiment of this aspect of the invention and as exemplified in FIG. 3F, an exemplary counter unit (or member) may be disposed in various locations of the middle quadrant of the cross-section of the EMS system. For example, a counter unit may be disposed on an interior of the dust cap 5D (7U1), on an interior of the spider 5S and near the cone 5C (7U2) or near the bracket 5B (7U3), and/or on an interior and on a side of the magnet 7M (7U4), bracket (7U5) or case member 5E (7U6).

In another exemplary embodiment of this aspect of the invention and as exemplified in FIG. 3G, an exemplary counter unit (or member) may be embedded in various locations of the middle quadrant of the cross-section of the EMS system. For example, a counter unit may be embedded into the dust cap 5D (7U1), embedded into the spider 5S and near the cone 5C (7U2) or near the bracket 5B (7U3), embedded into the magnet 5M (7U4), bracket 5B (7U5) or case member 5E (7U6), and the like.

Figure 3H:
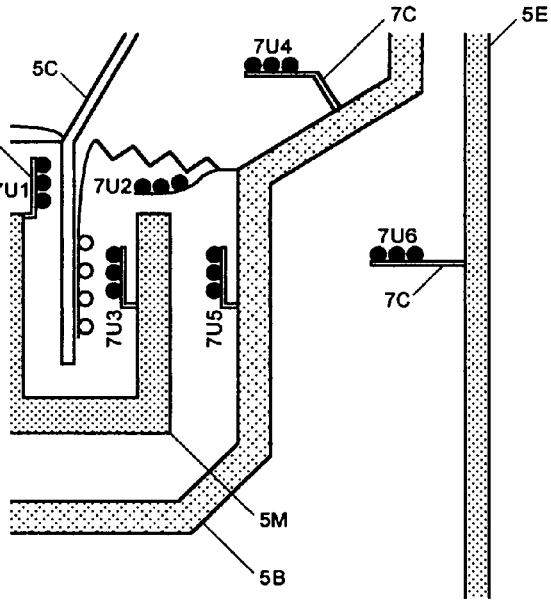

In another exemplary embodiment of this aspect of the invention and as exemplified in FIG. 3H, an exemplary counter unit (or member) may be disposed in various locations of the middle quadrant of the cross-section of the EMS system by various couplers releasably or fixedly coupling with various portions of such EMS systems. For example, a coupler 7C may be releasably or fixedly coupled to the dust cap 5D and receive thereon a counter unit which may be disposed on an interior (or exterior) of the cone 5C. A coupler 7C may similarly couple with the spider 5S or magnet 5M and receive thereon a counter unit which may be disposed respectively on an interior (or exterior) of the spider 5S (7U2) or magnet 5M (7U3). A coupler 7C may similarly couple with the bracket 5B and receive thereonto a counter unit which may be disposed on an interior (or exterior) of the bracket 5B and above the spider 5S (7U4) or below the spider 5S (7U5). A coupler 7C may be similarly coupled to the case member 5E and receive thereonto a counter unit which may be disposed on an interior (or exterior) thereof (7U6).

Figure 3I:
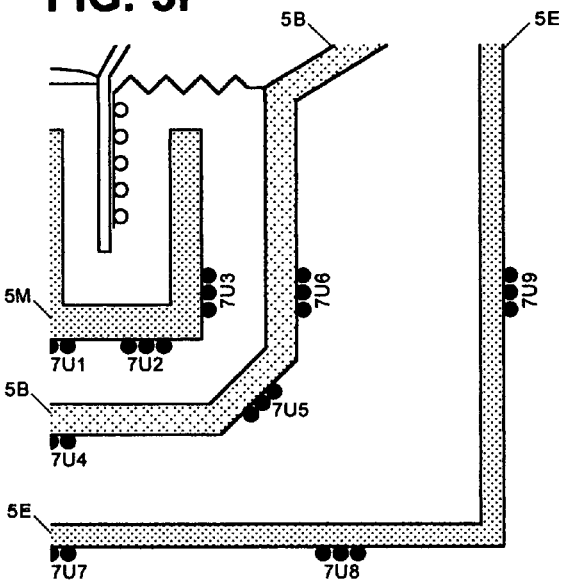

In another exemplary embodiment of this aspect of the invention and as exemplified in FIG. 3I, an exemplary counter unit (or member) may be disposed in various locations of a lower quadrant of the cross-section of the EMS system. For example, a counter unit may be disposed on an exterior of the magnet 5M and in a bottom center portion (7U1), in a bottom middle portion (7U2), in a bottom edge portion (7U3), and the like. A counter unit may be disposed on an exterior of the bracket 5B and in a bottom center portion (7U4), on a bottom edge (7U5) or on a side (7U6) or, in the alternative, may be disposed on an exterior of the case member 5E and also in a bottom center portion (7U7), in a bottom middle portion (7U8) or on a side (7U9).

Figure 3K:
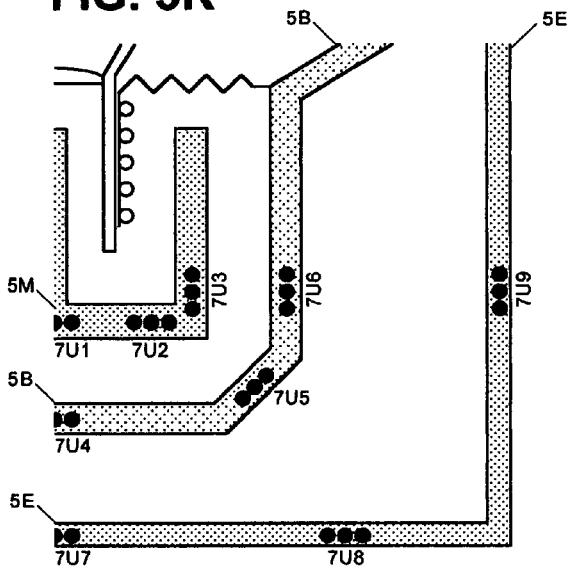
Figure 3J:
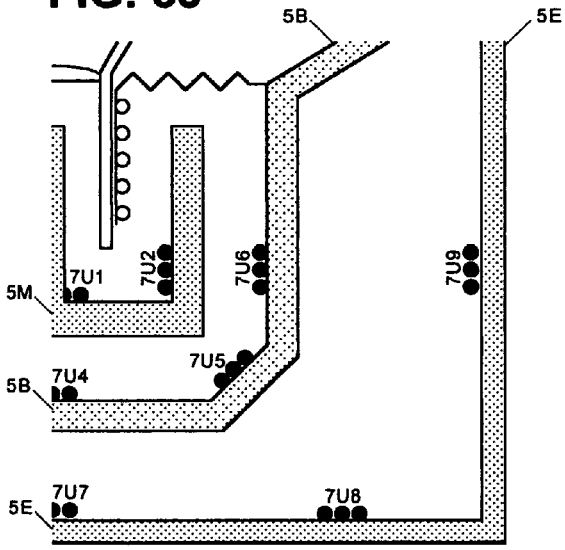
Figure 3L:
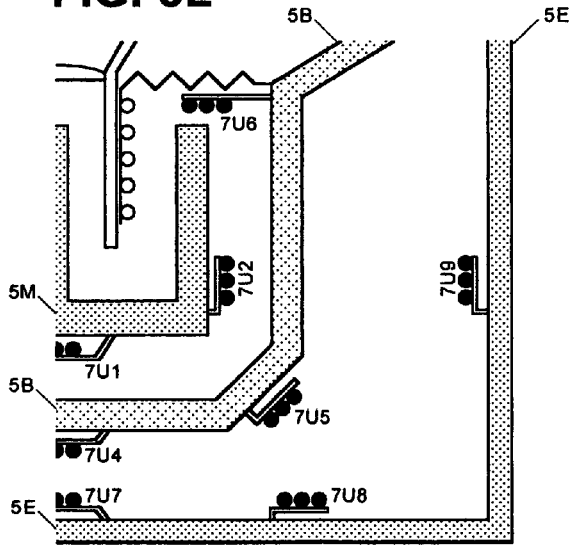

In another exemplary embodiment of this aspect of the invention and as exemplified in FIG. 3J, an exemplary counter unit (or member) may be disposed in various locations of a lower quadrant of the cross-section of the EMS system. For example, a counter unit may be disposed on an interior of the magnet 5M and in an inner center portion (7U1) or in an inner middle portion (7U2). A counter unit may be placed on an interior of the bracket 5B and in an inner center portion (7U4), on an inner edge (7U5) or on an inner side (7U6) or, alternatively, may be disposed on an interior of the case member 5E and in an inner center portion (7U7), in an inner middle portion (7U8) or on an inner side (7U9).

In another exemplary embodiment of this aspect of the invention and as exemplified in FIG. 3K, an exemplary counter unit (or member) may be embedded in various locations of the lower quadrant of the cross-section of the EMS system. For example, such a counter unit may be embedded into the magnet 5M and in a bottom center portion (7U1), in a bottom middle portion (7U2) or on a bottom side (7U4). A counter unit may be embedded into the bracket 5B and in a bottom center portion (7U4), in a bottom middle portion (7U5) or on a bottom side (7U6), may be embedded into the case member 5E and in a bottom center portion (7U7), in a bottom middle portion (7U8) or on a bottom side (7U9), and so on In another exemplary embodiment of this aspect of the invention and as exemplified in FIG. 3L, an exemplary counter unit (or member) may be disposed in various locations of the lower quadrant of the cross-section of the EMS system by various couplers releasably or fixedly coupling with various portions of such EMS systems. For example, a coupler 7C may be releasably or fixedly coupled to the magnet 5M and receive thereonto a counter unit which may be disposed on an interior (or exterior) of the magnet 5M and in a bottom center portion (7U1) or on a side (7U2). A coupler 7C may also couple with the bracket 5B and then receive thereon a counter unit which may be disposed on an interior (or exterior) of the bracket 5B and in a bottom center portion (7U4), along a bottom edge (7U5) or on a top side (7U6). Such a coupler 7C may be similarly coupled to the case member 5E and receive thereonto another counter unit which may be disposed on an interior (or exterior) of the case member 5E and in a bottom center portion (7U7), in a bottom middle portion (7U8) or on a side (7U9).

Configurational and/or operational variations and/or modifications of the counter members and units exemplified in FIGS. 3A through 3L also fall within the scope of this invention.

As described above, multiple dots of such figures may represent various counter members or counter units each of which may define one or more of the above shapes such as, e.g., wires, strips, tubes, sheets, coils, meshes, arrays thereof, combinations thereof, mixtures thereof, and the like. It is also appreciated that each set of multiple dots of such figures may represent a single counter member or unit, that each set of multiple dots thereof may represent multiple counter members or units each of which may define the identical or similar shape or at least two of which may define different shapes, that such counter members or units may be disposed in the same, similar or different arrangements or orientations, that such counter members or units may be supplied with the external currents or signals having the same, similar or different amplitudes and flowing therethrough along the identical, similar or different directions.

In addition, such a counter member or unit denoted by each set of such dots may be disposed in the specific location denoted by the dots such that, e.g., the counter unit 7U2 of FIG. 3A may denote the conductive article having a finite size and disposed on the specific area of the exterior of the case member. Alternatively, the counter member or unit denoted by each set of such dots may instead be disposed in more than one quadrant of the cross-section of the system in a symmetric or asymmetric arrangement while revolving around a preset portion of the system or its drive member about a preset axis of revolution. For example, the counter unit 7U2 of FIG. 3A may describe a coil of such an article which may symmetrically or asymmetrically wind the top exterior of the case member around the axis of revolution which also corresponds the longitudinal axis of such a system. Thus, such an unit 7U2 may encompass the top right and top left quadrants. Alternatively, such a counter unit 7U2 of FIG. 3A may instead be viewed as another coil of such an article which may symmetrically or asymmetrically wind the right side of the system around the axis of revolution which corresponds to a transverse or lateral axis of the system which in turn intersects the longitudinal axis at angles not equal to 0° or 180°.

Moreover, the counter member or unit represented by each set of the dots may extend or wind in a direction which may or may not coincide with a direction in which such dots are disposed in such figures. For example, the counter unit 7U2 of FIG. 3A may correspond to any of the coils of FIGS. 2A to 2F which are wound from top to bottom or vice versa and, therefore, extend in a direction opposite to a direction of such dots are positioned in the figure. Alternatively, such an unit 7U2 of FIG. 3A may correspond to the coil of FIG. 2H which may be wound from the center portion to the periphery of the top portion of the case member or vice versa and, therefore, extends in the same direction as the dots are positioned in the figure. In another alternative, the counter unit 7U2 of FIG. 3A may correspond to the array of multiple loops of FIG. 2G which may be stacked from top to bottom (or vice versa) or from the center portion to the periphery of the top portion of the case member (or vice versa).

As described hereinabove, the counter members or counter units may be disposed by various means. In one example, such counter members or units may be disposed in preset portions of such a system by being disposed onto various couplers which may be releasably or fixedly coupled to preset portions of the system. In another example, such counter members or units may be directly coupled to the preset portions of the system such as, e.g., on the exterior of, on the interior of or inside the case member, bracket, suspension, cone, spider, magnet, and the like. In another example, such counter members or units may be disposed freely in a gap space formed between various portions of such a system without being aided by the couplers. As long as the counter members or units may emit such counter waves capable of canceling the desired portion of the undesirable waves, detailed coupling means for the counter members or units may not be material within the scope of this invention.

In another aspect of the present invention, an EMS speaker system may include at least one of at least one electric shield and at least one magnetic shield. In one example, the electric shield (to be referred to as the "ES" hereinafter) and/or magnetic shield (to be referred to as the "MS" hereinafter) may be incorporated into, on, over or below various portions of the system. In another example, such an ES and/or MS may be incorporated as above and also used in conjunction with the above counter member or unit. In general, the ES may be made of and/or include at least one electrically conductive material such that electric waves of the undesirable waves may be absorbed thereinto and rerouted therealong. When desirable, the ES may also be grounded so that the absorbed and rerouted electric waves may be eliminated therefrom. The MS may be made of and/or include at least one magnetically permeable path member so that magnetic waves of the undesirable waves may be absorbed thereinto and rerouted therealong. When desirable, such an MS may include a magnet member which may be magnetically coupled to the path member and terminate the absorbed and rerouted magnetic waves in one of magnetic poles of the magnet member. The MS may further include a shunt member which may be also magnetically permeable and shield its magnet member, thereby confining a magnetic field from the magnet member closer thereto. Further details of such ES and MS have been provided in the co-pending Applications, where such details may be modified so that various heating elements of the co-pending Applications may be replaced by the counter members and/or units of this invention and such ES and/or MS may be incorporated into the counter members and/or units in this invention as such ES and/or MS have been incorporated into various heating elements of the co-pending Applications. It is to be understood that such ES and/or MS may also be incorporated into various portions of the EMS speaker system as the counter members and/or units are incorporated into such portions of the EMS speaker system.

As described above, the EMS speaker system of this invention may be provided with multiple defense mechanisms against the undesirable EM waves which are generated by various sources of the speaker system such as, e.g., the drive member and other wiring of the system. In one example, the counter member may be incorporated into various portions of such a system as described above. Accordingly, a single or multiple counter members and/or counter units may be disposed in a two- or three-dimensional paired or concentric arrangement in which the counter members and/or units may be disposed alongside the wave source of the system or may enclose at least a portion of the wave source, respectively. In another example, the ES and/or MS may be incorporated into various portions of the system and shield the electric and/or magnetic waves of the undesirable waves, respectively, where dispositions of such shields have been described in the co-pending Application. In yet another example, not only the counter member (and/or counter unit) but also at least one of the shields may be implemented into such a system so that the counter member (or unit) may cancel the preset portion of the undesirable waves and that the ES and/or MS may absorb and reroute the rest of the undesirable waves.

Configurational and/or operational variations and/or modifications of the EMS speaker systems also fall within the scope of this invention.

Such a system may be an earphone including at least one speaker with the counter member or electric and/or magnetic shields, a headphone including such a speaker, an audio and/or video system including such a speaker, another electric device including such a speaker, a speak of various electric devices, a microphone, an assembly of the speaker and microphone, and the like. Such a system may also be at least two same or different speakers enclosed in a single case member, at least two same or different speakers separately enclosed inside different case members, a pair of earphones, a pair of headphones, an assembly having at least one speaker and at least one microphone, and the like.

Such a relation may relate to a shape and/or a size of the counter member (or counter unit), a shape and/or a size of the voice coil, a shape and/or a size of the magnet, an orientation of the voice coil, counter member (or unit), and/or magnet, an arrangement of the counter member (or unit), voice coil, and/or magnet, amplitudes of the external currents and/or electric source signals flowing through the counter member (or unit) and/or voice coil, directions of the currents and/or signals flowing in the counter member (or unit) and/or voice coil, and the like. The counter member and/or counter unit may also define a curvilinear shape of a wire, an array thereof, a strip, an array thereof, a sheet, an array thereof, a tube, an array thereof, a coil, an array thereof, a mesh, an array thereof, a combination of two or more of such shapes, a mixture of two or more of such shapes, and the like, where the array may also define a shape of a bundle, a braid, a coil, a mesh, and the like. The shape and/or array may define a two-dimensional shape or a three-dimensional shape.

At least two portions of the counter member and/or counter unit may define the same or similar shapes of different sizes. At least two portions of the counter member and/or counter unit may have different shapes of similar or different sizes. At least two of the counter units may define the same or similar shapes of different sizes. At least two of the counter units may define different shapes of the same, similar or different sizes. The counter unit and voice coil may define the same or similar shapes of different sizes or, in the alternative, the counter unit and voice coil may define different shapes of similar or different sizes. The coil may be wound into a two-dimensional or three-dimensional solenoid and/or a toroid. Opposing ends of the solenoid or toroid may be arranged to oppose each other. The coil for the solenoid and/or toroid may include an even number of wires or strips at least two of which may generate the waves defining at least partially opposite phase angles. At least two of the counter units disposed adjacent (or close) to each other may be separated by at least one electric insulator when the units may not be coated by an insulative material, may contact each other when at least one of the units may be coated by the insulative material, and the like.

The counter unit may form an uniform shape and/or size along at least its substantial portion in a direction of its longitudinal axis, may have shapes and/or sizes varying in the direction, and the like. At least two of the counter units may electrically couple with each other in a series, parallel or hybrid pattern. At least two of the counter units may define longitudinal axes and may not electrically couple with each other in at least substantial portions along the axes. At least one of the counter units may enclose therein at least a portion of another counter units in a concentric arrangement, may extend (or be braided) along with the portion of another counter unit in a paired arrangement, and the like. Such a counter member (or unit) may define at least one junction and/or bifurcation therealong. The counter member may include therealong multiple layers at least two of which may operate as at least two of the counter units. The counter member (or unit) may include multiple portions which may couple with each other in series and/or parallel patterns or which may not be coupled to each other. The system may include multiple counter members (or units) which may be coupled to each other in series and/or parallel patterns or which may not be coupled to each other. At least two portions of the counter unit or at least two counter units of the counter member may extend in the same direction while forming a series coupling, where such currents or signals may flow therein with the same amplitude. At least two portions of the counter unit or at least two counter units of the counter member may extend in the same direction while forming a parallel coupling, where the currents or signals may flow therein with the same amplitude or different amplitudes.

The external currents or source signals may flow in at least two portions of the counter unit or at least two counter units of the counter member along the same direction but such at least two of the portions or units may also be wound in opposite directions, thereby canceling at least portions of the magnetic waves emitted thereby. Such currents or signals may flow through at least two portions of the counter unit or at least two counter units of the counter member in opposite directions and such at least two of the portions or counter units may be wound along the same direction, thereby canceling at least portions of the magnetic waves emitted thereby. The counter member and driver member may define substantially identical, similar or different resonance frequencies. The counter member and at least one of the voice coil and magnet may have identical, similar or different resonance frequencies. At least two portions of the counter unit or at least two counter units of the counter member may also define resonance frequencies which may be different from those of the rest thereof. At least one of multiple portions of the counter unit or at least one counter unit of the counter member may define a resonance frequency different from those of the rest thereof. At least one of multiple portions of the counter unit or at least one counter unit of the counter member may also be made of and/or include a different material, define a different resonance frequency, and have a different spectrum from that of the rest of the portions of the counter unit and from that of the rest of the counter units of the counter member, respectively. At least two portions of the counter unit or at least two counter units of such a counter member may be made of and/or include at least one common material and one of such at least two portions or units may include at least one frequency-modulating agent and define such spectrum which may overlap only preset portions of the spectrum of another of such two of the units but may not overlap the rest of the spectrum thereof. The preset portions of the electromagnetic waves may include low-frequency waves having frequencies less than 300 kHz, very low-frequency waves of frequencies less than 30 kHz, ultra low-frequency waves of frequencies less than 3 kHz, extremely low-frequency waves of frequencies less than 300 Hz, carrier frequencies in a range of from about 50 Hz to about 60 Hz, and the like. At least one portion of the counter unit or at least one counter unit of the counter member may be made of and/or include at least one material irradiating infrared rays including far-infrared rays, medium-infrared rays, and near-infrared rays as the current flows therein. The rest of the electromagnetic waves may be far infrared rays in a frequency range from about 300 gHz to about 10 tHz, medium infrared rays in a frequency range from about 10 tHz to about 100 tHz, a near infrared rays in a frequency range from about 100 tHz to about 700 tHz, and the like.

The system may include at least one of the magnetic shields described hereinabove or in the co-pending Applications. The magnetic shields may be disposed in, on, over, around, and/or through at least one of the members. The magnetic shields may define shapes at least partially conforming to shapes of at least one of the members of the system or, in the alternative, may define shapes at least partially different from shapes of at least one of the members. The path member may define a relative magnetic permeability greater than 1,000 or 10,000. The pole of the magnet member may be a South pole. The shunt member may directly or indirectly contact the magnet member. Such a shunt member may define a relative magnetic permeability greater than 1,000, 10,000 or higher. The magnetic shields described hereinabove or disclosed in the co-pending Applications may also be incorporated into any of the prior art devices and define novel systems of this invention. The system may further include at least one of the electric shields described hereinabove or in the co-pending Applications. The electric shields described hereinabove or disclosed in the co-pending Applications may be incorporated into any of the prior art devices and define novel systems of this invention. Such magnetic and/or electric shields may form shapes and/or sizes which may be maintained uniform along a longitudinal axis of at least one of the members or which may vary therealong. Such shapes and/or sizes of the magnetic shields and/or electric shields may be identical to, similar to or different from those of at least one of the members. The system may include multiple magnetic and/or electric shields. At least two of such magnetic and/or electric shields may shield against the magnetic waves and/or electric waves having same or different frequencies in same or different extents. The magnetic and/or electric shields may be disposed over at least a portion (or entire portion) of at least one of the members. The system may include the counter member and at least one of the electric shields and magnetic shields. At least one of the members may operate on AC or DC.

Unless otherwise specified, various features of one embodiment of one aspect of the present invention may apply interchangeably to other embodiments of the same aspect of this invention and/or embodiments of one or more of other aspects of this invention. Therefore, the counter member or unit of FIG. 1B may correspond to any of those exemplified in FIGS. 2A to 2X, and may also be disposed in any of the portions of the EMS speaker system exemplified in FIGS. 3A to 3L. In addition, the counter member of FIG. 2L may define an array of multiple counter units of various shapes described above. Similarly, each of the counter members or units shown in FIGS. 2M to 2R may correspond to any of the counter members or units exemplified in FIGS. 2A to 2L.

As described hereinabove, the EMS speaker system may include a control member which may be arranged to manipulate various operations of the system, in particular, an operation for canceling the desired portion of the undesirable waves emitted by the wave source of the system. To this end, the control member may perform various control operations such as, e.g., manipulating the amplitudes and/or directions of the external signals or source signals supplied to the counter member, monitoring the undesirable waves and manipulating the counter member to emit the counter waves accordingly, offering various options to the user for selecting a suitable canceling operation, and the like.

Various EMS speaker systems of this invention may operate on the AC power while canceling the preset portion of the undesirable EM waves by their counter members. When desirable, such EMS speaker systems may also operate on the DC power while similarly canceling the preset portion of the undesirable waves. It is appreciated that such systems may also employ any conventional modalities capable of shielding or canceling such undesirable waves. Accordingly, it is preferable that any extra wires other than the counter members or counter units may be braided, bundled, and/or concentrically fabricated in order to minimize irradiation of the undesirable waves.

It is to be understood that, while various aspects and embodiments of the present invention have been described in conjunction with the detailed description thereof, the foregoing description is intended to illustrate and not to limit the scope of the invention, which is defined by the scope of the appended claims. Other embodiments, aspects, advantages, and modifications are within the scope of the following claims.

What is claimed is:

1. An electromagnetically-shielded speaker system capable of generating audible sounds based on electric source signals supplied thereto while minimizing irradiation of undesirable electromagnetic waves to an user comprising:

a case member which is configured to define at least one opening therethrough;

a drive member which is configured to be disposed in said case member and to include at least one cone, at least one voice coil, and at least one magnet, wherein said magnet is configured to form a static magnetic field therearound, wherein said voice coil is configured to be fixedly coupled to said cone, to receive said signals, and to form a dynamic magnetic field therearound as said signals flow therein while irradiating said undesirable waves, and wherein said cone is configured to vibrate due to interactions between said magnetic fields while generating said sounds; and a counter member which is configured to be coupled to at least one of said case member and drive member in a preset relation to at least one of said voice coil and magnet and to irradiate counter electromagnetic waves capable of canceling at least a substantial portion of said undesirable waves due to said preset relation, thereby minimizing said irradiation without affecting said sounds, wherein said counter member is configured to define a shape which is configured to not conform to at least one of said voice coil and magnet but to generate said counter waves capable of canceling said portion of said undesirable waves according to said preset relation.

2. An electromagnetically-shielded speaker system capable of generating audible sounds based on electric source signals supplied thereto while minimizing irradiation of undesirable electromagnetic waves to an user comprising:

a case member which is configured to define at least one opening therethrough;

a drive member which is configured to be disposed in said case member and to include at least one cone, at least one voice coil, and at least one magnet, wherein said magnet is configured to form a static magnetic field therearound, wherein said voice coil is configured to be fixedly coupled to said cone, to receive said signals, and to form a dynamic magnetic field therearound as said signals flow therein while irradiating said undesirable waves, and wherein said cone is configured to vibrate due to interactions between said magnetic fields while generating said sounds; and a counter member which is configured to be coupled to at least one of said case member and drive member in a preset relation to at least one of said voice coil and magnet and to irradiate counter electromagnetic waves capable of canceling at least a substantial portion of said undesirable waves due to said preset relation, thereby minimizing said irradiation without affecting said sounds, wherein:

at least two of said drive members are disposed inside said case member, and said counter member is then configured to irradiate said counter waves capable of canceling said portion of a sum of said undesirable waves irradiated by both of said drive members according to said preset relation.

3. An electromagnetically-shielded speaker system capable of generating audible sounds based on electric source signals supplied thereto while minimizing irradiation of undesirable electromagnetic waves to an user comprising:

a case member which is configured to define at least one opening therethrough;

a drive member which is configured to be disposed in said case member and to include at least one cone, at least one voice coil, and at least one magnet, wherein said magnet is configured to form a static magnetic field therearound, wherein said voice coil is configured to be fixedly coupled to said cone, to receive said signals, and to form a dynamic magnetic field therearound as said signals flow therein while irradiating said undesirable waves, and wherein said cone is configured to vibrate due to interactions between said magnetic fields while generating said sounds;

a counter member which is configured to be coupled to at least one of said case member and drive member in a preset relation to at least one of said voice coil and magnet and to irradiate counter electromagnetic waves capable of canceling at least a substantial portion of said undesirable waves due to said preset relation, thereby minimizing said irradiation without affecting said sounds; and at least one insert which is configured to be made of at least one of a magnetically soft material and a magnetically hard material, to couple with said counter member, and to augment said counter waves.

* * * * *